US007911400B2

(12) United States Patent
Kaplan et al.

(10) Patent No.: US 7,911,400 B2
(45) Date of Patent: Mar. 22, 2011

(54) APPLICATIONS FOR LOW PROFILE TWO-WAY SATELLITE ANTENNA SYSTEM

(75) Inventors: Ilan Kaplan, North Bethesda, MD (US); Mario Ganchev Gachev, Sofia (BG); Bercovich Moshe, McLean, VA (US); Danny Spirtus, Holon (IL)

(73) Assignee: Raysat Antenna Systems, L.L.C., Vienna, VA (US)

( * ) Notice: Subject to any disclaimer, the term of this patent is extended or adjusted under 35 U.S.C. 154(b) by 0 days.

(21) Appl. No.: 11/647,576

(22) Filed: Dec. 29, 2006

(65) Prior Publication Data

US 2008/0018545 A1 Jan. 24, 2008

Related U.S. Application Data

(63) Continuation-in-part of application No. 11/320,805, filed on Dec. 30, 2005, now Pat. No. 7,705,793, which is a continuation-in-part of application No. 11/074,754, filed on Mar. 9, 2005, now abandoned, and a continuation-in-part of application No. 10/925,937, filed on Aug. 26, 2004, and a continuation-in-part of application No. 11/071,440, filed on Mar. 4, 2005, and a continuation-in-part of application No. 10/498,668, filed on Jun. 10, 2004, now Pat. No. 6,995,712, and a continuation-in-part of application No. PCT/US2005/028507, filed on Aug. 10, 2005, and a continuation-in-part of application No. 11/320,805, filed on Dec. 30, 2005, and a continuation-in-part of application No. 11/324,775, filed on Jan. 3, 2006, and a continuation-in-part of application No. 11/183,007, filed on Jul. 18, 2005, and a continuation-in-part of application No. 10/752,088, filed on Jan. 7, 2004, and a continuation-in-part of application No. 11/374,049, filed on Mar. 14, 2006.

(60) Provisional application No. 60/650,122, filed on Feb. 7, 2005, provisional application No. 60/653,520, filed on Feb. 17, 2005.

(51) Int. Cl.
*H01Q 1/34* (2006.01)

(52) U.S. Cl. ..... 343/713

(58) Field of Classification Search ..... 343/711–713
See application file for complete search history.

(56) References Cited

U.S. PATENT DOCUMENTS 3,565,650 A 2/1971 Cordon (Continued)

FOREIGN PATENT DOCUMENTS

EP 0572933 12/1993

(Continued)

OTHER PUBLICATIONS

D. Chang et al., "Compact Antenna Test Range Without Reflector Edge Treatment and RF Anechoic Chamber", IEEE Antenna & Propagation Magazine, vol. 46, No. 4, pp. 27-37, dated Aug. 2004.

(Continued)

*Primary Examiner* — Huedung Mancuso
(74) *Attorney, Agent, or Firm* — Banner & Witcoff, Ltd.

(57) ABSTRACT

Antenna and satellite communications assemblies and associated satellite tracking systems that may include a low profile two-way antenna arrangement, tracking systems, and applications thereof. Applications for the system include military, civilian, and domestic emergency response applications. The antenna arrangements may be configured to form a spatial multi-element array able to track a satellite in an elevation plane by electronically dynamically targeting the antenna arrangement and/or mechanically dynamically rotating the antenna arrangements about transverse axes giving rise to generation of respective elevation angles and dynamically changing the respective distances between the axes whilst maintaining a predefined relationship between said distances and the respective elevation angles. The system provides autonomous dynamic tracking of satellite signals and can be used for satellite communications on moving vehicles in a variety of frequency bands for military and civilian applications.

18 Claims, 36 Drawing Sheets

U.S. PATENT DOCUMENTS

| | | | | |
|---|---|---|---|---|
| 4,101,335 | A | 7/1978 | Barrable et al. | |
| 4,771,293 | A | 9/1988 | Williams | |
| 4,811,026 | A | 3/1989 | Bisset | |
| 4,903,033 | A | 2/1990 | Tsao et al. | |
| 5,005,019 | A | 4/1991 | Zaghloul et al. | |
| 5,038,152 | A * | 8/1991 | Wong et al. | 343/756 |
| 5,043,738 | A | 8/1991 | Shapiro et al. | |
| 5,076,986 | A | 12/1991 | Delvaux et al. | |
| 5,207,830 | A | 5/1993 | Cowan et al. | |
| 5,245,348 | A * | 9/1993 | Nishikawa et al. | 342/359 |
| 5,303,393 | A | 4/1994 | Noreen et al. | |
| 5,379,320 | A | 1/1995 | Fernandes et al. | |
| 5,408,241 | A | 4/1995 | Shattuck et al. | |
| 5,528,250 | A | 6/1996 | Sherwood et al. | |
| 5,706,015 | A | 1/1998 | Chen et al. | |
| 5,725,652 | A | 3/1998 | Shulman | |
| 5,835,057 | A | 11/1998 | van Heyningen | |
| 5,929,819 | A | 7/1999 | Grinberg | |
| 5,956,372 | A | 9/1999 | Vaman et al. | |
| 6,018,320 | A | 1/2000 | Jidhage et al. | |
| 6,023,244 | A | 2/2000 | Saygg et al. | |
| 6,043,788 | A | 3/2000 | Seavey | |
| 6,111,542 | A | 8/2000 | Day et al. | |
| 6,124,832 | A | 9/2000 | Jeon et al. | |
| 6,134,423 | A | 10/2000 | Wiedeman et al. | |
| 6,157,817 | A | 12/2000 | Norin et al. | |
| 6,191,734 | B1 | 2/2001 | Park | |
| 6,191,744 | B1 | 2/2001 | Snow et al. | |
| 6,218,999 | B1 | 4/2001 | Bousquet et al. | |
| 6,311,128 | B1 | 10/2001 | Prum et al. | |
| 6,317,096 | B1 | 11/2001 | Daginnus et al. | |
| 6,377,211 | B1 | 4/2002 | Hsiung | |
| 6,407,714 | B1 | 6/2002 | Butler et al. | |
| 6,483,472 | B2 | 11/2002 | Cipolla et al. | |
| 6,486,845 | B2 | 11/2002 | Ogawa et al. | |
| 6,496,158 | B1 | 12/2002 | Ksienski et al. | |
| 6,636,721 | B2 | 10/2003 | Threadgill et al. | |
| 6,639,548 | B2 | 10/2003 | Courtney et al. | |
| 6,678,520 | B1 | 1/2004 | Wang | |
| 6,695,398 | B2 | 2/2004 | Racine et al. | |
| 6,707,432 | B2 | 3/2004 | Strickland | |
| 6,710,749 | B2 | 3/2004 | King | |
| 6,807,222 | B1 | 10/2004 | Widdowson | |
| 6,839,039 | B2 | 1/2005 | Tanaka et al. | |
| 6,873,256 | B2 * | 3/2005 | Lemelson et al. | 340/539.1 |
| 6,900,769 | B2 | 5/2005 | Schlieber et al. | |
| 6,922,145 | B2 | 7/2005 | Piesinger | |
| 6,927,736 | B1 | 8/2005 | Kornbau et al. | |
| 6,957,702 | B2 | 10/2005 | Brothers et al. | |
| 6,965,343 | B1 | 11/2005 | Dybdal et al. | |
| 6,987,489 | B2 | 1/2006 | Melconian et al. | |
| 6,999,036 | B2 | 2/2006 | Stoyanov et al. | |
| 7,227,508 | B2 | 6/2007 | Wang et al. | |
| 7,339,520 | B2 | 3/2008 | Chang et al. | |
| 7,492,322 | B2 | 2/2009 | Jung et al. | |
| 7,532,694 | B2 | 5/2009 | Hwang et al. | |
| 2001/0027146 | A1 | 10/2001 | Spaziani et al. | |
| 2002/0041328 | A1 | 4/2002 | LeCompte et al. | |
| 2002/0132578 | A1 | 9/2002 | Wiedeman | |
| 2002/0167449 | A1 | 11/2002 | Frazita et al. | |
| 2003/0060156 | A1 | 3/2003 | Giaccherini et al. | |
| 2003/0090416 | A1 | 5/2003 | Howell et al. | |
| 2003/0097658 | A1 | 5/2003 | Richards | |
| 2003/0181161 | A1 | 9/2003 | Harles et al. | |
| 2003/0214449 | A1 | 11/2003 | King | |
| 2003/0222778 | A1 | 12/2003 | Piesinger | |
| 2004/0087294 | A1 | 5/2004 | Wang | |
| 2004/0090352 | A1 | 5/2004 | Jaffe et al. | |
| 2004/0092228 | A1 | 5/2004 | Force et al. | |
| 2005/0113040 | A1 | 5/2005 | Walker et al. | |
| 2005/0126430 | A1 | 6/2005 | Lightner et al. | |
| 2005/0229235 | A1 | 10/2005 | Loyer | |
| 2006/0176227 | A1 | 8/2006 | Fujii et al. | |
| 2006/0244669 | A1 | 11/2006 | Mansour et al. | |
| 2006/0250285 | A1 | 11/2006 | Jaffe et al. | |
| 2006/0268738 | A1 | 11/2006 | Goerke et al. | |
| 2007/0027624 | A1 | 2/2007 | Powe et al. | |
| 2007/0252765 | A1 * | 11/2007 | Jayasuriya et al. | 343/702 |

FOREIGN PATENT DOCUMENTS

| | | | |
|---|---|---|---|
| EP | 0810685 | A2 | 12/1997 |
| EP | 0985646 | | 3/2000 |
| WO | WO 99/31757 | | 6/1999 |
| WO | 0111718 | A | 2/2001 |
| WO | 02097919 | A | 12/2002 |
| WO | 2004075339 | A | 9/2004 |
| WO | 2006004813 | | 1/2006 |

OTHER PUBLICATIONS

K-L Wong et al., "Broad-Band Single-Patch Circularly Plarized Microstrip Antenna Withdual Capacitivity Coupled Feeds", IEEE Transactions on Antenna and Propagation, vol. 49, No. 1, pp. 41-44, dated Jan. 2001.

RaySat Inc.: Press release, Online,Jan. 6, 2005, retrieved from the Internet: http://www.raysat.us/news/release/01-16-05-internet.asp.

EP 06127356.1 extended Search Report dated Nov. 1, 2007.

* cited by examiner

Two-way semi- electronic scanning antenna application

Fig. 44

| Parameter | Specified value | Notes |
|---|---|---|
| Frequency range Tx, GHz | 14.0-14.50 | |
| Frequency range Rx, GHz | 11.7-12.75 | |
| Polarization Rx / Tx | Dual Linear | FSS |
| Az beam coverage, deg | 0 – 360 | |
| El beam coverage, deg | 10 – 70 | |
| EIRP, dBW | 30.8 | |
| G/T, dB/K | 5 | |
| Gain of sidelobe peaks envelope in Az, dBi | 29-25Log(θ) dBi<br>1≤θ≤7.0 deg;<br>8 dBi<br>7.0<θ≤9.2 deg;<br>32-25Log(θ) dBi<br>9.2<(θ)≤48 deg;<br>-10 dBi<br>48<(θ)≤180 deg | FCC 25.209 |
| Cross-Polarization Gain envelope in Az, dBi | 19-25Log(θ) dBi<br>1.8≤θ≤7.0 deg;<br>-2 dBi<br>7.0<θ≤9.2 deg; | FCC 25.209 |
| IF input / output, MHz | 950 – 1450 / 950 – 1950 | |
| Output dynamic range, dBm | -50 ÷ 0 | |
| Output /Input Impedance, ohm | 50 | |
| External DC voltage, V | 10.5 – 14.0 | 12V nominal |
| Satellite recognition | Modem | |
| Satellite tracking | Gyro modules / RSSI | |
| Acquisition time less than, s | 60 | |
| Tracking speed, deg/s | 60 | |
| Az. Tracking error, deg | < 0.75 | @ 60 deg/s |
| Az tracking error, deg | < 0.5 | @ 30 deg/s |
| Polarization tracking. error, deg | +/-3 | |
| Polarization angle control of linear polarization | Automatic | Rx and Tx |
| Dimensions L x W x H, mm | 1150 x 900 x 170 | |
| Weight, kg | 28 | ODU (without sat. receiver) |
| Power consumption | 75 | ODU+IDU (without sat. receiver) |
| Interface | Cable or Wi-Fi | |

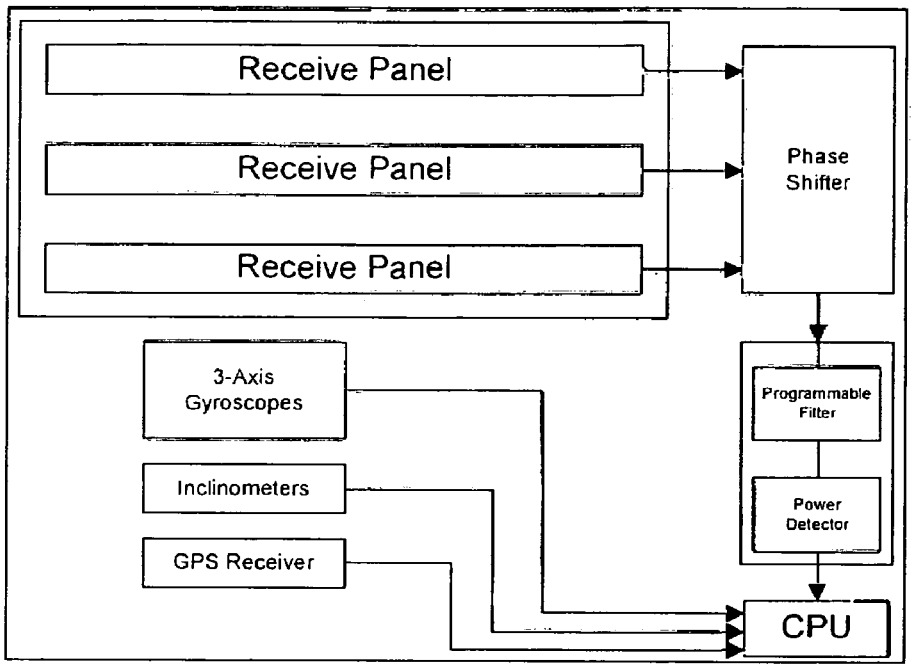
Figure 47. Diagram of Tracking Method.
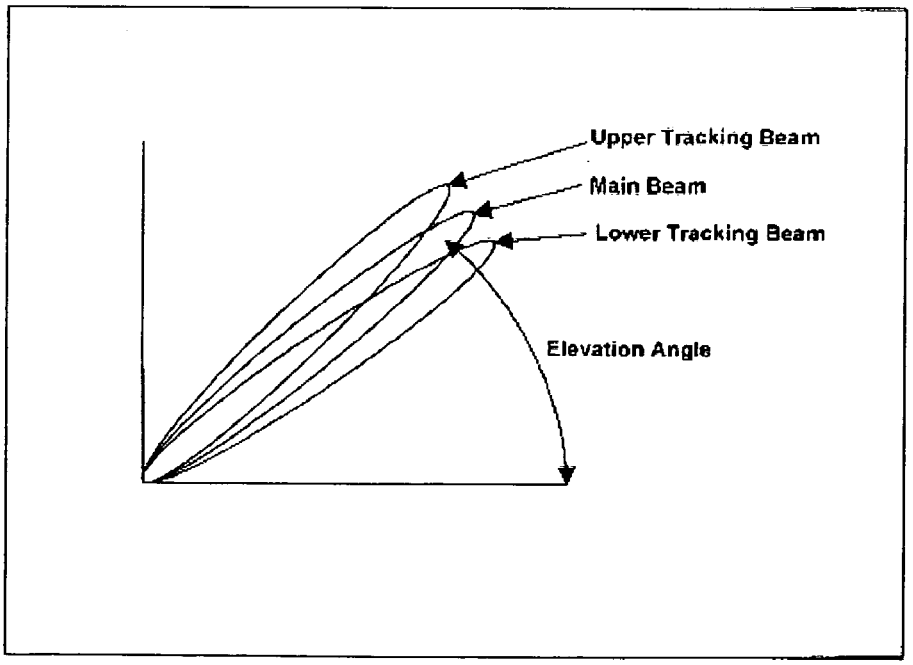
Figure 48. Beam generation in the elevation plane

APPLICATIONS FOR LOW PROFILE TWO-WAY SATELLITE ANTENNA SYSTEM

CROSS REFERENCE TO RELATED APPLICATIONS

The present invention is a continuation-in-part of U.S. application Ser. No 11/320,805, filed Dec. 30, 2005 now U.S. Pat. No. 7,705,793 which application claims benefit under 35 USC §119(e)(1) of U.S. Provisional Application No. 60/650,122 filed Feb. 7, 2005, and of U.S. Provisional Application No. 60/653,520, filed Feb. 17, 2005 and claims benefit under 35 USC §120 of the following United States applications in which this application is a continuation-in-part of U.S. application Ser. No. 11/074,754, filed Mar. 9, 2005 now abandoned; U.S. application Ser. No. 10/925,937, filed Aug. 26, 2004; U.S. application Ser. No. 11/071,440, filed Mar. 4, 2005; U.S. application Ser. No. 10/498,668, filed Jun. 10, 2004, now U.S. Pat. No. 6,995,712, issued Feb. 7, 2006, PCT/US05/28507, filed Aug. 10, 2005, U.S. patent application Ser. No. 11/320,805 filed Dec. 30, 2005 (Publication Number 20060284775 published Dec. 21, 2006), U.S. patent application Ser. No. 11/324,775 filed Jan. 3, 2006 (Publication Number 20060273967 published Dec. 7, 2006), U.S. patent application Ser. No. 11/183,007 filed on Jul. 18, 2005, U.S. patent application Ser. No. 10/752,088, filed Jan. 7, 2004, and U.S. patent application Ser. No. 11/374,049, files Mar. 14, 2006 (Publication Number 20060273965 published Dec. 7, 2006). Each of the foregoing applications is hereby specifically incorporated by reference in their entirety herein. With respect to any definitions or defined terms used in the claims herein, to the extent that the terms are defined more narrowly in the applications incorporated by reference with respect to how the terms are defined in this application, the definitions in this application shall control.

TECHNICAL FIELD

The present invention relates generally to mobile antenna systems with steerable and tracking beams and more particularly to applications for low profile steerable antenna systems for use in mobile satellite communications, where it is understood that stationary applications are inherently included.

BACKGROUND

There is an ever increasing need for communications via satellites, including reception of satellite broadcasts such as television and data and also transmission via satellites to and from vehicles such as trains, cars, SUVs etc. that are fitted with one or more receivers and/or transmitters, not only when the vehicle is stationary (such as during parking) but also when it is moving.

The known antenna systems for mobile satellite reception (e.g., Direct Broadcast Satellite (DBS)) reception can be generally divided into several main types. One type utilizes a reflector or lens antenna with fully mechanical steering. Another type uses phased array antennas comprised of a plurality of radiating elements. The mechanically steerable reflector antenna has a relatively large volume and height, which, when enclosed in the necessary protective radome for mobile use, is too large and undesirable for some mobile applications, especially for ground vehicles. For use with in-motion applications, the antenna housing as a whole should be constrained to a relatively low height profile when mounted on a vehicle.

The array type comprises at least three sub-groups depending on the antenna beam steering means: 1) fully electronic (such as the one disclosed in U.S. Pat. No. 5,886,671 Riemer et al.); 2) fully mechanical steering; and 3) combined electronic and mechanical steering. The present invention relates to the latter two sub-groups.

Other patents related to antenna systems include U.S. Pat. Nos. 6,975,885, 6,067,453, 5,963,862, 5,963,862, 6,977,621, 6,950,061, 5,835,057, 5,835,057, 6,977,621, 6,653,981, 6,204,823 and U.S. Patent Publication: 20020167449.

Phased array antennas are built from a certain number of radiating elements displaced in a planar or conformal lattice arrangement with suitable shape and size. They typically take the form of conformal or flat panels that utilize the available space more efficiently than reflector solutions and therefore can provide a lower height profile. In certain cases the mentioned panel arrangements can be divided into two or more smaller panels. Such an antenna for DBS receiving is described in A MOBILE 12 GHZ DBS TELEVISION RECEIVING SYSTEM, authored by Yasuhiro Ito and Shigeru Yamazaki in "IEEE Transactions on Broadcasting," Vol. 35, No. 1, March 1989 (hereinafter "the Ito et al. publication").

There is a need in the art to provide a mobile antenna system with low profile and better radiation pattern keeping relatively low cost, suitable for mounting on moving platforms where the size is an issue as is the case in military vehicles, public safety vehicles, RVs, trains, SUVs, buses, boats etc.

BRIEF SUMMARY

This Summary is provided to introduce selected features of the invention more particularly shown in the Detailed Description below. This Summary is not intended to limit the many inventions described in the Detailed Description but merely to highlight some of these inventions in a simplified context. The inventions are defined by the claims and the summary is not intended nor shall it be used to import limitations into the claims which are not contained therein.

In some aspects of the invention, a method may include applications of low profile mobile two-way satellite terminals and systems to military applications.

In still further aspects of the invention, the military applications shall include command and control applications.

In further aspects of the invention, the military applications shall include surveillance and position reporting applications.

In further aspects of the invention, the military applications shall include medical applications including telemedicine.

In further aspects of the invention, the military applications shall include logistics applications.

In further aspects of the invention, the military application shall include 'sense and respond' logistics, Movement and Tracking and all active, and passive RFID applications, communications and interconnections whether mobile or stationary.

In further aspects of the invention, the military applications shall include targeting applications.

In further aspects of the invention, the military applications shall include battle field control applications including targeting applications.

In further aspects of the invention, the military applications shall include convoy protection including forwarded real time information from unmanned aerial vehicles In further aspects of the invention, the military applications shall include stationary and mobile wide area relay and satellite backhaul of SINCGARS, EPLRS and future Warfighter Information Network-Tactical (WIN-T), Command and control On the move Network-Digital Over the horizon Relay (CONDOR), Joint Tactical Radio Systems (JTRS) components, applications and all relevant voice, video and data whether encrypted or "in the clear".

In further aspects of the invention, the military applications relevant to Maritime and all Electronic Naval Warfare to include US Coast Guard applications, communications, computing, intelligence, surveillance, reconnaissance interconnections and/or backhaul.

In further aspects of the invention, the US military, North Atlantic Treaty Organization (NATO) and Coalition Partners in conjunction with "present day" theater of operation or Area of Responsibility (AOR), all fixed and mobile satellite communications with interfaces and/or backhaul to the Non-classified Internet Protocol Routed network (NIPRnet), Secure Internet Protocol Routed network (SIPRnet), NATO and "present day" Coalition partner networks.

In further aspects of the invention, the 50 state and all US territories Army and Air National Guard networks including interfaces and/or backhaul of all stationary or mobile Guardnet, NIPRnet, SIPRnet and state and/or territory specific network while operating under State control or Title 10, all relevant voice, video, data and internet applications In still further aspects of the invention, the applications of the low profile two-way mobile satellite terminal shall include public safety applications such as first responder applications.

In further aspects of the invention, the first responder applications shall include disaster relief applications.

In further applications of the invention, the applications shall include situation and position reporting and interaction with command centers such as for border patrol, emergency locales, crime scenes, and rescue operations.

In further applications of the invention, the mobile terminals may be moved into areas where conventional communications have been disrupted and used as temporary communications nodes for all types of communications including voice, video, data, location based tracking (e.g., GPS tracking via the Internet) and Internet. The terminals may be active during the movement into such areas and also act as stationary terminals upon arrival. In combination with, for example, a Wi-Fi device, the terminal may act as a "hot spot" or subnet of an Internet network.

In further applications of the invention, the mobile satellite terminals whether operating on the move or in a stationary position, providing satellite communications interfaces for portable cellular sites/nodes and voice interoperability applications for legacy P25 or generic Land Mobile Radio (LMR) to cellular, to Voice over Internet Protocol (VoIP), to traditional Plain Old Telephone System (POTS) and/or interconnection to Private Branch Exchange (PBX) to include Military, all National Guard, First Responder, NATO, "present day" Coalition partners, Healthcare or private Enterprise regardless of National boundaries or individual satellite voice, video, data and internet communications and all relevant computing infrastructure.

In other aspects of the invention, the two-way, low profile, mobile satellite terminal may be constructed and mounted on many types of vehicles for military applications including but not limited to: the roof of a vehicle cab; a convenient surface of a tank such as behind the hatch; the rear part of a tank turret away from the cannon end; the flat portion of a tank behind the turret.

In further aspects of the invention, the two-way, low profile, mobile satellite terminal may be mounted to the top of a variety of other vehicles including, but not limited to HMMWV (High-Mobility Multipurpose Wheeled Vehicle) also sometimes known as "humvee"; Joint Tactical Light Vehicle (JLTV); Stryker, and ambulance; bus; or truck.

In further aspects of the invention, the two-way, low profile, mobile satellite terminal may be mounted to the roof or other structure of an aircraft or military aircraft (such as C-17 and C-130).

In further aspects of the invention, the two-way, low profile, mobile satellite terminal may be mounted to a convenient surface of a helicopter such as in front of the tail section and behind the main cockpit or behind the rotor.

In still further aspects of the invention, an antenna apparatus may include multiple network links to various aspects of the command and control structure.

In other aspects of the invention, the various aspects of the command and control structure include surveillance, position reporting, intelligence and logistics.

In other aspects of the invention, the acquisition and tracking of the appropriate satellite by the terminal may be autonomous, requiring no inertial navigation from the vehicle, in other words, the beam tracking may be accomplished by a tracking system without accessing the navigational system in the vehicle. But rather detecting and tracking on the signal strength (level).

In other aspects of the invention, the acquisition and tracking may be accomplished by an "obedient" mode that bypasses the autonomous mode and permits the control of the beam position using at least a portion of the vehicle's navigation system.

In other aspects of the invention, the terminal may use modulations and forward error correction rates that permit it to radiate signals satisfying regulatory (e.g. FCC and ITU) restrictions on the power spectral density (PSD) intended to limit inter-system interference.

In other aspects of the invention, the terminal may utilize spread spectrum signals to reduce the power spectral densities and limit potential interference.

In other aspects of the invention, various specific designs allow the use of smaller terminals with simplified designs to permit two-way operation at lower data rates.

In other aspects of the invention the a potential implementation of satellite network in conjunction with an inclined satellite can be perform as the terminal tracks based on signal strength (rather than position). This capability will provide a significant saving operating the satellite network in conjunction with the terminal.

In other aspects of the invention, several satellite frequency band can be implemented such as Ku-Band, Ka-Band, X-Band, and L-Band.

In other aspects of the invention, the terminal FCC application shows that it is protecting other licensed users of the Ku-Band. Which includes: coordinating the use of the antenna with the satellite operators of all satellites that operate adjacent to the satellites that the RaySat antennas will be communicating with; Coordinate with NASA to ensure protection of "exclusion zones" within the antenna firmware that prevent the antenna from operating in specified locations; And a similar coordination with the National Science Foundation.

These and other aspects will be described in greater detail below. The invention is specifically contemplated to include any of the foregoing aspects of the invention in any combination and may further include additional aspects of the invention from the text below in any combination. In particular, when viewed in relation to the prior art cited herein, one skilled in the art will recognize numerous applications and minor design variations from the description herein and this summary section is not limiting as to the inventive concepts disclosed herein, which will only be defined by any final claims issuing in a patent.

BRIEF DESCRIPTION OF THE DRAWINGS

A more complete understanding of the features described herein and the advantages thereof may be acquired by referring to the following description by way of example in view of the accompanying drawings, in which like reference numbers indicate like features, and wherein:

FIG. 44 is a table illustrating exemplary performance of a system embodying the antennas illustrated in FIGS. 46-43;

FIG. 45 illustrates an exemplary block diagram of the antenna shown in FIGS. 39-44 which may be configured as a reduced size transmit-receive antenna terminal applicable to a specialized dedicated mobile service;

FIG. 47 illustrates the functional diagram describing terminal tracking principles;

FIG. 48 illustrates the application of the elevation tracking beams;

DETAILED DESCRIPTION

In the following description of the various embodiments, reference is made to the accompanying drawings, which form a part hereof, and in which is shown by way of illustration various embodiments in which the invention may be practiced. It is to be understood that other embodiments may be utilized and structural and functional modifications may be made without departing from the scope and spirit of the present invention.

Figure 1:
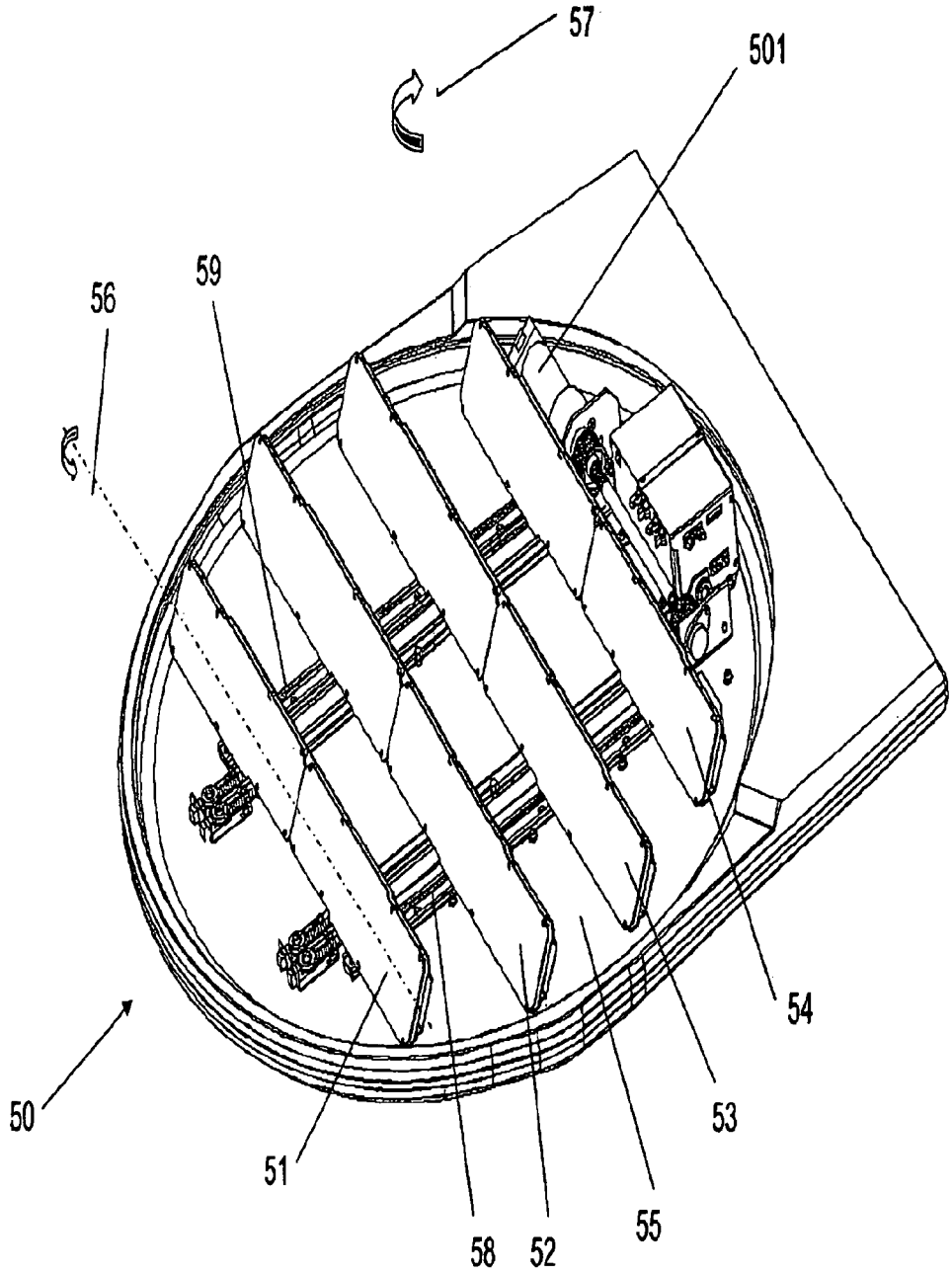
FIG. 1 illustrates an antenna unit in accordance with embodiments of the invention.
Figure 3A:
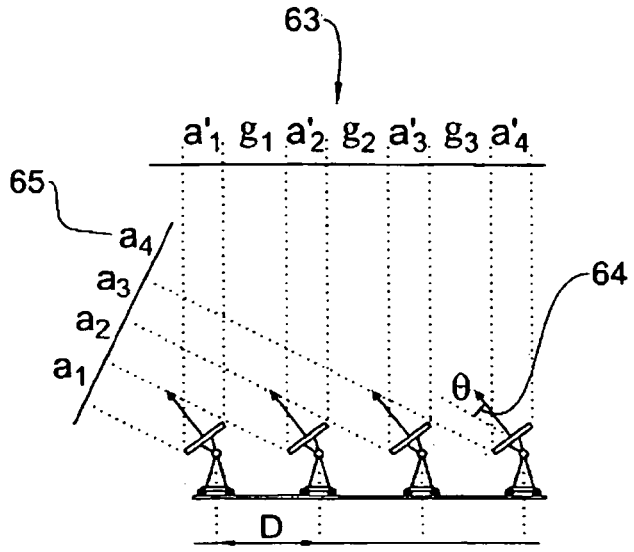
FIG. 3A-3C illustrate schematically a side view of an antenna unit in different elevation angles, in accordance with embodiments of the invention.
Figure 3B:
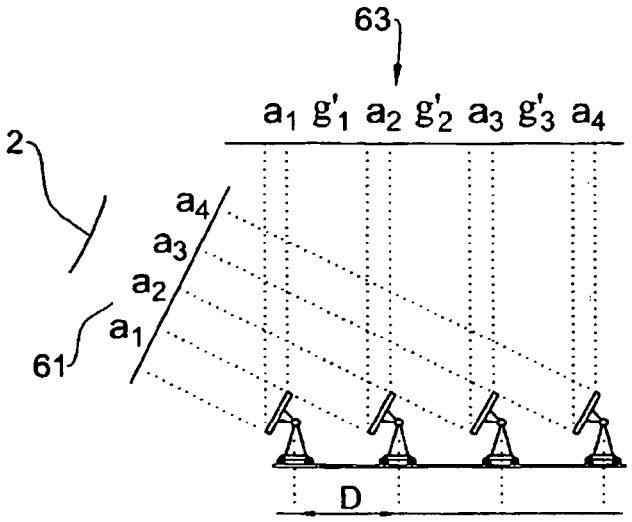
Figure 3C:
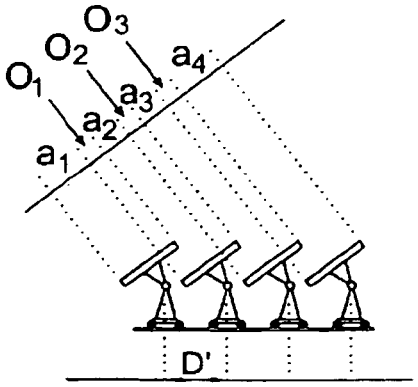

FIG. 1 illustrates a perspective view of an antenna unit 50, in accordance with an embodiment of the invention. In this exemplary embodiment, four antenna arrangements (51 to 54) may be mounted on a common rotary platform 55 using any suitable arrangement such as carriages/bearings disposed about at the center of each end of the antenna arrangement. In alternative embodiments, the antenna elements may be controlled using electronic steering such as a stepper motor, motor controller, angular rotation mechanism or other suitable arrangement. In the exemplary embodiment shown in FIG. 1, the carriages provides mechanical bearing for a traversal about an axis of rotation (see, for example, 56 marked in dashed line in FIG. 1) about perpendicular to the elevation plane of the antenna arrangement. In exemplary embodiments, the rotation of the antenna arrangement around the axis provides its elevation movement giving rise to different elevation angles as shown in FIGS. 3A to 3C. Although the elevation angles in this embodiment are provided via mechanical means, a lower profile may be achieved by using electronic steering of the elevation angles, thus eliminating the mechanical axis of rotation. This has the advantage of reducing the height. This alternative embodiment is set forth more fully below.

The rotation of the beam in the azimuth plane may be realized by any suitable mechanism. Exemplary mechanisms include electronic steering, which can increase costs but has the advantage of increasing reliability. The rotation in the azimuth plane may also be realized by rotating the rotary platform 55 about axis 57, typically disposed about normal thereto. Note that in this exemplary embodiment, the steering in the azimuth plane is performed mechanically using a mechanical driving mechanism, but electronic steerable antenna elements are also within the scope of the invention as more fully set forth below. It should be understood that the invention is, however, not bound by mechanical movement in the azimuth plane or in the elevation plane, again as more fully set forth below.

Returning to the elevation plane, in exemplary embodiments, the axes of rotation of two or more and/or all antenna arrangements may be disposed parallel each to other. For example, on the rotary platform 55 there may be mounted two rails 58 and 59 joined with the carriages, at their bottom side using a mechanical mechanism such as wheels or bearings. This may facilitate slide motion of the carriages in the rails 58 and 59. In this manner, a linear guided movement in direction perpendicular to the axes of rotation of the antenna arrangements may be achieved, to thereby modify the distance between the axes of the antenna arrangements (e.g. D, D1 and D2 shown in FIGS. 3A to 3C). An electrical motor with proper gears (not shown) may be provided for providing movement of the carriages in the rails. Note that the electrical motor and associated gears are a non-limiting example of driving mechanism and those skilled in the art will recognize other driving mechanisms. In still alternate embodiments, the drive motors and rails may be replaced by electrical switching a planar array antenna such that different elements disposed a different distance apart may be activated with appropriate relative amplitude and phase or time delay. The outputs of the selected elements may be input into the combining/splitting device to implement an electronic distance adjusting mechanism.

Antenna arrangements may be rotated around their respective transversal axes in a predetermined relationship with the elevation angle. Further, the antenna arrangements may be simultaneously moved back and forth changing the distance between each other, all as described in the applications incorporated by reference above.

Figure 2:
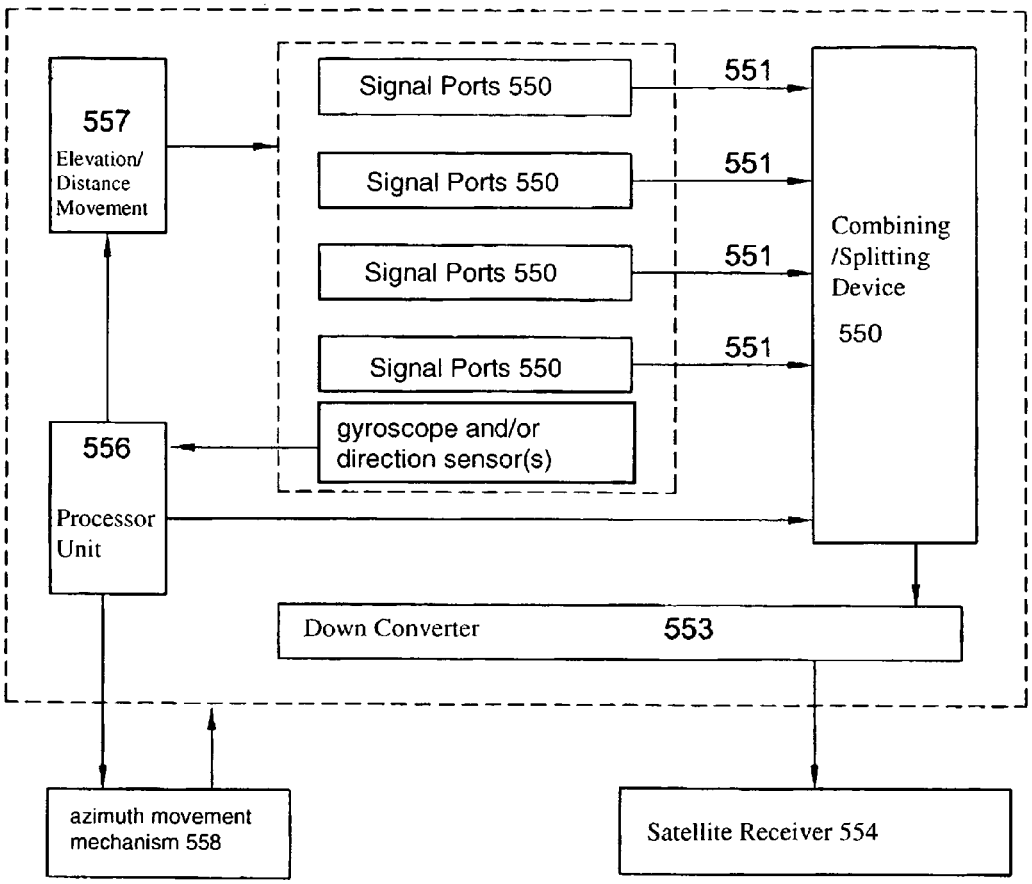
FIG. 2 illustrates a block diagram of a combining/splitting module in accordance with embodiments of the present inventions.

With respect to some embodiments as illustrated in FIG. 2, the antenna arrangements may have signal ports connected through a connectivity mechanism 551, e.g. coaxial cables to a common RF combining/splitting device 552, which may provide combining/splitting of the signals, changing the phase or time delay for each antenna arrangement to combine the signals for each panel in a predetermined relationship with the tracking elevation angle and corresponding instantaneous distance between antenna arrangements and providing the combined/split signal to the down converter 553 and satellite receiver 554.

In exemplary embodiments, the antenna unit autonomously acquires and tracks the satellite (being an example of a tracked target) using directing and tracking techniques to be described in more detail in a subsequent paragraph, for instance by using gyroscope(s), and/or tilt sensors and/or one or more direction sensor(s) 555, connected to the processor unit 556, which may be utilized to control elevation and distance movement mechanism 557, azimuth movement mechanism 558 and combining/splitting device 552 to direct the antenna at the satellite and/or in addition tracking the radio waves received from the satellite. Note that aspects of the invention are not bound by the specific configuration and/or manner of operation of FIG. 2.

Bearing this in mind, there follows a non limiting example concerning change of the distances between the axes (e.g. the specified D, D1 and D2 distances) performed in a predefined relationship with the elevation angle. More specifically by one example, the relationship complies with the following equation: $D=W/\sin(e)$ where D represents the distance between said axes of rotation of the arrangements, e represents the elevation angle and W represents the width (smaller dimension) of the arrangements' array panels. In this particular example, a panel does not shadow one "behind" it as seen from the direction of the satellite and further, no gaps appear between the panels as seen looking at the antenna from any elevation angle (as may be the case for certain elevation angles with respect to the specific examples depicted in FIGS. 3A-3C).

In a minor variation of the aforementioned process, each panel may incorporate a phase progression between adjacent rows of elements to effect a "tilt" of its beam away from the normal to the panel, e.g. "downward" in elevation. The beam of such a panel may point toward a lower elevation angle that would be the case if it were normal to the panel. In this case, the distance to a panel "behind" it should obey the relation $D=W\cos(\theta_s)/\sin(e)$ where $\theta_s$ is the angle of the static beam tilt from the panel.

Turning now to FIG. 3A-C, there is shown, schematically a side view of an antenna unit with four antenna arrangements in different elevation angles, in accordance with an embodiment of the invention.

In one embodiment, the antenna arrangements (e.g. 51 to 54 of FIG. 1) are realized as planar array antennas (each being an example of a planar element array). By another embodiment, the arrangements are realized as conformal phased arrays (being an example of conformal element array). By still another embodiment, the arrangements are realized as e.g. reflector, lens or horn antennas. Other variants are applicable, all depending upon the particular application.

In some preferred embodiments for mobile applications, the antenna arrangements include one or more planar phased array antenna modules (panels), acting together as one antenna. In accordance with certain embodiment of the invention, a reduced height of the antenna unit is achieved, thereby permitting a relatively low-height for the protective covering e.g., radome. For instance, for a satellite reception system operating at Ku-band (12 GHz) this could permit a low height antenna with height reduction to less than about 13 cm, or even less than about 10 cm (or even preferably less than about 8 cm). In the case of electronic steering of the antenna, a height of less than about 2-3 cm may be achieved. In one embodiment, the antenna has a diameter of 80 cm. (see 50 in FIG. 1), but this size may also be reduced to less than about ½ meter—50 cm or even ⅓ meter—30 cm. The reduced height and size of the antenna unit is achieved due the use of more antenna arrangements all as described above. The fact that more arrangements of smaller size are used and give rise to reduced height as is clearly illustrated in FIGS. 3A and 3C.

One embodiment may be brought about due to the use of variable distances between the antenna arrangements. Another embodiment may be brought about by the use of a fixed distance between the panels where such fixed distance, while not absolutely optimum may be adequate for the application and where the cost and reliability are improved by eliminating the extra mechanisms for inter-panel spacing adjustment. The inter-panel spacing can be difficult to achieve reliably in harsh environments creating unnecessary interference with satellite signals. Whenever necessary, additional optimizing techniques are used, all as described in detail above in the applications that are incorporated by reference. The use of antenna unit with reduced height is an esthetic and practical advantage for a vehicle, such as train, SUV, RV, car, bus, or aircraft and has substantial benefits for military vehicles where the communication equipment may be targeted by an adversary.

Certain embodiments of the antenna arrangements may be configured to provide the functions of transmit, receive or both modes. For example, array panels implemented for transmission at a suitable frequency, e.g. 14 GHz or at Ka-band (around 30 GHz) or at Q band (around 44 GHz) may be combined with those for reception, either on the same array panels, on different panels mounted to the same platform, or on a completely separate rotating platform.

Yet another embodiment incorporates both transmit and receive functions on each of a single or multiple panels, e.g. a panel that supports both the 11 GHz receive and 14 GHz transmit bands with a suitable diplexer to separate the transmit and receive frequencies to protect the receiver from the transmit signal. In this case, a single panel could be used for certain applications or, as described above, multiple panels may be combined by suitable phase and amplitude combining circuits.

In the case where separate transmit and receive panels are used, the tracking information for the transmit beam(s) could, in one example, be derived from the information received by the reception beam(s). The principles embodied herein would apply. If multiple transmit panels, separate from the receive panels, are used, the transmit panel spacings would be adjusted separately from those of the receive panels. If transmit and receive functions are combined on the same panels, the spacing criteria for the radiating elements and the inter-panel spacings can be derived from straightforward application of array antenna design principles and the panel spacing criteria described herein.

Figure 4:
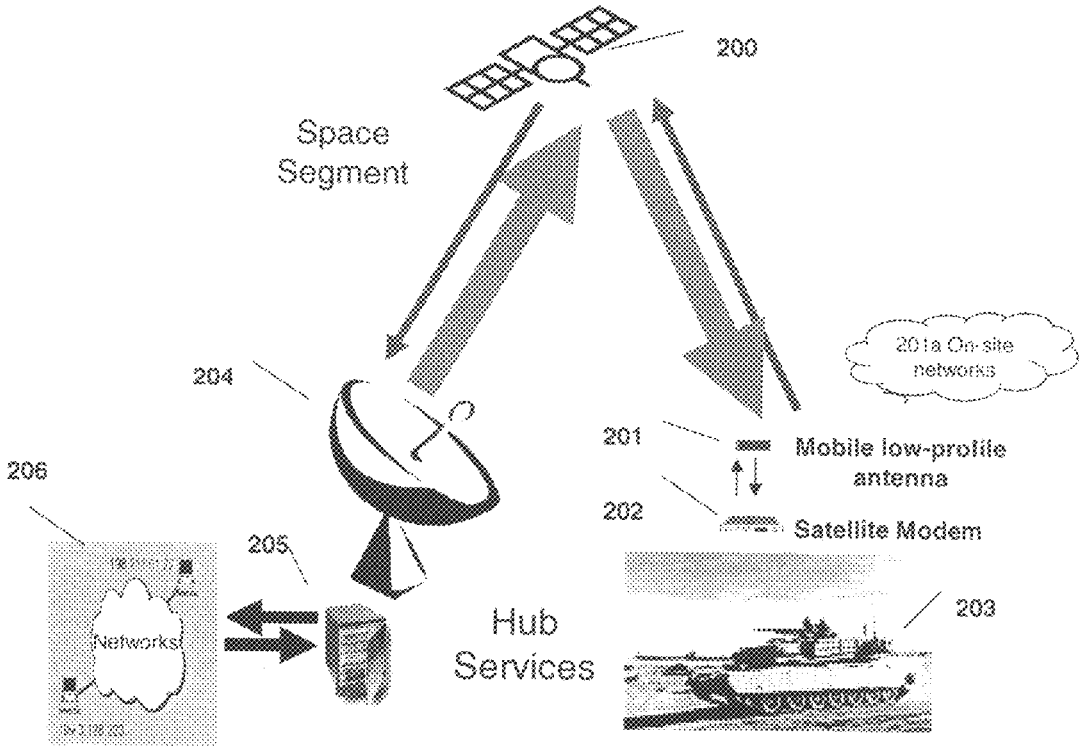
FIG. 4 is a diagram showing exemplary network system embodiments of the present invention.

The present invention comprises a terminal system using low profile transmit and receive antennas, that is suitable for use with a variety of vehicles, for in-motion satellite communications in support of two-way data transfer. With reference to the illustration in FIG. 4 of an exemplary system in which the invention may be employed, a mobile vehicle for example a tank 203 has mounted thereon a terminal system, comprising a low profile antenna terminal 201 and satellite modem 202, which communicate trough satellite 200 (or multiple satellites) with a hub earth station 204. The satellite 200 may be a geostationary FSS, DBS or other service satellite working in Ku (or Ka) band or may be an end of life satellite on inclined orbit or a satellite arranged on low earth (LEO), medium earth orbit (MEO), geostationary earth orbit (GEO) or even highly inclined high altitude elliptical orbits (HIEO or HEO) since the low profile antenna 201 is capable to track the satellite while in-motion and does not need the satellite to stay fixed on the geostationary arc with respect to the antenna location on the earth surface. The earth station 204 supports the communication network, comprising many mobile terminals insuring processing information received and transmitted to mobile terminals as well as the interface with the terrestrial networks.

Figure 5:
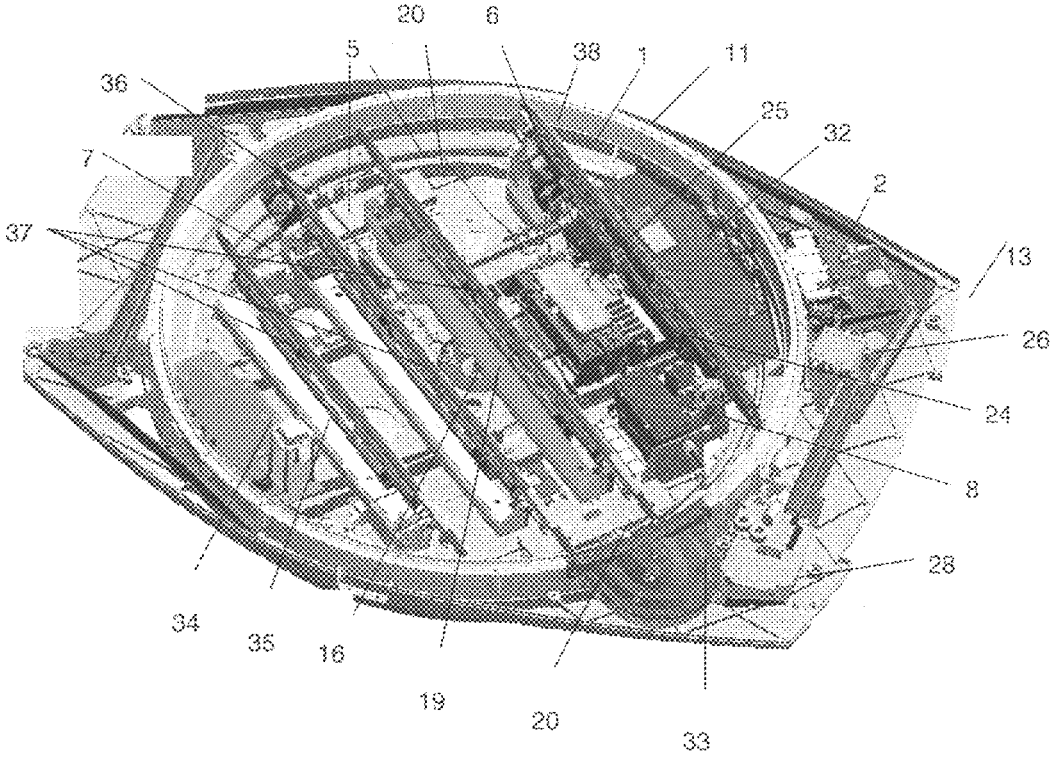
FIG. 5 illustrates a schematic view of one embodiment of the low profile two-way antenna outdoor unit.
Figure 6:
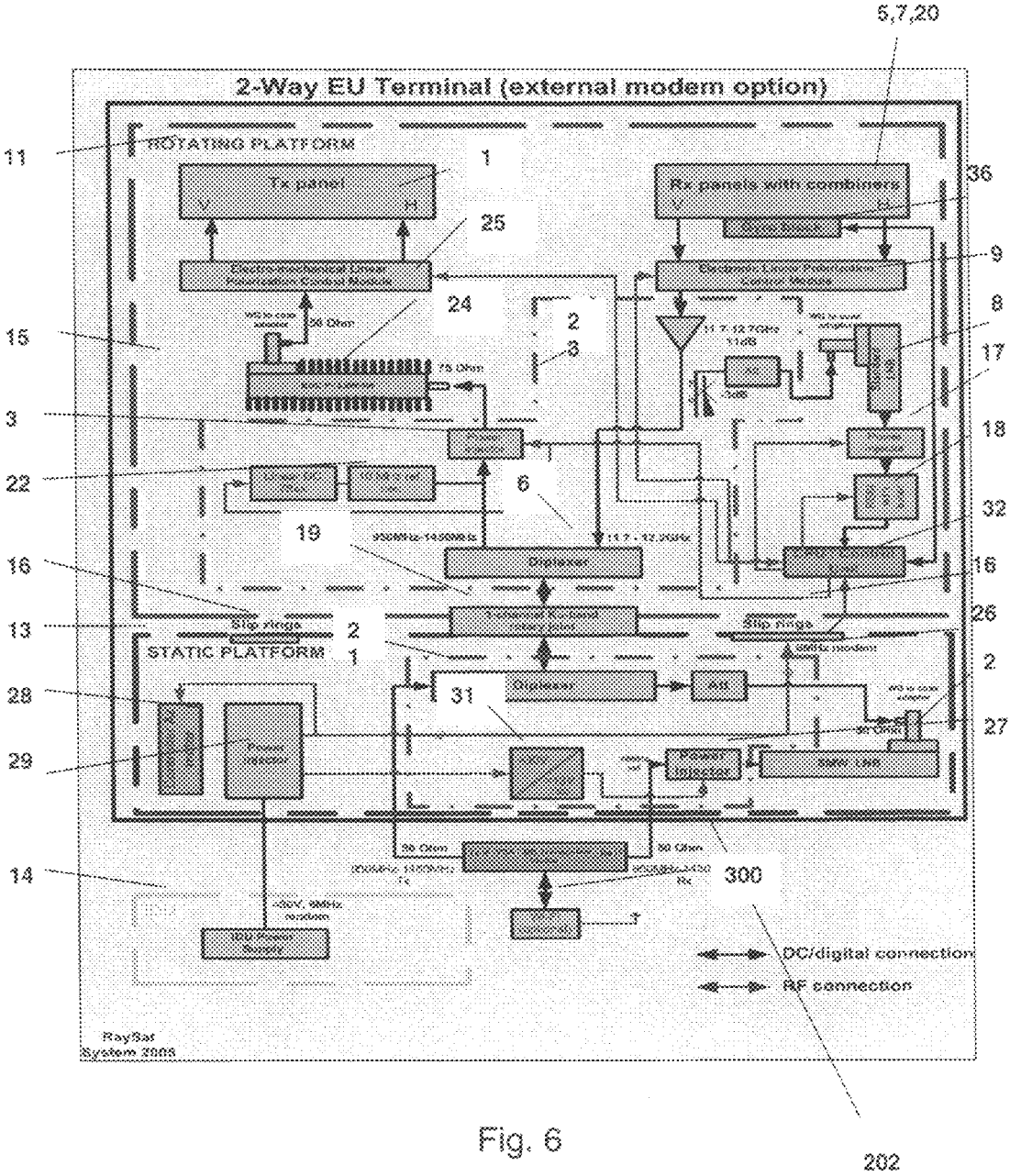
FIG. 6 is a block diagram of a two-way terminal in embodiments having an external modem.

The example refers to a preferred application, namely low profile antenna terminal (shown on FIG. 5, 6) for in motion two-way communication using satellites arranged on geostationary orbit or other orbits as described above or end of life satellites on inclined orbit. While LEO, MEO, and HEO orbits may be utilized, geostationary orbits may be preferred since there is substantial existing bandwidth available to users in the Ka and Ku bands.

The preferred shape of the antenna comprises flat panels in order to decrease the overall height of the whole system. In one preferred application these could be several receive and transmit panels in order to optimize the size and communications capacity of the antenna aperture, which may be fitted in the specific volume with preferred minimal height. The terminal may include outdoor unit (ODU) 15 and indoor unit (IDU) 14.

The ODU 15 comprises a rotating platform 11 and a static platform 13. The outdoor unit may be variously configured and may include one or more of receive and transmit panels, phase combiners, global positioning system (GPS), received signal strength indicator (RSSI), diplexer(s), block up converter(s), elevation motor controller(s), central processing unit(s), rotary joint, gyro sensor block(s), azimuth motor and control board, low noise block(s), and power injector(s).

The rotating platform 11 may also be variously configured to include transmit (Tx) and receive (Rx) sections. The transmit section may include, for example, a flat and/or low profile antenna transmit panel 1, mechanical polarization control device 25 and up converter unit such as a block-up converter (BUC). The BUC may be located inside the radome of the ODU on the rotating platform or, in some cases where high power is required, the BUC may be located outside the rotating platform, and even outside the radome, either atop the vehicle adjacent to the ODU or inside the vehicle. In the cases where it is outside the rotating platform, the rotary joint would carry the RF transmit signals to the radiating elements. In this event, straightforward engineering considerations, well known in the art, would dictate whether, for example, single channel or dual channel rotary joints would be used and the detailed arrangement of suitable diplexers to keep the receive and transmit signals separate 24.

The transmit antenna panel 1 may be variously configured to transmits signals with linear polarization. In this embodiment, an array antenna technology may be utilized which can comprise one or more dual port radiating elements (the antenna panel architecture and technology used are described in details in the patent application "Flat Mobile Antenna" PCT/BG/04/00011). In this embodiment, the antenna may be designed to work in transmit mode in the 14-14.5 GHz frequency band.

The signal power to each one of the two ports of the radiating elements may be delivered by two independent feeding networks one for all horizontally polarized and one for all vertically polarized radiating elements ports. The one or more independent feeding networks (e.g., two) are connected to the outputs of the polarization control device 25 in order to achieve the needed amplitude and phase combination of the signals delivered to each one of the two ports. In this example, the radiating elements may be configured to match the polarization tilt angle of the transmitted signal with the polarization of the receiving antenna situated on the satellite. In exemplary embodiments, the feeding networks comprise properly combined stripline and waveguide power splitting devices in order to minimize signal losses. The block up converter 24 may be configured to include the circuit to up-convert the transmit circuit from the intermediate frequency output of the modem, e.g. at L-band 202 and a high power amplifier operating at the RF transmit frequency, e.g. 14 GHz or 30 GHz. In another application, one or more high power amplifying modules may be integrated directly to each one of the transmit panel inputs in order to minimize signal losses between any up-converter unit(s) and radiating element(s). In this case a mechanical and/or electronic polarization control device connected between the up-converter and power amplification units may be used. The electronic polarization control may comprise suitable circuitry such as electronic controlled phase controlling devices and attenuators in order to control the amplitude and phase of the signals applied to each one of the antenna panel inputs.

In another application, amplifiers may be distributed throughout the array panel with one amplifier associated with each radiating element or with a subgroup of radiating elements. In this way, losses between the final amplifiers and the radiating elements may be further reduced and the individual amplifiers may be of substantially lower power than a single high power amplifier. This can also have the advantage of distributing the heat generated by the amplifier(s) over a larger area and thereby simplifying heat dissipation. In this case integrated circuit modules, e.g. monolithic microwave integrated circuit (MMIC) modules could combine the functions of polarization control and amplification for each radiating element or subarray of such elements. The distribution of the heat is an important element in a harsh mobile environment where the unit may experience severe temperature extremes, particularly when operating on top of a hot engine on a tank in the desert sun.

The receive section may be variously configured. For example, the receive section may include multiple receive array panels. These may include one or more "large" 5 and/or "small" 7 antenna panels. Where a rotating platform is used, the multi-panels may be situated on the same rotating platform with the transmit panel 1 and aligned properly to have either exactly and/or about the same directions of the main beams. In this manner, the panels 5 and 7 may have an extended frequency band of operation in order to simultaneously cover both FSS (10.95-12.2 GHz) and DBS (12.2-12.75 GHz) bands.

Where mechanical elevation controls are utilized, the elevation angles and/or the distances between the receive panels may be controlled by the elevation mechanics and elevation controlling motors 37. These devices may be variously arranged such as on the backs of the receiving panels 5, 7 in order to achieve best performance in the whole elevation scan range. One embodiment of such a construction including its principles of operation and construction of the multi-panel antenna receive system are disclosed in the U.S. patent application Ser. No. 10/752,088 Mobile Antenna System for Satellite Communications, herein incorporated by reference. In another application, the distances between receiving panels may be optimized for a given range of elevation angles and stay fixed in order to simplify the elevation controlled mechanics. However, while fixed distances may result in degradation in the reception performance, such fixed spacing may be adequate for certain applications.

In still further embodiments, one or more combining and phasing blocks 20 (for example, two where each one is dedicated to one of the two independent linear polarizations), may be utilized to properly phase and combine the signals coming from the antenna panels outputs. Polarization control device 9 may be utilized to control and match the polarization offset of the linearly polarized FSS signals with respect to the satellite position. In another preferable application the combining and phasing blocks 20 may be used to provide the needed signal polarization tilt, which could obviate the need for additional polarization control devices 9.

A low cost gyro sensor block 36 in some embodiments may be variously placed, i.e., on the one of the receive panel's backs and may be utilized to provide information about the platform movement to the digital control unit 32. For example, gyros and controller circuits permit the terminal to "remember" the terminal's pointing information and allows for rapid re-acquisition of the satellite signal in the event of a temporary signal blockage. The digital control unit 32 controls all motors for beam steering in azimuth and elevation, polarization controlling devices 25 and 9, phase combining and phase control blocks 20, comprising interfaces to the gyro sensor block 36 and indoor unit 14. In another preferable embodiment an additional gyro sensor 38 may be attached to the back of the transmit panel 1 in order to provide information about the dynamic tilt angle of the platform needed for the dynamic correction of the polarization mismatch error. For example, such gyro sensors permit the rapid re-acquisition of the satellite signals In another preferable a GPS receiving module 35 may be used to provide information of the exact location of the antenna to the CPU block 32. The information may be variously used, for example to calculate the exact elevation angle with respect to the preferred satellite, thereby reducing the initial time needed for satellite acquisition. In another preferable embodiment, the information may be used for the calculation of the signal polarization tilt, given the information for geographical position of the antenna provided by the GPS module 35 and the position of the preferred communication satellite.

The diplexer and power injector unit 23 may be variously configured and may include a diplexer 6 for splitting intermediate frequency transmit signal in L band and high frequency receive signal in Ku band delivered through the common broadband rotary joint device 19, power injector 3 biasing the BUC device 24 and a internal 10 MHz reference source. In another preferred application the reference source may be delivered by the satellite modem 202.

The static platform contains DC slip rings 16 in order to transfer DC power and digital control signals to the rotating platform, the stationary part of the RF rotary joint 19, azimuthal mechanics, azimuth motor 33, the azimuth motor controller 28, diplexer and power injector unit 26, and low noise block downconverter (LNB) 2. The diplexer and power injector unit 26, and diplexer 21 combine the IF transmit signal in L band and received high frequency signal in Ku band to transfer through the same broadband rotary joint 19, power injector 27 providing bias to the LNB 2 and voltage inverter circuit 31.

The indoor unit (IDU) 14 may be variously configured to include power supply unit biasing for the outdoor unit 201. Further, the indoor unit may be combined with the satellite modem 202 and a Wi-Fi interface 300 with the communication equipment installed in the vehicle. It may also communicate with equipment and personnel external to the vehicle, for example, located within 3000 feet from the vehicle. In this manner, a subnet may be established.

Figure 7:
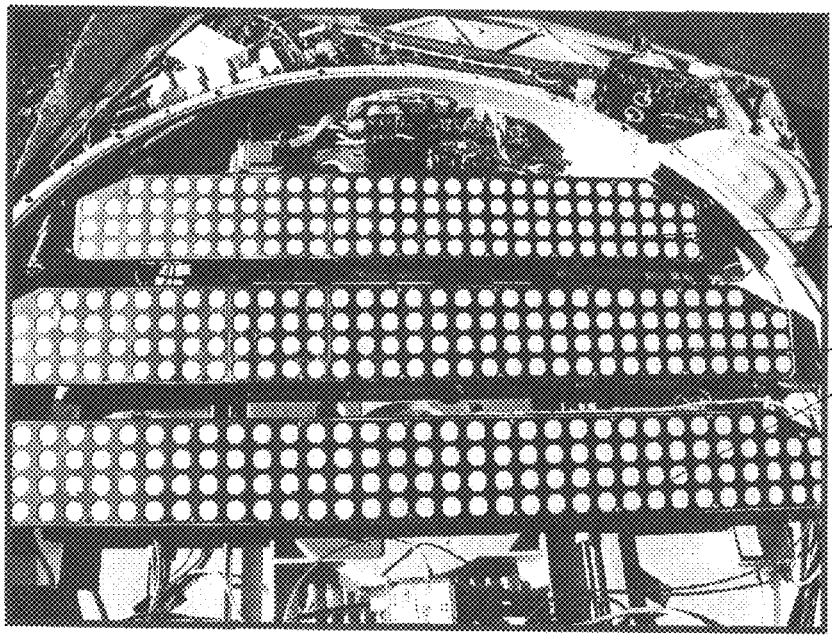
FIG. 7 is an illustration of receive panels which may be utilized in an outdoor unit.

FIG. 7 illustrates an example of an array of receiving flat antenna panels. In one preferred embodiment of the invention, two large 5 and one small 7 panels are used. The panels may be variously configured such as comprising a plurality of radiating two port antenna elements arranged in a Cartesian grid, two independent combined stripline-waveguide combining circuits. The combining circuits may be configured to combine independently the signals received by the horizontal and vertical excitation probes of all panel radiation elements, providing the summed signals to two independent panel outputs. They may also be configured to combine the signals further, coming from the panel's outputs with properly adjusted phase and amplitude by combining and phasing blocks 20. In another preferred embodiment in polarization control module 9 it is possible to select the preferred application signal polarization. The polarizations could be arbitrary depending on the application. Typical polarizations would be circular—Left Hand (LHCP) or Right Hand (RHCP) or linear—vertical (V) or horizontal (H) or tilted linear at any angle between 0 and +/−90 degrees.

Figure 8:
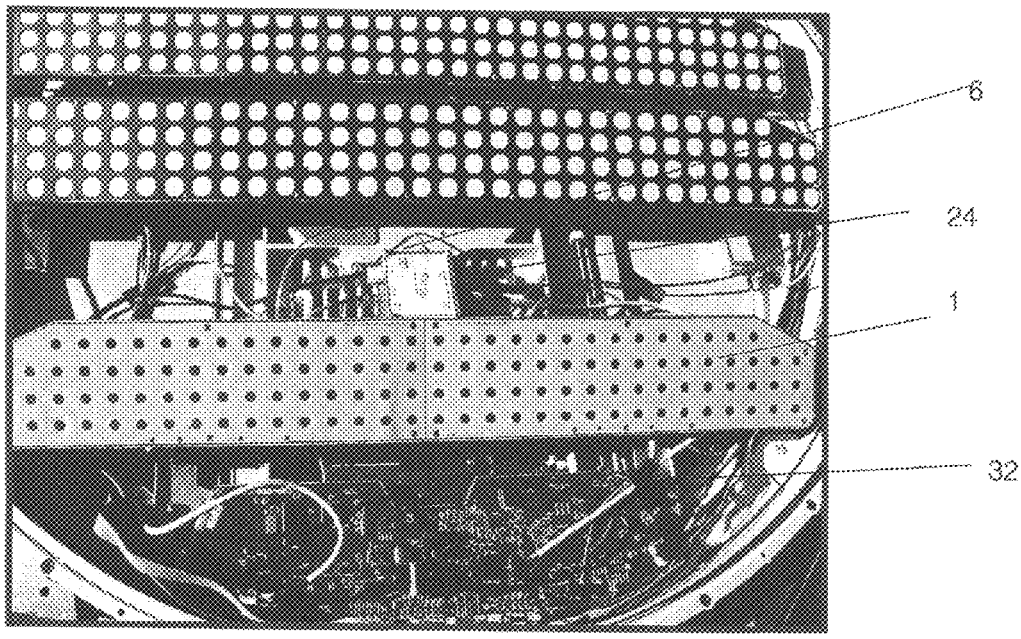
FIG. 8 is an illustration of a transmit panel in combination with one or more receive panels which may be utilized in an outdoor unit.

FIG. 8 illustrates an example of the transmit panel 1. In the shown embodiment, the transmit panel comprises a plurality of printed circuit radiating elements. In other preferred embodiments, the radiating elements may be radiating apertures, waveguides, horns, dipoles, slots or other type of low directivity small size antennas.

Figure 9:
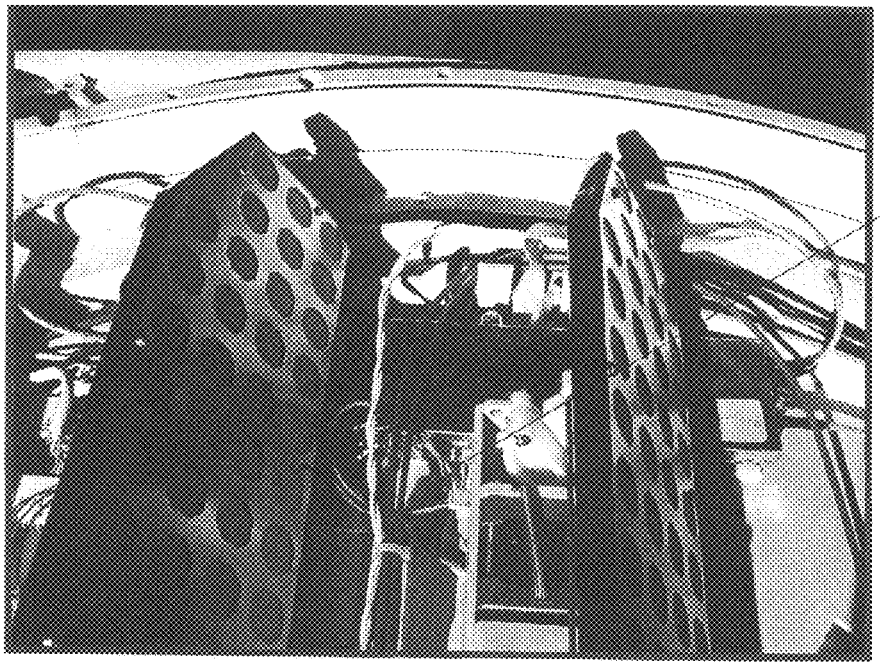
FIGS. 9 and 10 show H (horizontal polarization) and V (vertical polarization) signal combiners which may be utilized in embodiments of the outdoor unit.
Figure 10:
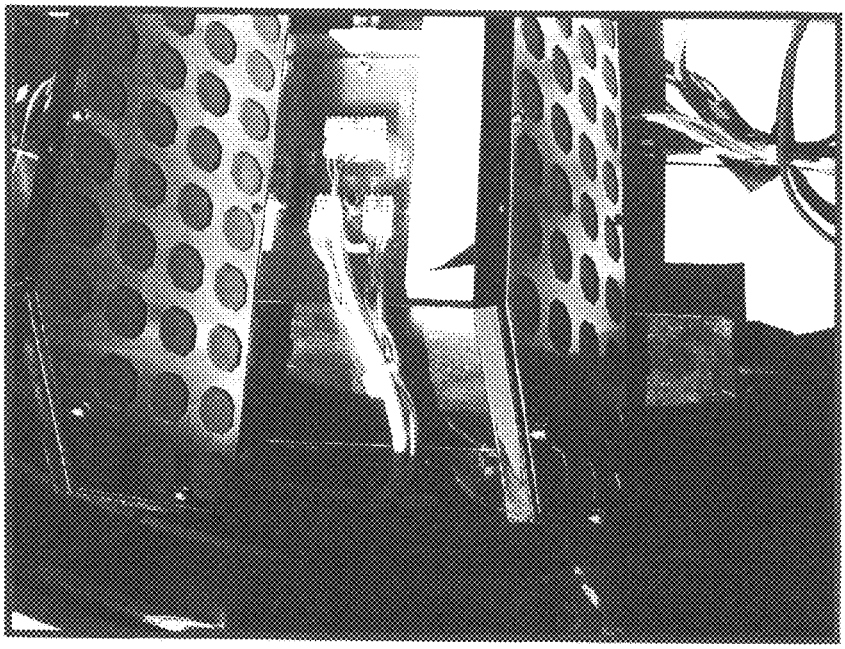

FIG. 9 illustrates an example of an elevation mechanism and elevation motor 37. In the embodiment shown, the elevation control to each one of the panels (transmit and receive) is provided using a separate stepper motor arranged on the back of the panel and a proper elevation mechanic. In another embodiment, a common motor for the elevation movement of all antenna panels may be used. The elevation mechanics and controls allow synchronization of the elevation movements of all panels.

Figure 11:
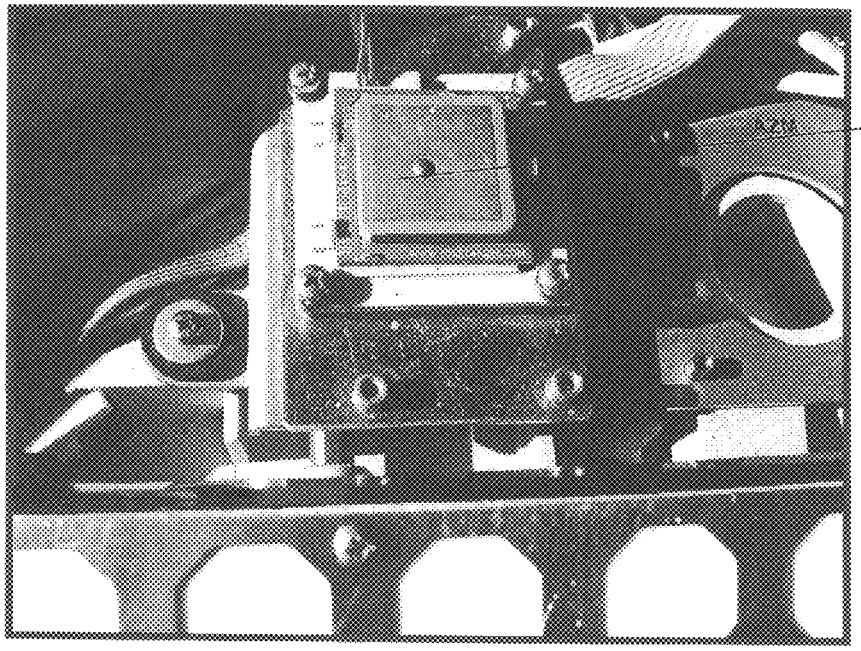
FIG. 11 is an illustration of an exemplary embodiment of a global positioning system which may be incorporated into the terminal.
Figure 12:
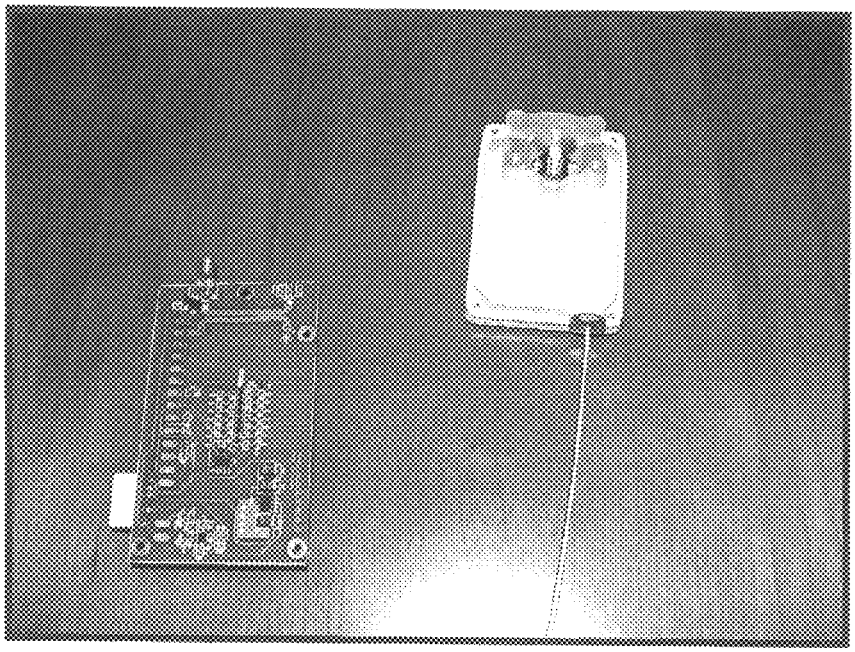
FIG. 12 is an illustration of an exemplary embodiment of a received signal strength indicator (RSSI)

FIG. 11 illustrates an example of a GPS module 35. In the example, the module provides information about the current geographical position of the antenna to the main CPU board 32. This information may be used to calculate the elevation angle to the satellite, obviating the need for elevation searching upon startup and minimizing the initial acquisition time. The GPS information, along with known epheneris data for the preferred satellite, may also be used to calculate the polarization tilt corresponding to the relative positions of the antenna and the preferred satellite.

Figure 13:
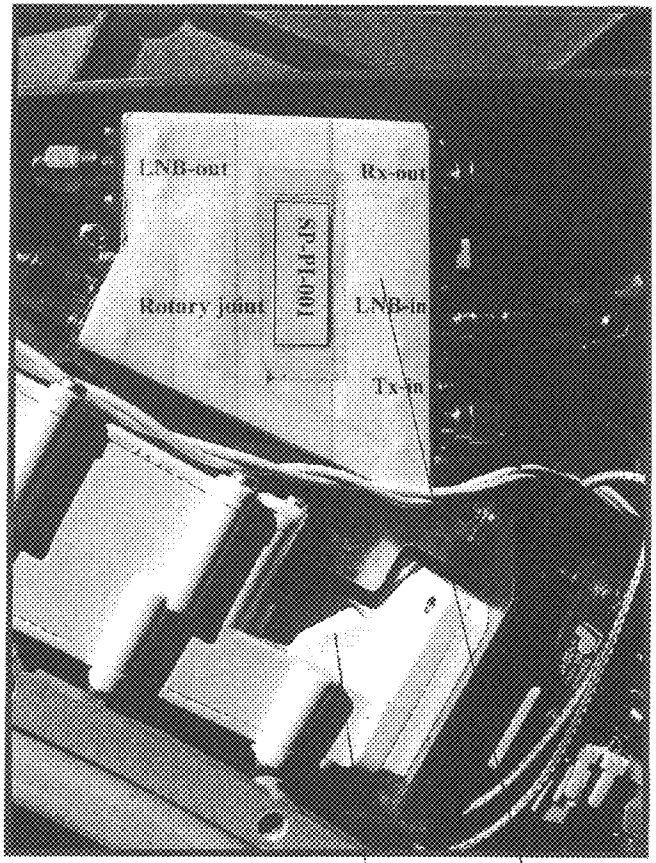
FIG. 13 is an exemplary diplexer which may be utilized in the outdoor unit to allow

FIG. 13 illustrates an example of components on the static platform which may include a diplexer 21, power injector device 27 and voltage converter 31. In this example, the diplexer 21 combines the intermediate frequency L-band transmit signal and high frequency received signal in Ku band. This configuration may facilitate the transfer between rotating and static platforms using a single broadband rotary joint 19. In this way, the diplexer may provide the transmit signal, having intermediate frequency in L band through the rotary joint to the block-up converter 24, situated on the rotary platform and in the same time Ku band received signal to the LNB 2.

Figure 14:
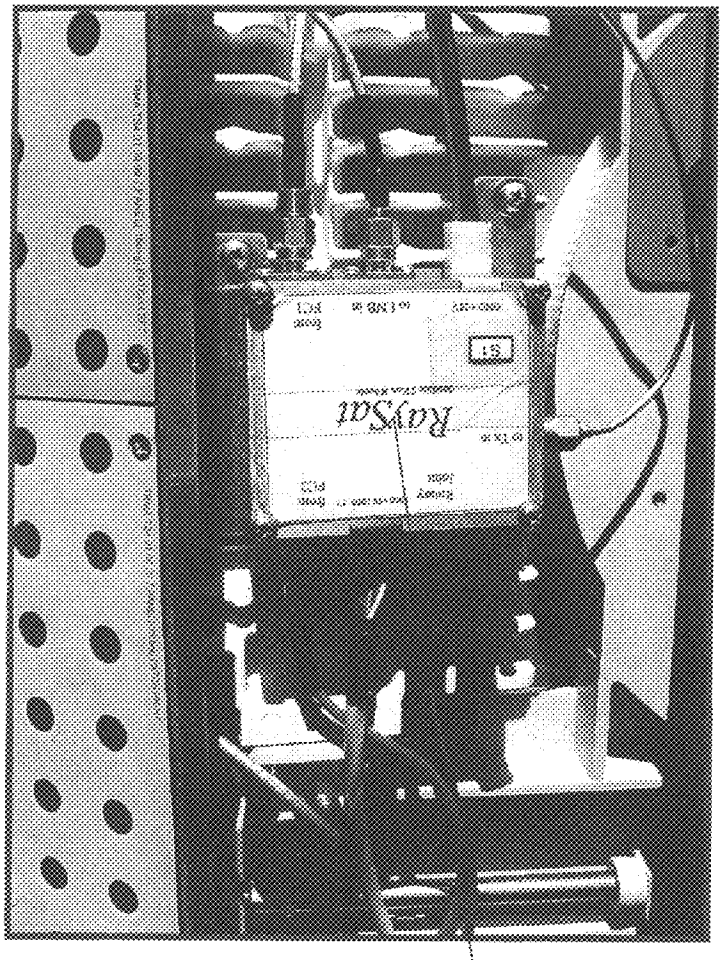
FIG. 14 is an illustration of an exemplary embodiment of a block up converter (BUC)

FIG. 14 illustrates an example of the block upconverter (BUC). The BUC takes the L-band intermediate frequency transmit signal and up-converts it to the RF transmit frequency, e.g. at the Ku-band 13.75-14.5 GHz FSS frequencies. This output is fed to the power amplifier which may be a solid state power amplifier as shown or, in other embodiments may be a traveling wave tube (TWT) amplifier (TWTA). As noted, the BUC usually refers to the combination of upconverter and amplifier and may be located on the rotating platform as shown, or it may be located outside the rotating platform and even outside the radome, either adjacent to the ODU or inside the vehicle. In these cases, rotary joint and diplexer options will be familiar to those skilled in the art.

Figure 15:
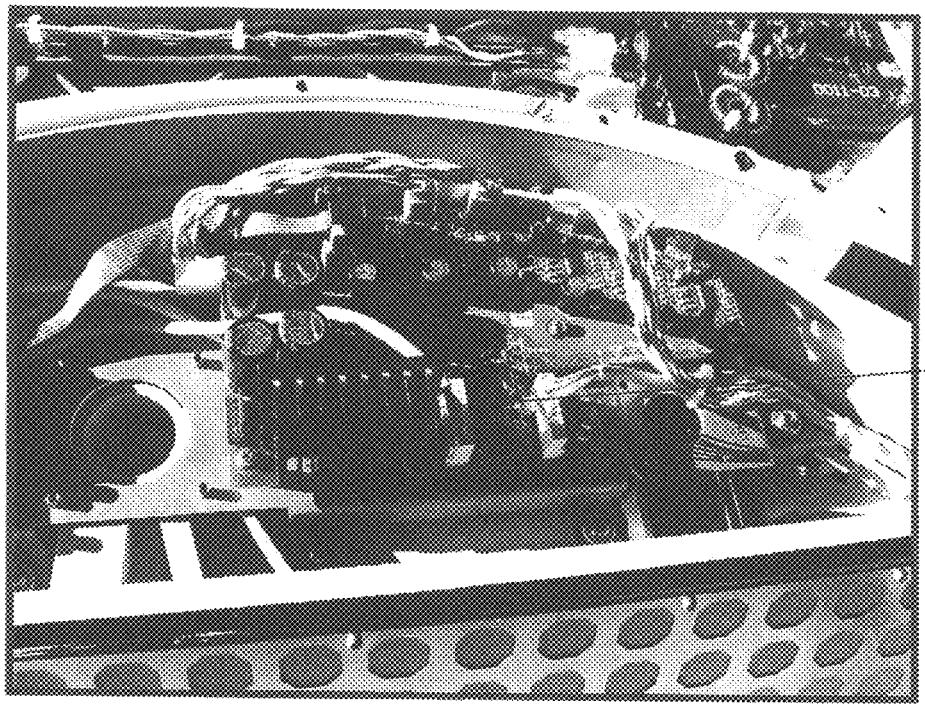
FIG. 15 is an illustration of an exemplary embodiment of an elevation motors controller.

FIG. 15 illustrates an example of an azimuth motor control board.

Figure 16:
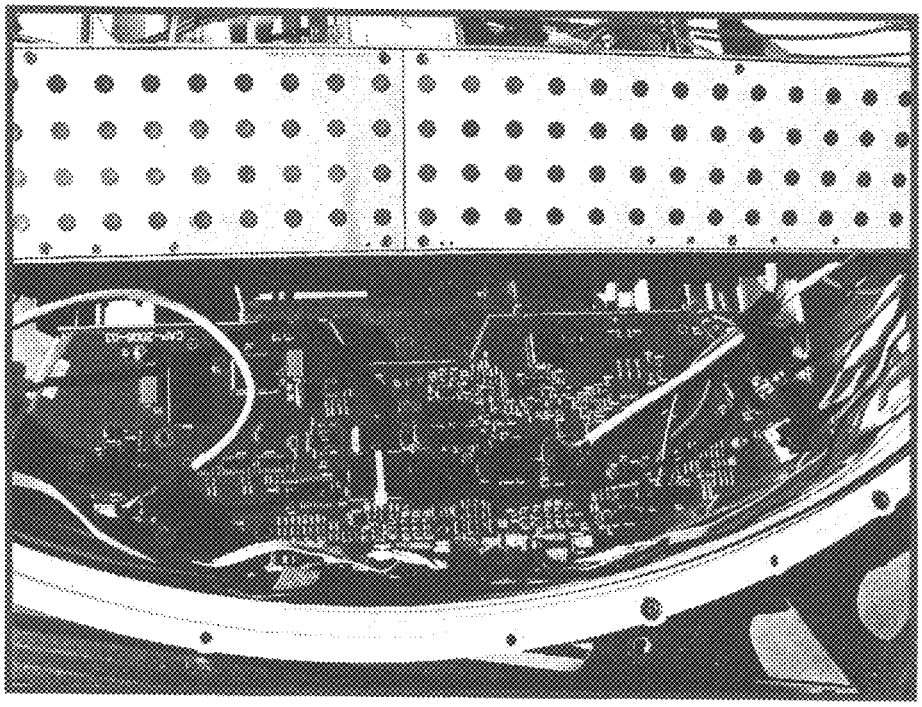
FIG. 16 is an illustration of an exemplary embodiment of a central processing unit module for use in connection with the outdoor unit.

FIG. 16 illustrates an example of a CPU board.

Figure 17:
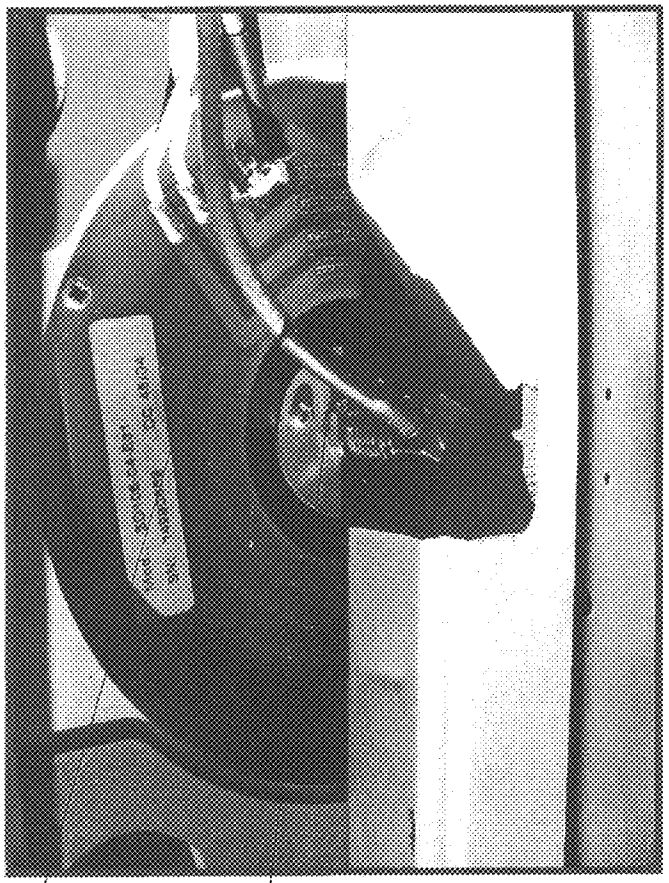
FIG. 17 is an illustration of an exemplary embodiment of an outdoor unit rotary joint (RJ) for use with outdoor units, which employ a mechanical rotary joint as opposed to an electronic direction mechanism.
Figure 18:
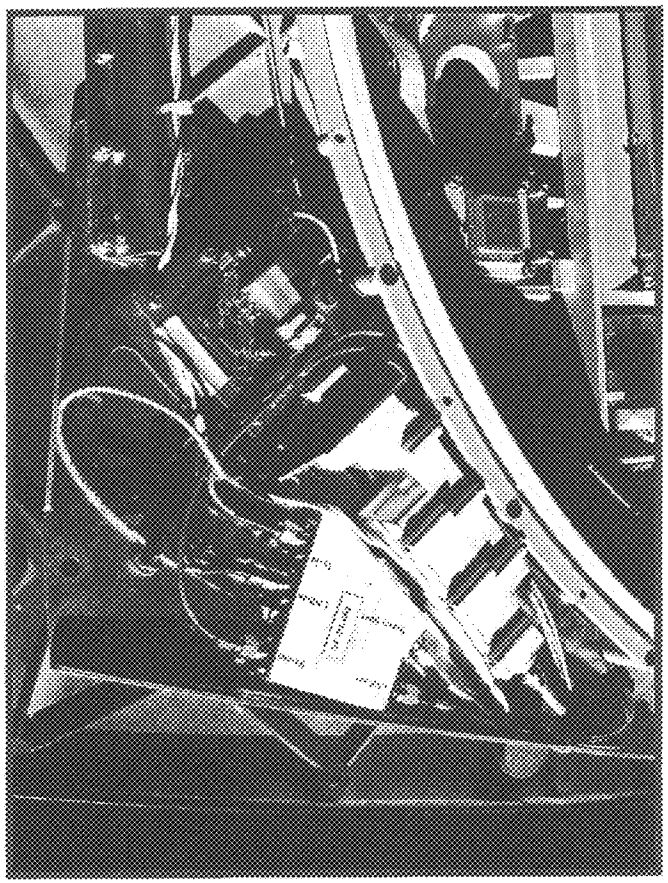
FIG. 18 is an illustration of an exemplary low noise block and power injector.

FIG. 17 illustrates an example of a broadband rotary joint device 19. The rotary joint provides RF connection between the rotating 11 and stationary platforms 13 of the antenna terminal. The RF connection comprises transmit signal with intermediate frequency in L band and high frequency received signal in Ku and/or Ka band. The slip rings 16 provide the DC and digital signal connections between rotating 11 and stationary 13 platforms. In embodiments where fully electronic steering is utilized, no rotary joint may be required.

Figure 19:
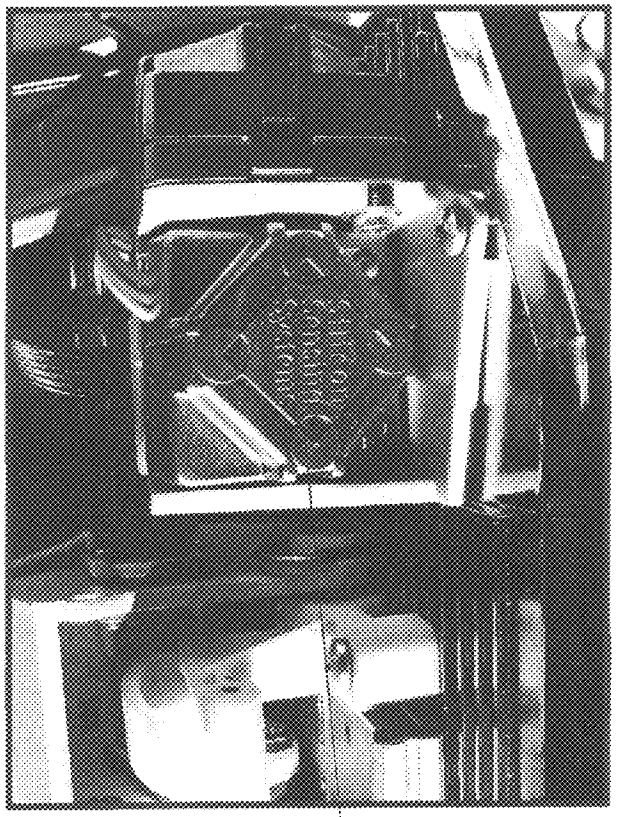
FIG. 19 is an illustration of an exemplary gyro sensor block.

FIG. 19 illustrates an example of the gyro sensor block 6. The gyro sensor block comprises two gyro sensors providing the information for platform rotation in azimuth and elevation.

Figure 20:
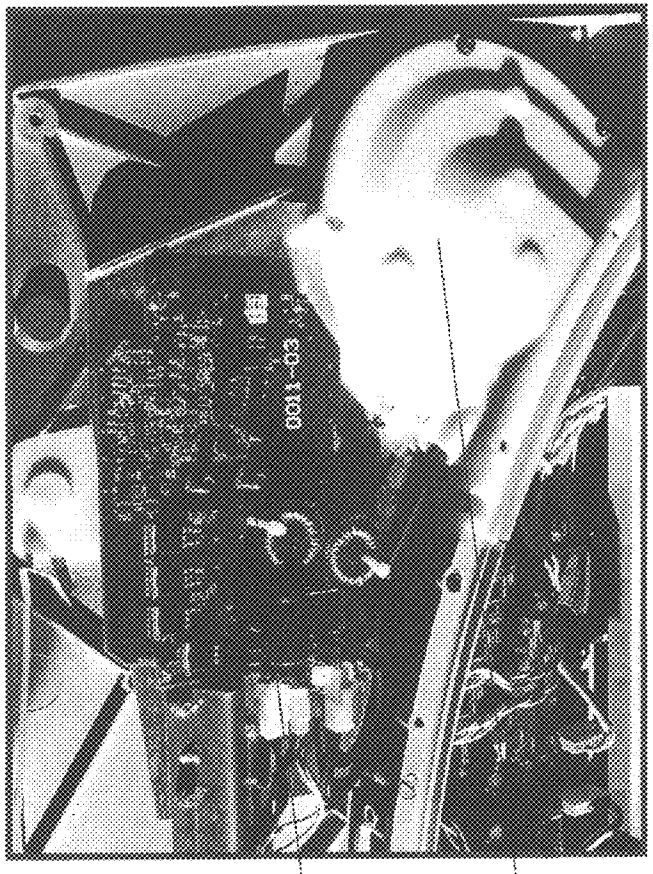
FIG. 20 is an illustration of an exemplary azimuth motor and azimuth control board.

FIG. 20 illustrates an example of an azimuth motor 33 and azimuth motor control board 28.

The components shown in detail in FIGS. 5-21 may be integrated into one or more application specific integrated circuits (ASICs), thereby reducing costs and increasing reliability. This can have significant advantages particularly when deployed across many vehicles in price sensitive applications or deployed in harsh environments such as military applications.

Figure 21:
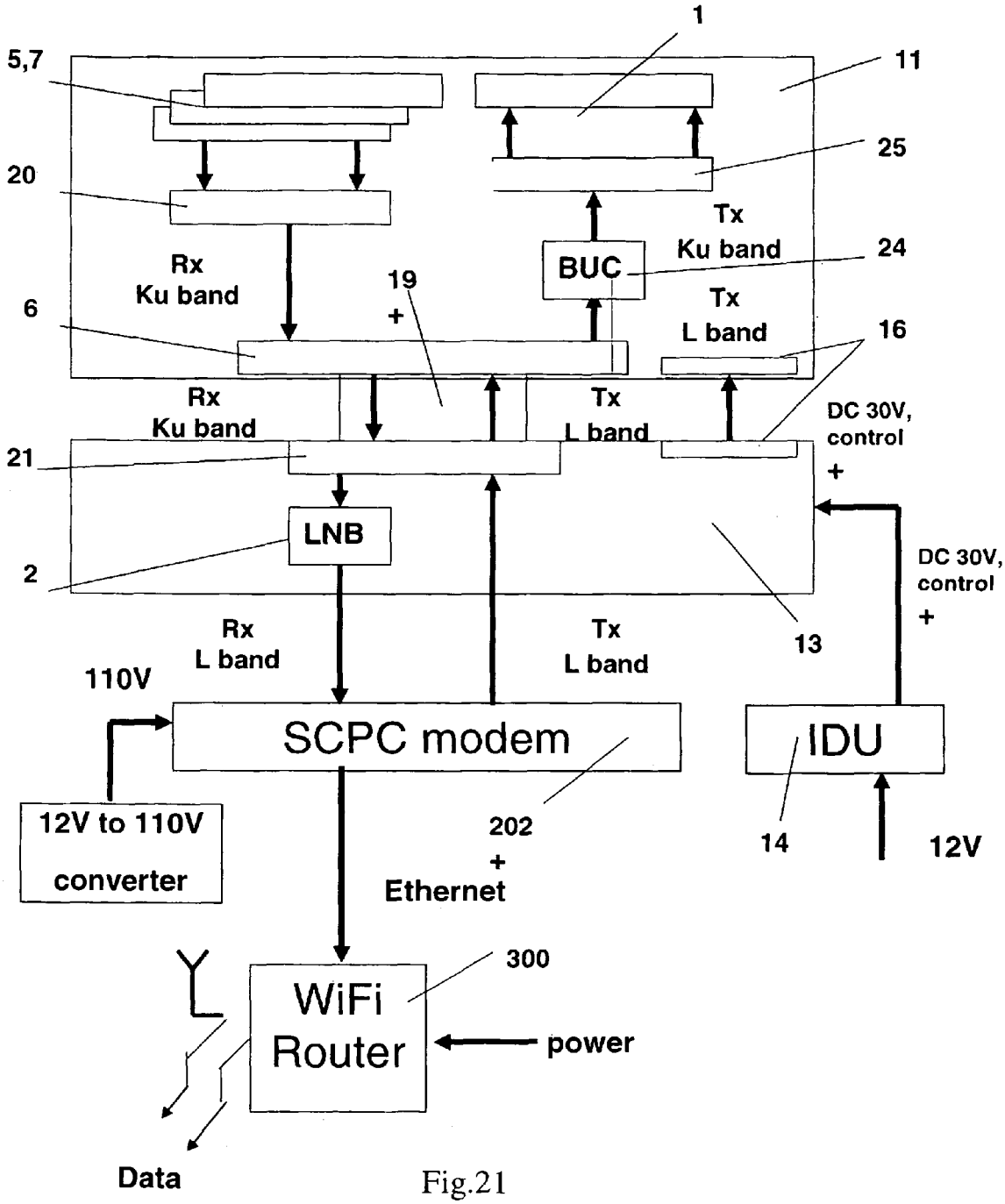
FIG. 21 is a block diagram of a low profile two-way satellite antenna in accordance with some aspects of the present invention.

FIG. 21 is schematic illustration of an exemplary embodiment of the signal flow through various components on the Rx and Tx sides, including an illustration of signals transferring between rotary and static platforms of the outdoor unit (ODU) through a single broadband rotary joint. In this example, the Rx signal goes out from the output of the received active panels 5, 7. The signals may then be combined by the active combining devices 20. In this example, the combining is in parallel with proper phase and amplitude of the Rx signals set in order to achieve the desired polarization tilt. Again in this example, the signal is combined with the intermediate frequency Tx signal in L band in the diplexer 6 and transferred trough the single broadband rotary joint 19 to the static platform 13. On the static platform 13 the Ku band Rx signal may be separated from the Tx L band signal by the diplexer 21 and down converted by a LNB 2 to an intermediate frequency in L band. The intermediate Rx signal may then be transferred by a separate coaxial cable to the satellite modem 202 in the vehicle. From the other side in this example, the Tx signal coming from the satellite modem 202 with an intermediate frequency in L band is transferred through a cable to the static platform 13 and then combined with the Rx signal in Ku band in the diplexer 21 in order to be transferred through the common broadband rotary joint 19 to the rotating platform 11. On the rotating platform 11 again in this example, the Tx signal is separated from the Ku band Rx signal using the diplexer 6 and then upconverted by a BUC 24 in Ku band. Continuing with the example, the upconverted Tx signal may be transferred through the polarization control device 25 in order to adjust the polarization tilt. The Tx signal may then be delivered to the transmit antenna inputs.

Figure 22:
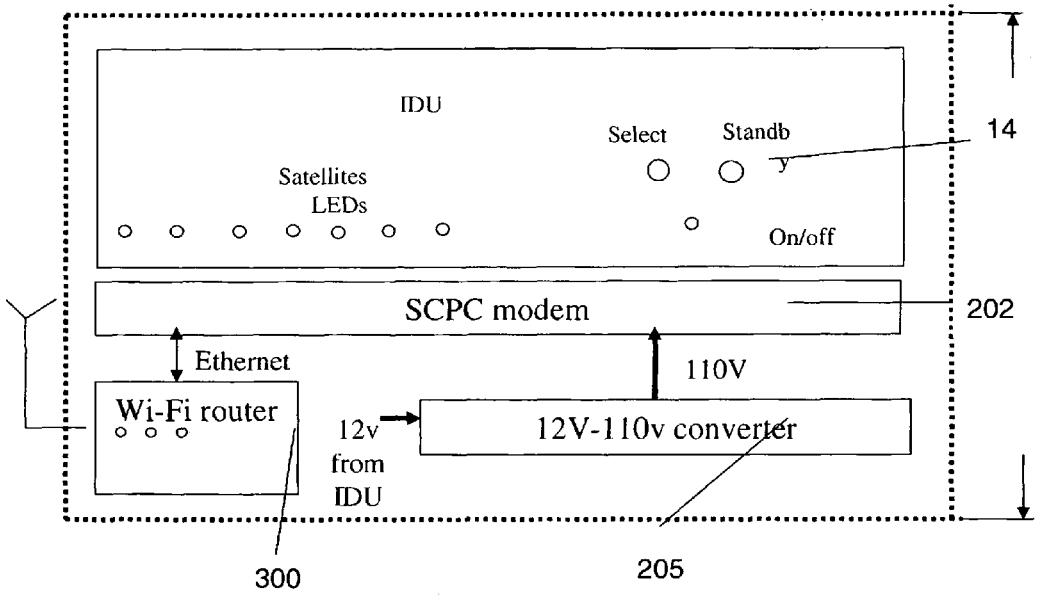
FIG. 22 is a block/illustrative diagram of an assembly which may function as an indoor unit for the low profile two-way satellite antenna illustrated in FIG. 21.

FIG. 22 illustrates an example of the equipment, which may be disposed inside the vehicle according to an embodiment of the invention. The equipment in this example comprises an indoor unit (IDU) 14, satellite modem 202, Wi-Fi router 300 and/or Voltage converter 205. The Indoor unit 14 may be variously configured such as providing the supply voltage to the Outdoor unit and control signal for the selection of the satellite preferred for communication. In the example, the satellite modem processes the digital communication signal, coming from the computer or other communication devices and transfers them to Rx and Tx intermediate frequency signals in L band. In one preferred application, a Wi-Fi router 300 may be used for a wireless interface with a computer or other communication equipment. In the example, the voltage converter 205 is a commercially available device for transferring 12V DC power supply from the vehicle battery to 110V AC used to power the satellite modem 202. Of course, a 12 or 24 or 28 volt or other voltage system could also be utilized.

FIGS. 23-27 illustrate various example arrangements of the terminals on military vehicles and show example inside equipment arrangements. A great variety of such arrangements are possible depending on the specific needs and limitations of each vehicle.

Figure 28:
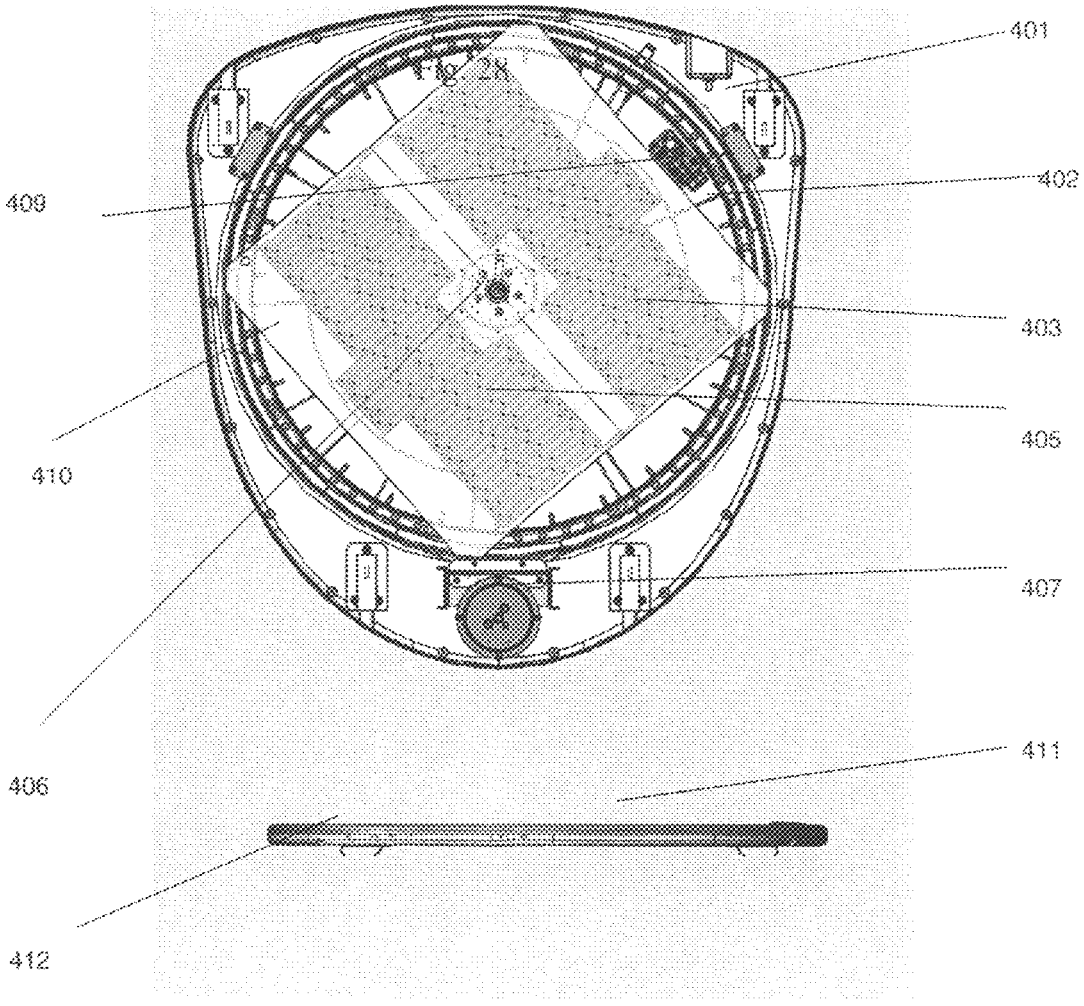
FIG. 28 is a two-way semi-electronic scanning antenna with a very low profile.
Figure 29:
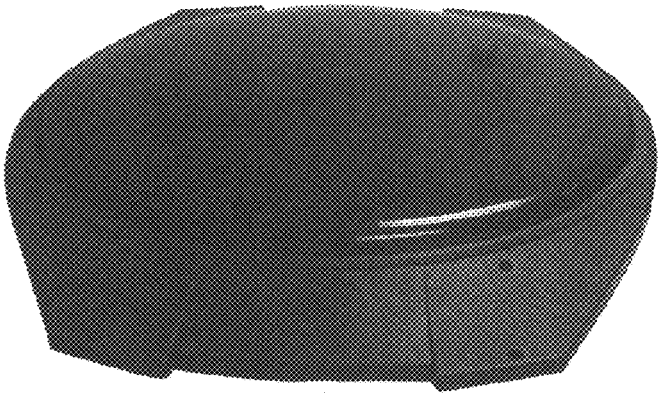
FIG. 29 is an exemplary embodiment of the external package of a low profile antenna.
Figure 30:
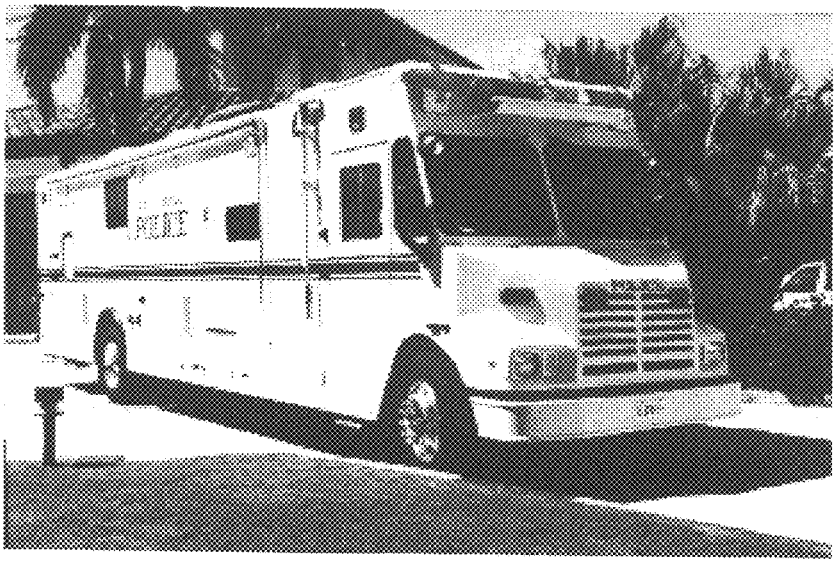
FIG. 30-31 are exemplary embodiments of a low profile antenna outfitted to vehicles such as mobile command centers.
Figure 31:
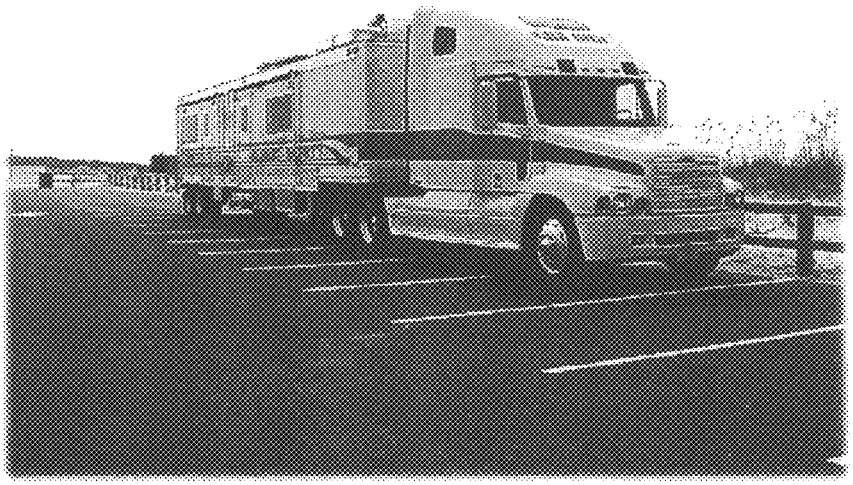
Figure 32:
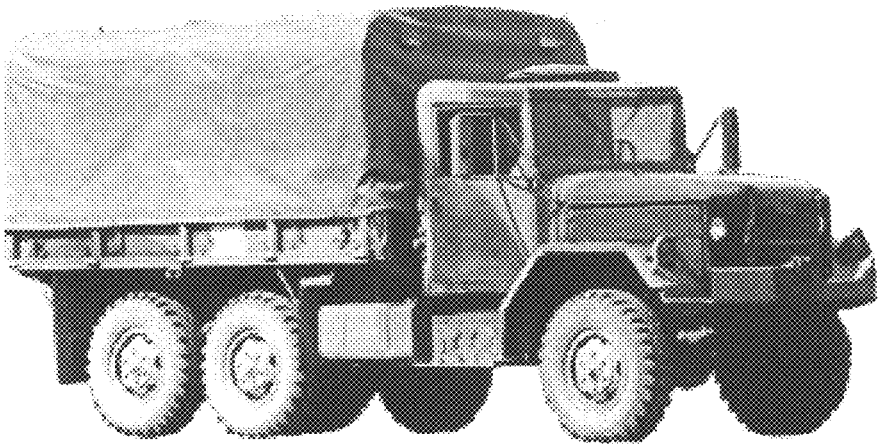
FIGS. 32-34 and 36-38 are illustrative embodiments of a low profile antenna mounted to various military vehicles.
Figure 33:
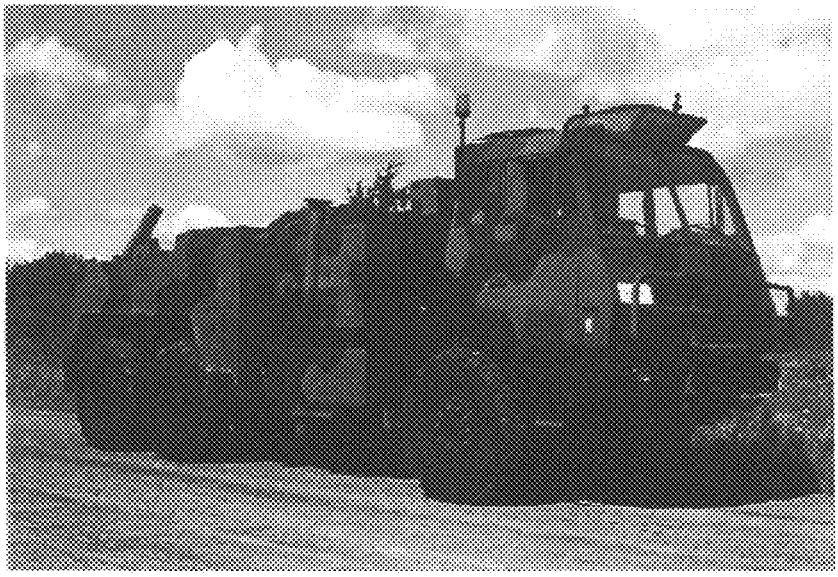
Figure 34:
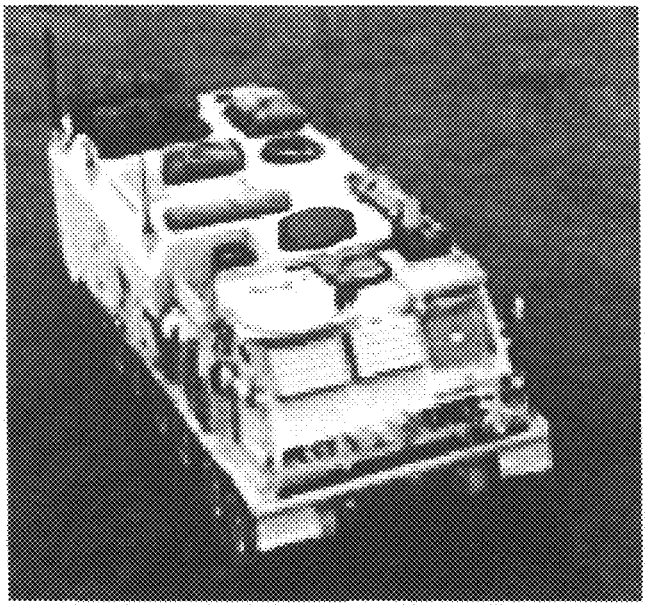
Figure 35:
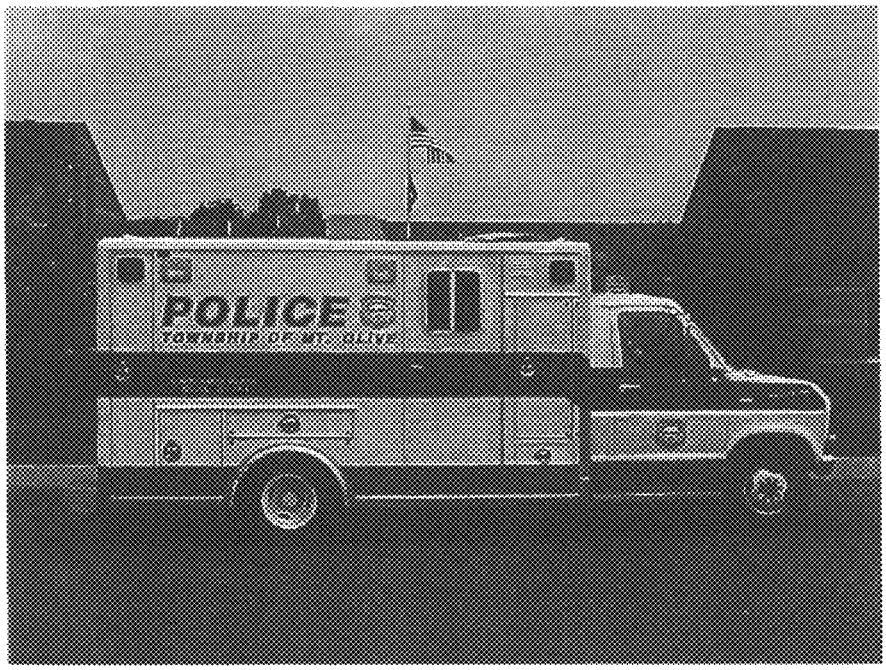
FIG. 35 illustrates a low profile antenna mounted to a police/ambulance/emergency response vehicle.
Figure 36:
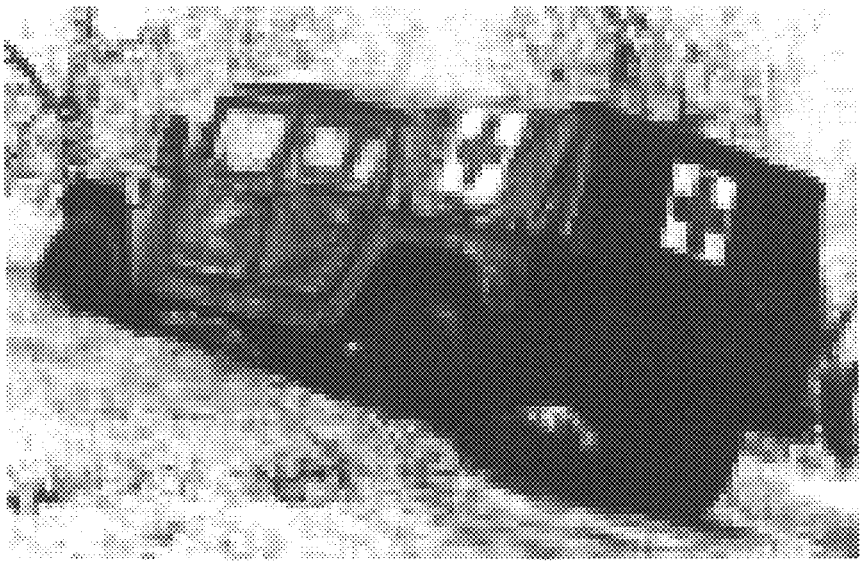
Figure 37:
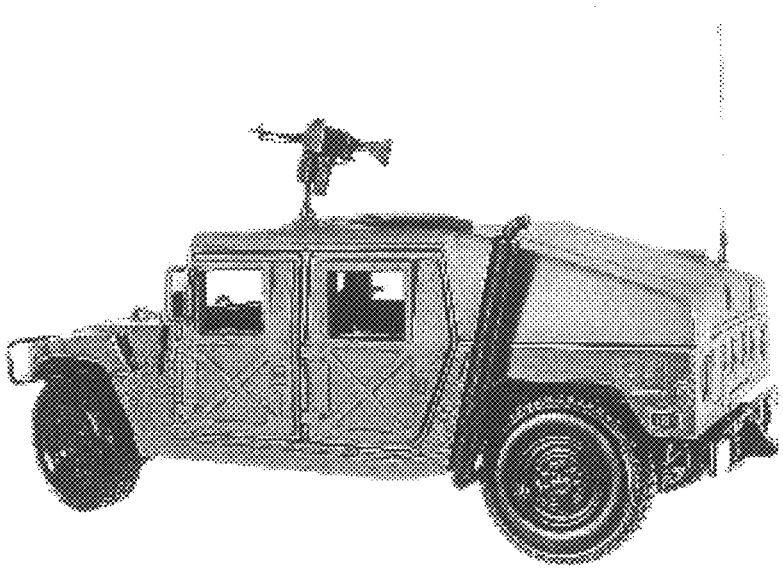
Figure 38:
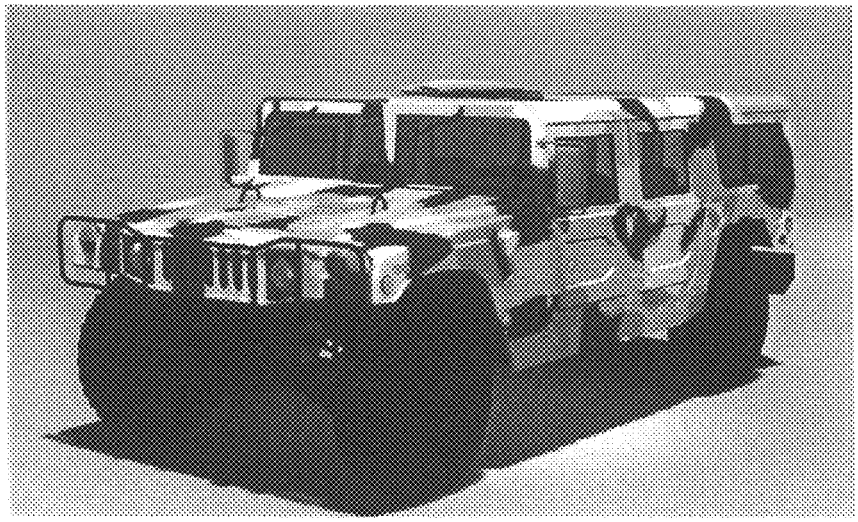

FIG. 28 illustrates one preferred application of a very low profile semi-electronic scanning antenna. The antenna beam is steered electronically in elevation and mechanically in azimuth. In this example, the antenna may be flat on the vehicle roof, reducing the overall height of the antenna terminal (below 6 cm). In this example, the antenna terminal comprises a static platform (antenna case and base) 401 and rotating platform 402. An antenna panel 410 may be situated on the rotating platform 402. The antenna panel 410 comprises two array antenna apertures: a receive antenna aperture 403 and transmit antenna aperture 405. In another embodiment, the same array antenna aperture is utilized for both transmit and receive and may include a plurality of broadband radiating antenna elements along with suitable diplexer circuits to separate the transmit and receive signals and to permit polarization control of the transmit and receive signals. The antenna panel 410 may be configured to include several flat layers which comprises radiating antenna elements, combined microstrip/waveguide low loss combining networks, amplifiers, phase controlling devices, low profile up and down converters, gyro sensors and digital control unit. In these embodiments, since the antenna may scan electronically only in the elevation plane, the radiating elements may be grouped initially by rows. In this manner, the system may apply the phase control to the entire row in the process of scanning, reducing significantly the number of amplifiers and time delay or phase controlling devices (compared with the full electronically steering option).

In another exemplary embodiment, when the field of view in the elevation plane is limited to about 50-60 degrees, it is possible to combine pairs of rows, which may further reduce the number of amplifiers and phase controlling devices. In one embodiment, the static platform 401 comprises azimuth motor and azimuth motor controller 407, power supply unit 409 and a static part of the rotary joint 406. In another embodiment the static platform 401 may comprise GPS modules, gyro sensors, digital control unit or block-up converter. The static 401 and rotating 402 platforms may or may not be connected through rotary joint 406. Where a rotary joint is used, the rotary joint 406 provides transmit and receive signals, power supply and digital control signals. In one preferred embodiment a dual channel rotary joint may be used to provide independent transmit and receive signals between the two platforms and slip ring provide for DC and digital signals. The static platform (the base of the antenna casing) may also include antenna radome 411 attachment mechanics and a set of brackets 412 for proper mounting on the vehicle roof. The antenna radome 411 provides environment protection.

Two-Way Fully Electronic Scanning Antenna Application

Another embodiment is a fully electronic scanning antenna. The antenna comprises the plurality of radiating element, feeding networks, amplifiers and phase controlling devices, which are able to control properly the phase of each one of the antenna radiating elements or an appropriate subgroup of elements in order to achieve fully electronic beam steering. The fully electronically scanning antenna may comprise two independent receive and transmit array antenna apertures or in another preferred embodiment to have one and the same antenna aperture for transmit and receive comprising the plurality of broadband antenna elements, diplexing, and polarization control elements. The antenna terminals in case of fully electronic steering may include a multilayer antenna panel and antenna box. The antenna box may comprise a radome for environmental protection and for proper mounting on the vehicles. Where a multi-layer antenna panel is utilized, it may include all antenna electronic parts. The radiation antenna elements may be arranged on the top layer of the antenna panel, while the feeding networks and low noise amplifiers are situated on the intermediate layers. In one embodiment, the phase controlling devices, final combining networks, and low profile down and up converting devices are arranged on the bottom layer of the antenna panel. In another embodiment, the antenna panel comprises the digital control unit, gyro sensors and GPS module. The exemplary embodiments described above may be configured to enable a fully electronic steerable antenna which may be more reliable because it does not include any moving parts. Another important advantage of the preferred application is the highest possible speed of tracking limited only by the speed of electronics.

Ruggedization for Military Applications

A consideration for military applications is the radome design and ruggedization. For military applications, it is often useful to use special materials and designs. One example is the use of a LEXAN™ plastic radome. RaySat has employed a variation of this design for train environments. The material is very strong and has a good transparency for RF signals. By increasing the thickness, the LEXAN plastic may be designed to be thick enough and correspondingly very strong (around 6-8 mm in Ku band). The thickness may be selected to account for the best tradeoff of the absorption losses with respect to different frequencies used in the transmit and receive, since the frequencies are in different bands 11.9-12.7 for Rx and 14-14.5 for Tx. Another embodiment is to use a more expensive radome, specially designed for military applications based on plastic with ceramic filing or other proper materials. LEXAN material may be used in the bullet protection jackets. Similar other materials with good bullet protection and satellite signal transparency may also be used.

Two or more antennas may be used on a single vehicle to improve the reliability of the overall system. For example, if the distance between antennas is large enough (having in mind application on long vehicles such as buses, trains, ships etc.), it will reduce significantly the communication interruptions due to temporary blockages of one of the antennas from buildings, trees and other obstacles.

In another preferred embodiment of the overall terminal system, spread spectrum may be implemented with the appropriate satellite modem utilized in order to meet adjacent satellite interference regulations.

Still further, the use of low order modulation such as BPSK along with low fractional coding rates (high number of coding bits relative to information bits) such as FEC rate ⅓ or ¼ or lower with the accompanying high coding gains may be used as a de facto "spreading" method, yet retaining conventional modem operation, to distribute the energy sufficiently to allow the use of a "non-spread" signal on the ground. In this embodiment the limiting of the antenna skew angle along with the use of forward error correction coding (FEC) performance and low input power density into the antenna allows the antenna to comply with regulatory requirements. These regulatory requirements are discussed in more detail below.

Speed of Tracking

The presently described embodiment easily achieves a tracking speed of 40 deg/s in elevation and 60 deg/sec in azimuth, which is more than enough for military applications such as on a tank. For military application it is important to implement dynamic adjustment of the polarization tilt when the tank is driving over rough terrain. For that purpose a third gyro on the back of the transmit panel may be implemented. The gyro may provide the CPU information for the dynamic tilt change to compensate for the vehicle movement around the axes normal to the surface of the antenna panels. The initial polarization tilt angle (when the vehicle is standing on a flat horizontal surface) is calculated by CPU having the information for the geographical position of the antenna, provided by GPS module and the position of the satellite preferred for communication. The CPU may incorporate tracking software receiving input from the output of the gyros and performing coordinate calculations to compensate for tilting of the vehicle from a level position.

Further, improvements in tracking velocities and tracking accelerations that may be achieved for some military and/or aerospace applications. In certain instances, high performance motors, belts, and/or electromechanical parts may be incorporated to achieve even more responsiveness. For example, use of high performance tracking hardware allows tracking velocities of 400 degrees per second in azimuth, elevation and polarization. Also, tracking accelerations of at least 500 degrees per second per second (deg/$s^2$) may readily be incorporated within the scope of the design principles upon which this application is based. More detailed tracking principles of operation will be described in a subsequent paragraph.

In exemplary embodiments, the antenna may be mounted in a way that provides a clear view to all elevation and azimuth angles covering the desired field of view. In one embodiment, a convenient way to connect the terminal with the equipment inside the vehicle is a cable connection. The described configuration may use 2 RF or optical cables (for Rx and Tx) connection with the satellite modem and one additional cable for DC and digital communication with the indoor unit. Wireless connection, while also a possible embodiment, can be problematic in certain military environments and could be detected relatively easily by the enemy reconnaissance.

Further embodiments of the two-way terminals include variations wherein the number of panels is different from that described so far and also terminals whose overall size is optimized for specific data requirements and vehicle "real estate" limitations as is described in the subsequent paragraphs.

Alternate Optimized Embodiments

Figure 39:
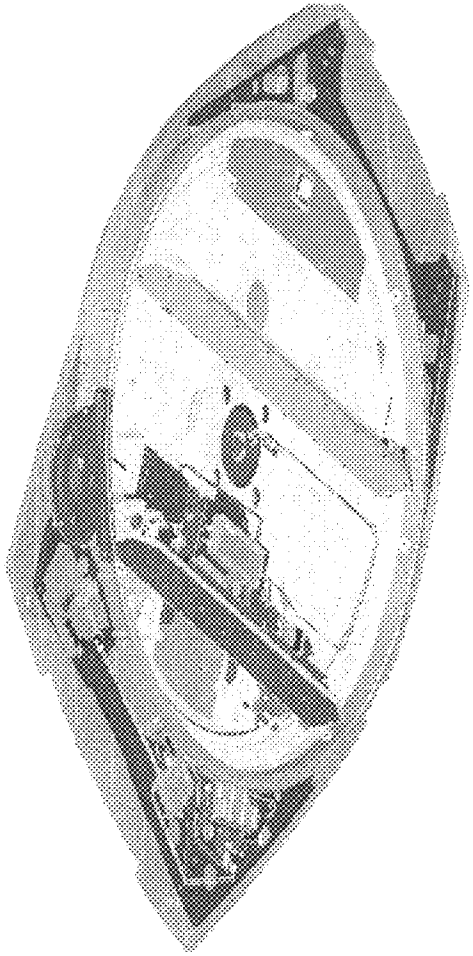
FIG. 39 illustrates a first exemplary embodiment of a two panel terminal applicable for low elevation angles pointing, with particular use in northern hemisphere locations.
Figure 40:
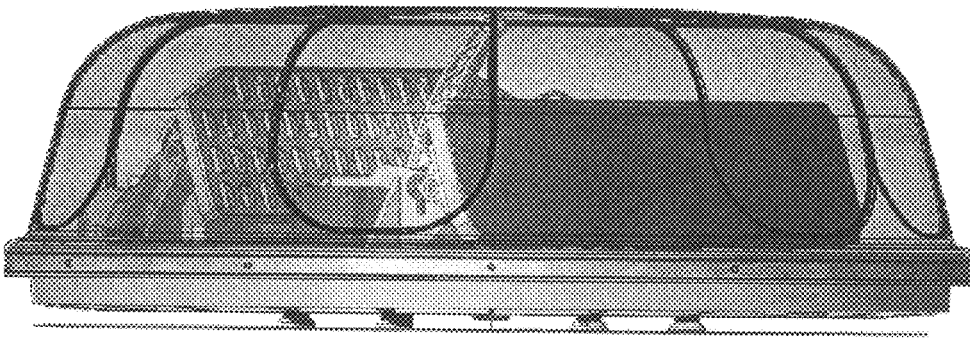
FIGS. 40-43 illustrate a second exemplary embodiment of a two panel terminal applicable for low elevation angles pointing, with particular use in northern hemisphere locations.
Figure 41:
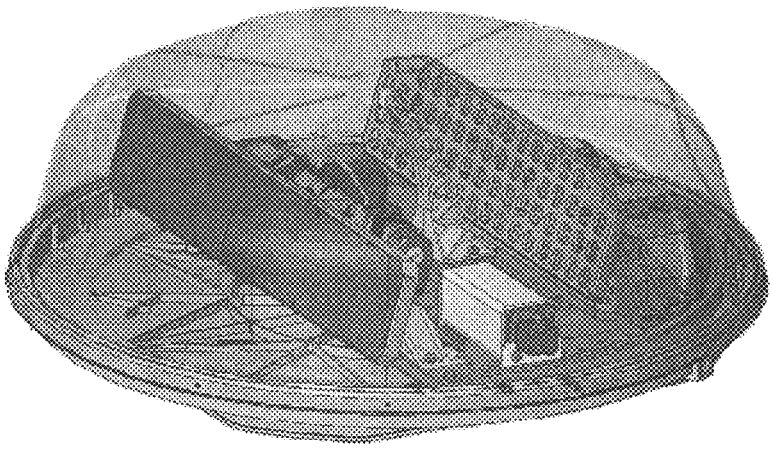
Figure 42:
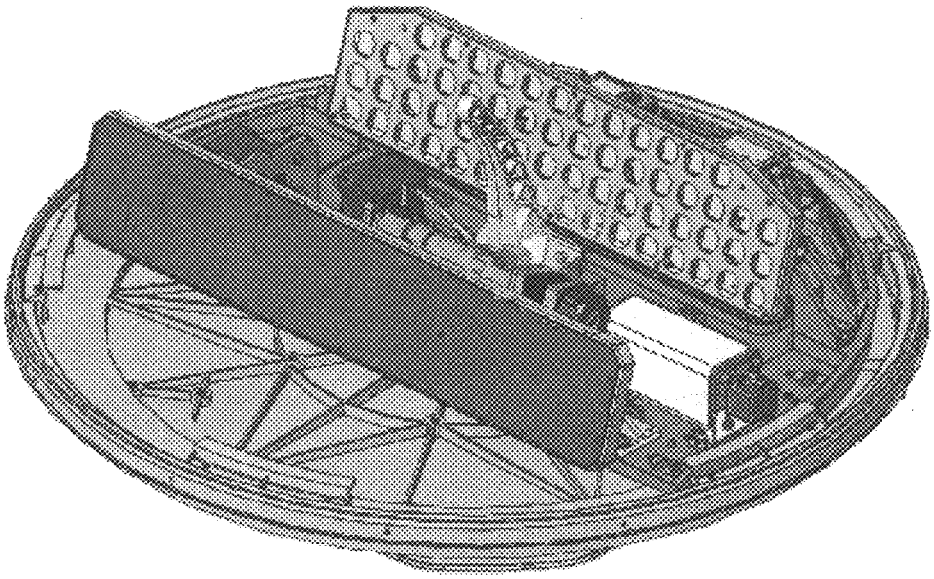
Figure 43:
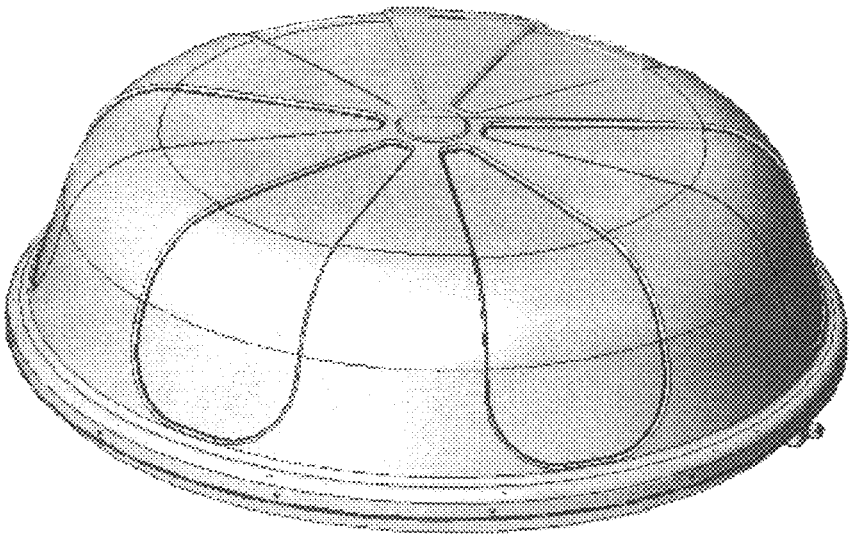
Figure 15:
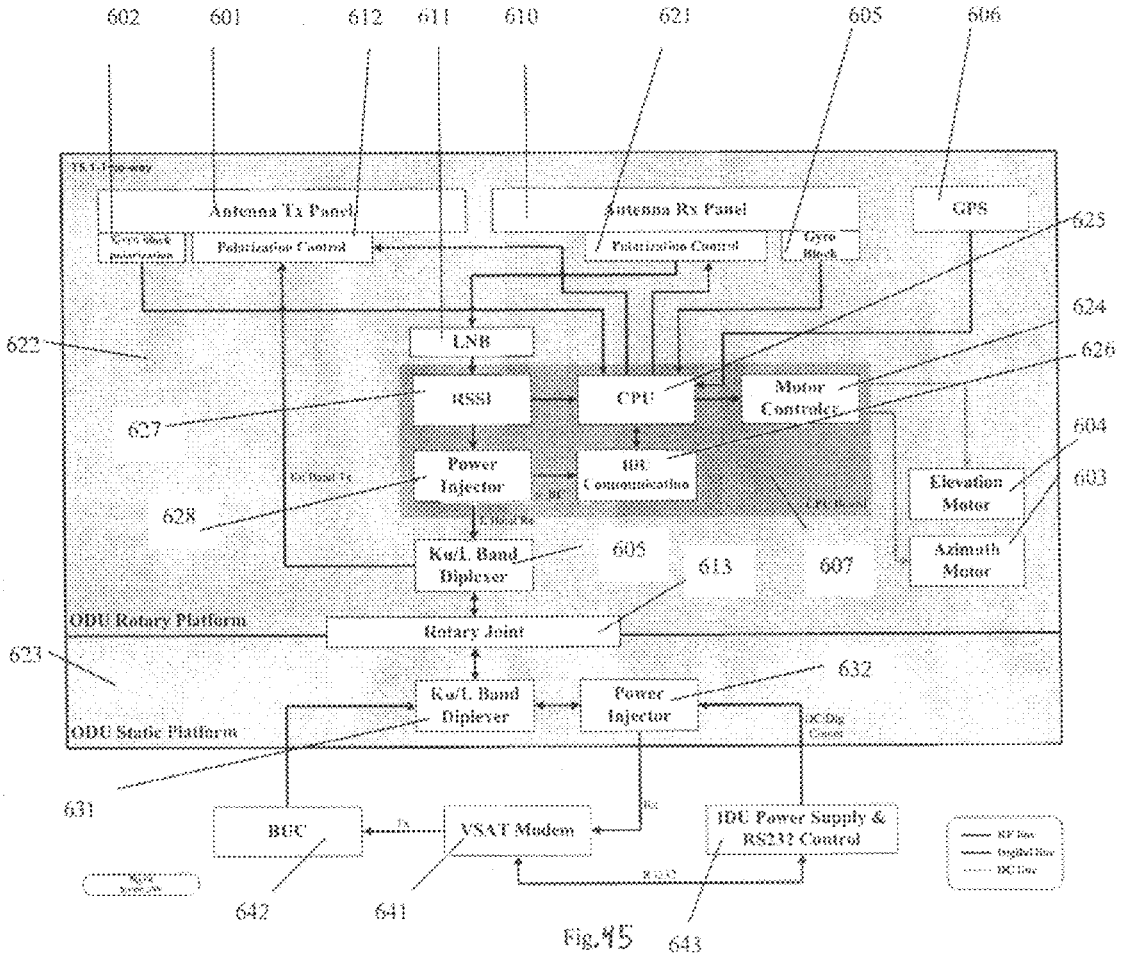

The embodiment illustrated in FIG. 39 incorporates just two panels. The inter panel spacing is such that there is little or no "shadowing" between the panels even at high elevation angles. For example, as the vehicle moves further north or south and/or climbs in elevation, the angle between the antenna platform and the satellite becomes lower (e.g., 30 degrees, 20 degrees, 10 degrees or even lower).

In order to operate in northern hemisphere regions, southern hemisphere regions, or high altitudes using multi-panel architectures, it is required to avoid shadowing to a large extent. Often, military and first responder vehicles must be designed to operate where ever they are needed in the world. It is often not helpful to have a military vehicle that cannot operate above certain altitudes (e.g., 3,000 feet) or in excess of certain latitudes e.g. 30 degrees (roughly the Canadian boarder in the U.S.) or less (arctic region). Much of Russia and the Commonwealth of Independent States (former Soviet Union) lies at latitudes that would preclude conventional multi-panel arrays from operating correctly.

Figure 54:
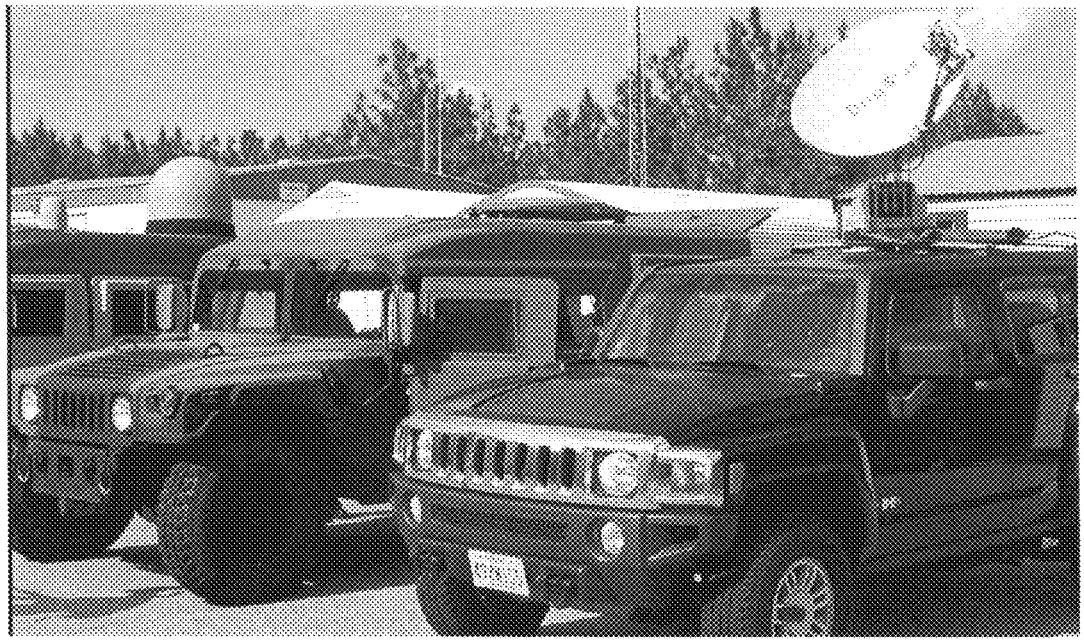
FIG. 54 illustrates two proposed configurations for mobile antennas juxtaposed with embodiments of the present invention.

The conventional solution is to having military or other vehicles operating above a certain latitude to have a very high profile antenna. See, for example, FIG. 54. In FIG. 54 two of the vehicles have antennas that are at least ⅓ meter tall to 1 meter tall. Although these configurations can operate at high altitudes, they are unsuitable for most military applications where low profile reduces the target cross section of the communication module. FIG. 54 shows a low profile antenna mounted on a HUMVEE next to two high profile satellite antennas.

Figure 52:
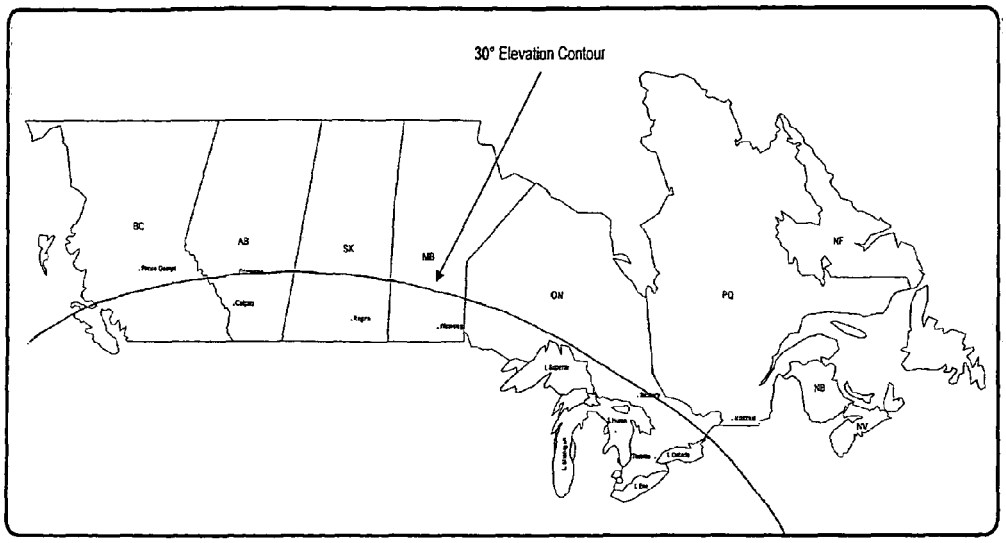
FIG. 52-53 illustrate embodiments of the elevation angle coverage for various configurations of the antenna terminal shown in FIGS. 39-43, e.g., panel spacing of about twice the height of the rectangular panels, or about three times the height of the rectangular panels, or about four times the height of the rectangular panels.
Figure 53:
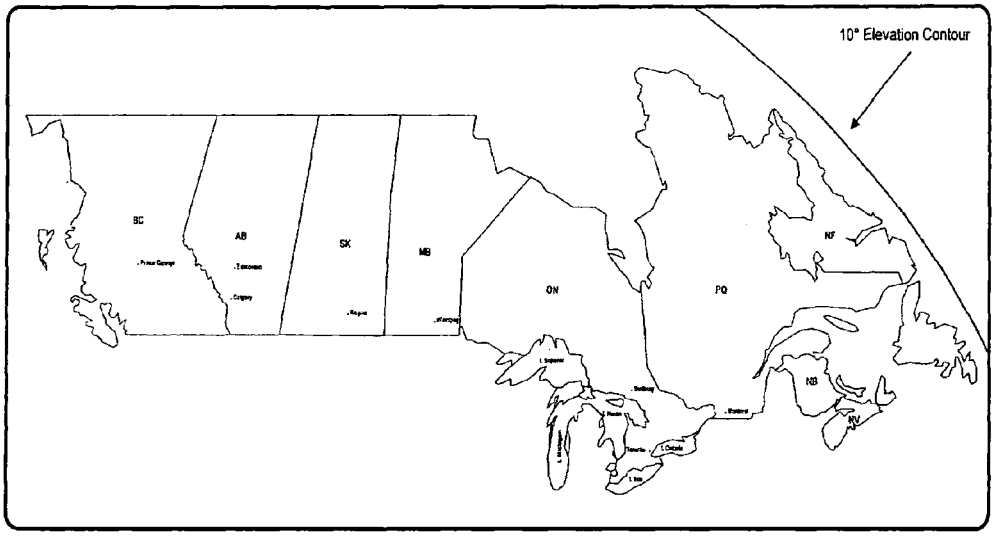

Typically, low profile antennas operated with close inter-panel spacing. Although height is reduced (e.g., the phased panels stand less than 10 cm. in height), the inter-panel spacing may be such that panels shade their neighboring panels in low elevations (high latitudes). Configurations such as those shown in FIG. 1 typically operate up to an elevation angle of about 30°. However, the antennas shown in FIGS. 39-43 are capable of operating at much lower elevation angles. These antennas are capable of operating in locations such as Ft. McMurray, Alberta (home of Canada's current oil boom). Overcoming the low look angle challenge means the antenna panels must be able to mechanically tilt to lower angles. In addition to the physical adjustment of the tilt angle of the panels, the inter-panel spacing must be such that the panels do not substantially shadow the other panels when the angle to the satellite is considered. For example, FIG. 52 shows an exemplary 30° elevation contour for Anik F2@111.1° W. Similarly, FIG. 53 shows an exemplary 10° Elevation Contour for Anik F2@111.1° W. In multi-panel satellites operating in this region, the inter Operating a network in northern latitudes via geosynchronous satellites presents certain challenges. Due to the satellite being stationed 23,000 miles over the equator and the earth's curvature, the look angle to any antenna decreases rapidly as it moves towards higher latitudes and/or the vehicle moves into higher altitudes. As a result, the range to the satellite increases, which means the satellite signal has to travel a greater distance through the earth's atmosphere where it is subject to attenuation due to atmospheric moisture and absorption.

Overcoming the additional atmospheric losses due to operating in northern latitudes can be facilitated by modifications of the hub design and satellite utilization. Since the transmit power from a remote antenna is fixed, a larger hub antenna (on the order of seven meters or more) is often helpful to receive and decode the faint incoming signal from the remote. In addition, the forward link (hub to remote) often includes high powered transmitters at the hub to provide the additional gain required to overcome the atmospheric losses with sufficient margin. To improve the link availability, particularly during rain showers, uplink power control at the hub is often helpful. This feature automatically increases the output power of the transmitter when rain attenuation is detected by one or more sensors, weather reports and/or electronic detection devices.

The increased power requirements at the hub also drive the satellite transponder utilization. This means the forward link carrier will consume a larger percentage of the transponder power, thereby driving up the satellite space segment costs for the service offering to the end users.

FIGS. 39-43 include, for example, two panels which may include a transmit panel and a receive panel, and/or one or more transmit and receive panels. In the illustrated embodiment, there are two panels. This embodiment represents a substantially simpler design for certain applications. For example, in exemplary embodiments, there is no inter-panel spacing adjustments. This substantially reduces the mechanical and electrical components and makes the overall panel more reliable. In addition, this design operates to lower elevation angles, e.g. 10 degrees and below. Further, the size of the two panels is optimized according to the allowable size of the rotating platform so as to maximize the panel antenna gains. For example, the antenna in FIG. 39 is configured for a minimal cross sectional profile whereas the antenna of FIGS. 40-43 allows for a much smaller diameter (e.g. 53 cm) with a slightly increased height (e.g. 18 cm) while still preventing shadowing of the panels. Where the panels are not performing dual roles of both transmit and receive, no panel combining circuits are necessary for these configurations.

Figure 46:
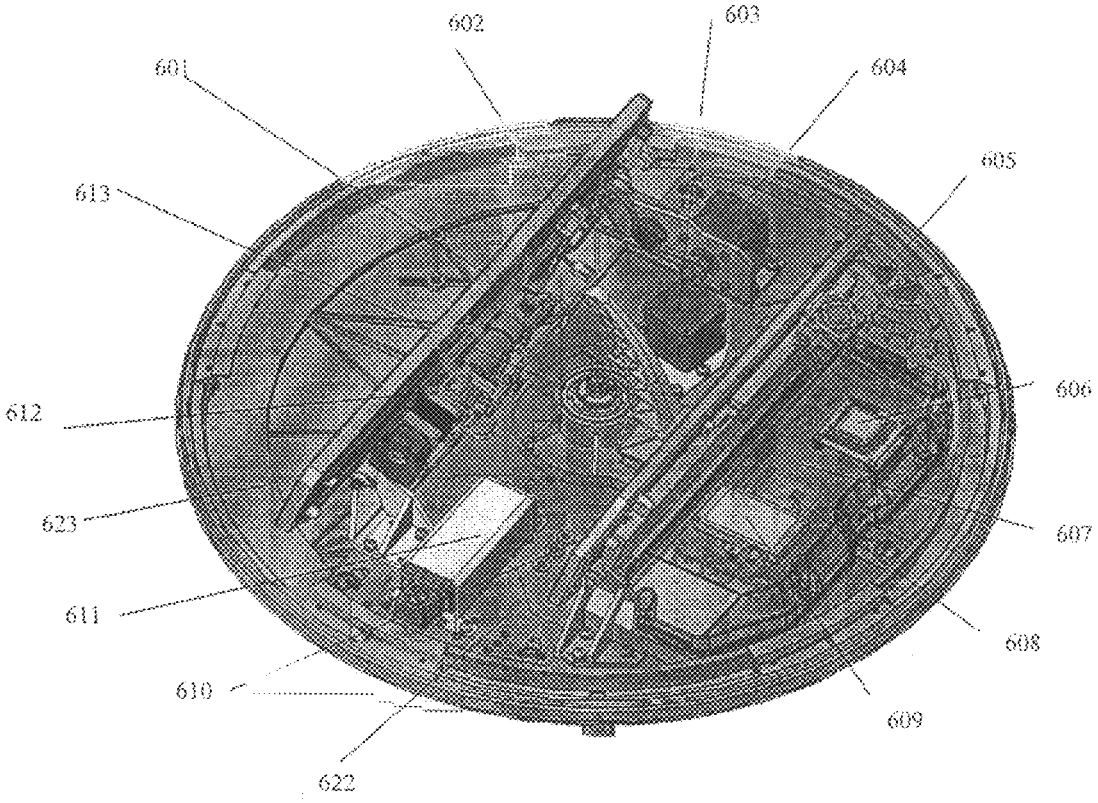
FIG. 46 illustrates an exemplary mechanical drawing of the reduced size transmit-receive antenna terminal shown in FIGS. 39-45 which is applicable to a specialized dedicated mobile service.

FIGS. 45 and 46 illustrate another variant of the low profile two-way terminals. Here, a smaller diameter terminal is shown which operates at lower data rates but occupies a substantially smaller surface area on a vehicle. For example, this terminal may be only 10-18 cm high by 40-53 cm in diameter. It may include two panels, one for Tx and one for Rx (and/or combined transmit and receive panels). When operated at Ku-band with typical FSS satellites, this embodiment can provide various suitable data rates. In one embodiment where low link connection costs are required, a 64 kbps uplink and several Mbps downlink speeds are easily achievable.

With respect to some embodiments as illustrated on FIGS. 45 and 46 the antenna terminal may have a reduced size supporting a dedicated mobile service. In embodiments of the example described herein, two-way data communications using satellites in the U.S. Fixed Satellite Service (FSS) frequency band of 11.7-12.2 for reception (downlink or forward link) and 14.0-14.5 GHz for transmit (uplink or return link) may be provided for a dedicated service. In this manner, it is practical to reduce the size of the antennas installed on the vehicles to a smaller diameter—making it more practical and aesthetically pleasing for smaller vehicles. The dedicated service may use a spread spectrum technology or other suitable coding technique in order to suppress the interference from and to the satellites arranged on the neighboring orbital positions. The small size and low profile of the antennas make them attractive for installations even on small vehicles such as small cars, recreation vehicles, boats or other vehicles where the small size, low profile is of a main importance. The lower profile facilitates terminal installation directly on the roof of the mobile platforms, while maintaining the aerodynamic properties of the vehicles almost unchanged.

In another embodiment, comprising antenna panel (phased array) with fully electronic beam steering in elevation, an extremely low profile antenna package is achieved, allowing the antenna terminal integration within the vehicle roof. This is particularly important for armored vehicles where any deviation above the vehicle often makes a target for enemy fire. It is also important for sports cars and luxury cars where vehicle drag and/or visual appearance is a major concern in the purchasing decision of the vehicle.

The proposed low profile communication equipment meets the above-mentioned objective, comprising low profile outdoor transmit and receive antenna terminal and indoor equipment. While this equipment has heretofore been described, it generally includes a modem, upconverter BUC (Block Up Converter), which provides transmit signal to the outdoor terminal, IDU (indoor unit) providing power supply and communication control (e.g., RS 232, WiFi, and/or other) and data receivers.

It is clear that similar terminals for different frequency bands, e.g. portions of the 10.7-12.7 GHz bands available in Europe, are included within the disclosure of this invention.

In an exemplary embodiment, the low profile in-motion antenna comprises one transmit and one receive antenna panels, each containing a plurality of dual port radiating elements (patches, apertures etc.), passive summation circuits, and active components. Each antenna panel in this embodiment has two independent outputs each one dedicated to one of the two orthogonal linear polarizations. The signals from the two antenna outputs with two orthogonal linear polarizations are then processed in polarization control devices in order to adjust the polarization tilt in case of linear polarization.

In still further embodiments, transmit and receive antenna panels are arranged on the same rotating platform in order to ensure exact pointing to the selected satellite using tracking in receive mode. The beam pointing may be accomplished by mechanical rotation in azimuth plane of the platform comprising transmit and receive antenna panels and by mechanical, electronic or mixed steering in the elevation plane.

The motors or electronic steering components may be controlled by a computer (e.g., a CPU or other logic device) using the information, supplied by the sensor and received signal strength indicator (RSSI) blocks. FIG. 44 is an exemplary table of performance characteristics associated with an exemplary antenna in accordance with the aforementioned embodiments (e.g., FIGS. 39-43).

FIG. 45 illustrates block diagram of the mobile antenna terminal in accordance with embodiments of the invention.

FIG. 46 illustrates the arrangement of the reduced size indoor unit (transmit and receive antenna terminal).

Instances of Specific Implementation

The example refers to a preferred application, namely low profile and small size antenna terminal. The terminal includes an outdoor unit and indoor equipment installed inside the vehicle. The outdoor unit configuration is shown on FIG. 46. In one preferred embodiment the outdoor unit comprises rotating platform 622 and static platform 623 and cover (radome) not shown. The rotating platform comprises: Transmit antenna panel 601 with a polarization control device 612 and tilt sensor 602 coupled to the transmit panel 601 (e.g., coupled to the back of the panel); azimuth motor 603; elevation motor 604, receive antenna panel 610 with a gyro sensor block 605 attached to the panel 610 (e.g., attached to the back cover); CPU board 607; GPS module 606; recognition module 608; diplexer 609 and LNB (Low Noise Block) 611.

The static platform 623 may include a diplexer and power injector (not shown). Different types of the attachment devices may be used for antenna mounting on the vehicle roof. In some preferred embodiments such devices may be brackets or strong magnets support or other suitable arrangements.

Connection between the rotating platform 622 and static platform 623 may be done using a rotary joint device 613 comprising in one preferred embodiment a dual band RF rotary connection for transferring the RF signals between the two platforms and may be a slip ring device for transferring the DC power supply and digital control signals.

The functionality of the preferred embodiment may be explained using the block diagram shown on FIG. 45. Most of the antenna main blocks are arranged on the rotating platform 622. The transmit 601 and receive 610 antenna panels pointing their main beams at one and the same direction are attached to the rotating platform 622, which rotates the antenna panels simultaneously in the azimuth plane by means of an azimuth motor 603. The pointing of the receive and transmit antenna panels in the elevation plane may be done using an elevation motor 604, rotating in the elevation plane both of the panels synchronously. The antenna beam positions are calculated by a central processor unit (CPU) device 625 using information about mobile platform rotation delivered by the gyro sensors 605 and about the strength of the received signal delivered by the RSSI device 627. Then commands may be sent to the motor controller 624 to drive the motors 604 and 603 and point the antenna beam toward the satellite selected for communication. The transmit and receive antennas may comprise a plurality of radiated elements arranged in antenna arrays or other type of antennas for example small reflectors, horns or lenses. In one preferred embodiment the antenna array antennas may comprise dual port radiating elements, passive combining circuits and amplifiers. In receive mode the signals received by the receive antenna elements are summed by two independent summation networks, amplified and delivered to the two antenna panel output. Each one of the signals which appear at the antenna outputs is proportional respectively to the received signals with vertical and horizontal polarizations. Then the two signals are used to adjust the polarization tilt according to the polarization offset of the signal transmitted by the satellite using the polarization controlling device 621. Then the received signal may be down converted by the standard LNB device 611 to the intermediate frequency in L band, transferred through diplexer 605 rotary joint 613 and the second diplexer 631 to the antenna terminal output and then trough the coaxial cable to the equipment inside the vehicle (VSAT) modem 641.

In transmit mode, the transmit signal formed by the VSAT modem 641 may be upconverted by the standard high power Block Up Converter BUC 642 to Ku band and then transferred through the static platform duplexer 631 and the dual band rotary joint 613 to the transmit antenna panel 601. In one preferred embodiment the polarization of the transmit signal is adjusted by the polarization control device 621 in order to match the polarization with the polarization of the satellite receiving antenna.

In another preferred embodiment of the invention the polarization tilt of the receive and transmit signals is calculated by the CPU 625 using information from the GPS module 606 for the vehicle geographical position and the position of the selected for communication satellite and the information for the tilt of the vehicle delivered by a gyro tilt sensor 602 attached to the back cover of the transmit antenna panel 601.

In exemplary embodiment the power supply for the devices installed on the rotary platform 622 is delivered through the dual band rotary joint 613 and power injector 632 by the IDU 643 installed inside the vehicle.

A feature of some exemplary terminals described herein is autonomous acquisition and tracking. In these embodiments, the terminal does not need to rely on inputs from the vehicle's navigation system and, indeed does not require that such a navigation system exist. Nor does it require any operator intervention for tracking and acquisition. Of course, the autonomous features can readily be disabled and the terminal be configured to permit "obedient" pointing by taking its direction form such a system if required to do so (as might be the case for an aircraft application). The autonomous acquisition and tracking is based on the use of tracking beams and a received signal strength indicator (RSSI). One exemplary embodiment of an algorithm employed for determining signal maximum locations is described in U.S. patent application Ser. No. 10/481,107, filed Dec. 17, 2003, now U.S. Pat. No. 6,900,757, herein incorporated by reference.

Figure 49:
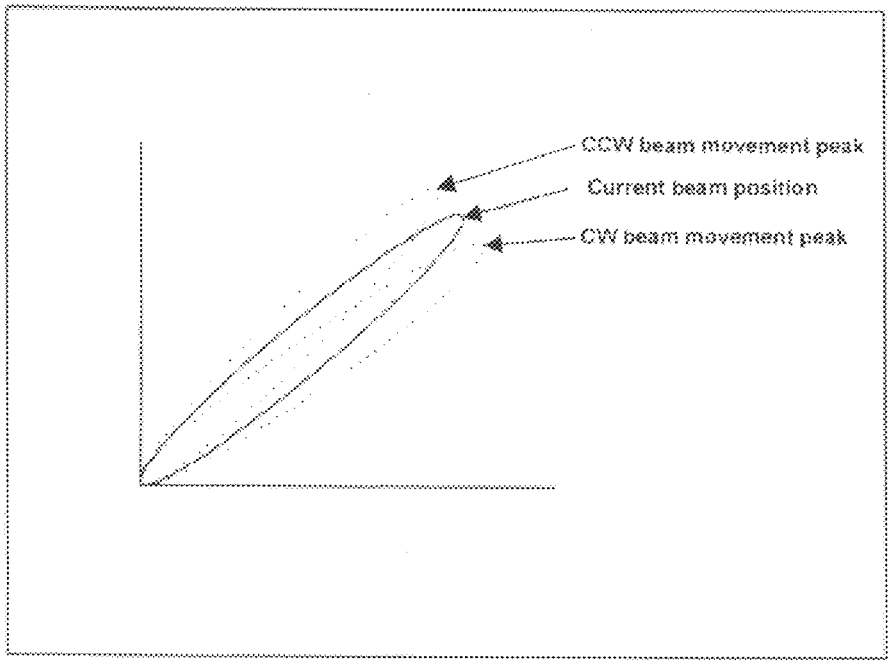
FIG. 49. illustrates the application of the azimuth tracking beams.
Figure 50:
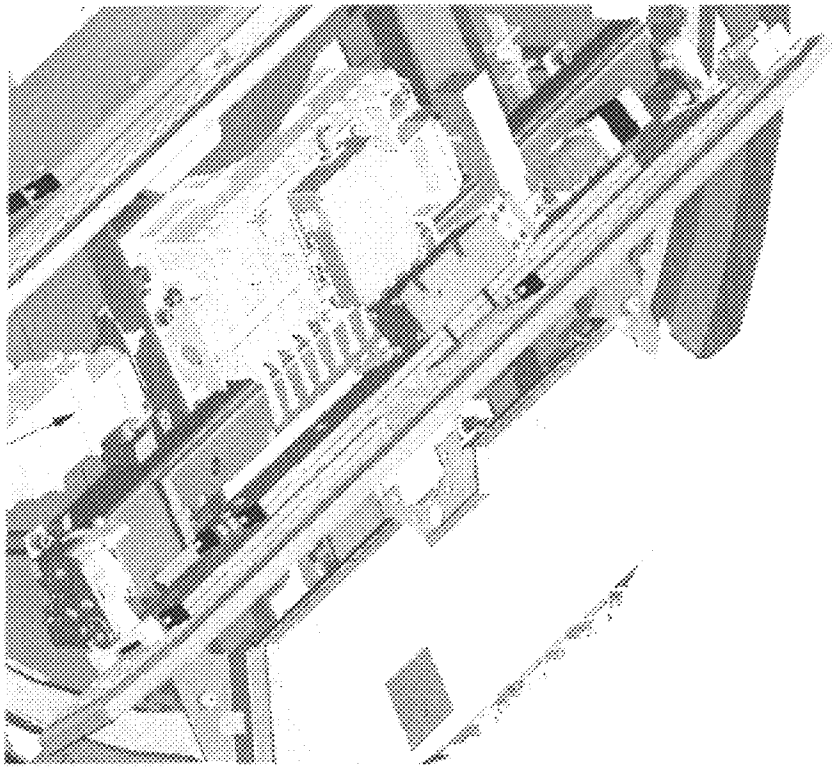
FIG. 50 illustrates embodiment of the terminal configuration with block upconverter (BUC) installed inside the outdoor unit.
Figure 51:
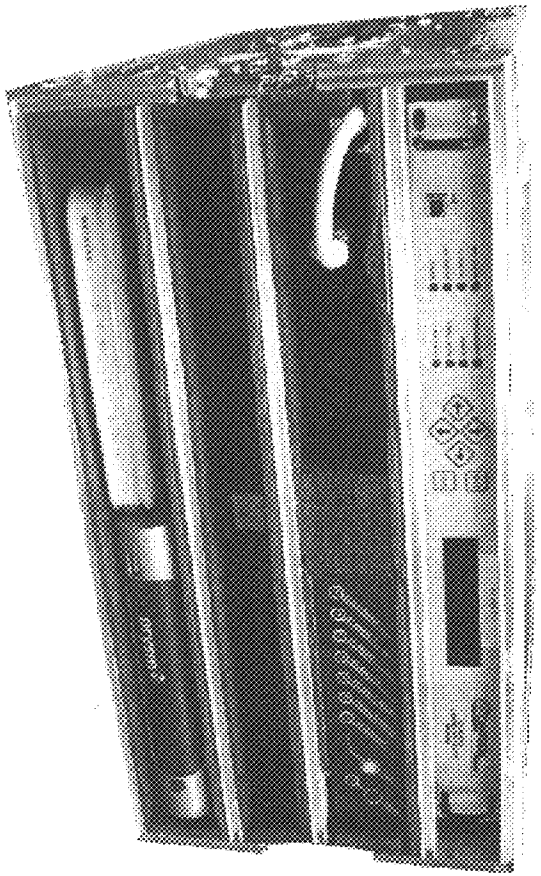
FIG. 51 illustrates embodiment comprising non-spread modem indoor unit (IDU)

The signals from the receive panels may be fed to the phase combing network as shown in FIG. 47. In the elevation plane 3 beans are generated through the phase combiners: an upper tracking beam, a main beam, and a lower tracking beam as shown in FIG. 48. To track the satellite in the elevation plane the phase shifter shifts its output to the energy detector between the upper and lower tracking beams. The energy detector may include a programmable filter which centers the filter frequency and desired bandwidth on the carrier. The CPU or other computer device may then determine that the elevation is correct when the power from the upper and lower tracking beams are equal. For the azimuth plane the antenna dithers mechanically in the azimuth plane. The energy detector may be configured to synchronize the detected power of the main beam with the mechanical position on the azimuth plane. The correct azimuth position may be determined when the power detected at either end on the dither is the same as shown in FIG. 49. When the satellite signal is blocked, e.g. by driving under a bridge the antenna uses information from the Gyroscopes to maintain the antennas position on the satellite. In one preferred embodiments only two (instead of three) gyros attached on the back cover of one of the receiving panels may be used, measuring platform angles of rotation in azimuth and elevation. With linearly polarized signals the CPU uses GPS information about the satellite location and information from the inclinometers to set the polarization angles on an open loop basis. When it is determined that the satellite is no longer reliably pointed to the satellite (e.g., movement is detected while the receive beam is blocked) the transmit power is shut down to avoid any interference with adjacent satellites.

Applications of Low Profile Two-Way KU and/or KA Band Antennas

The low profile two-way antenna terminals may be used in a wide variety of applications and may be used in any of several satellite frequency bands while embodying essentially the same design concepts rendered with the particular details appropriate to each band. These bands include, but are not limited to: L-band, e.g. around 1.5-1.6 GHz for such systems as MSAT, Iridium, Globalstar, and Inmarsat; X-band around 7-8 GHz for such systems as XTAR and other military satellites; Ku-band as noted for most FSS satellites around the world; Ka-band for existing and forthcoming satellites such as Wideband Gapfiller; and other bands such as the 20/44 GHz bands and Q-bands.

Figure 23:
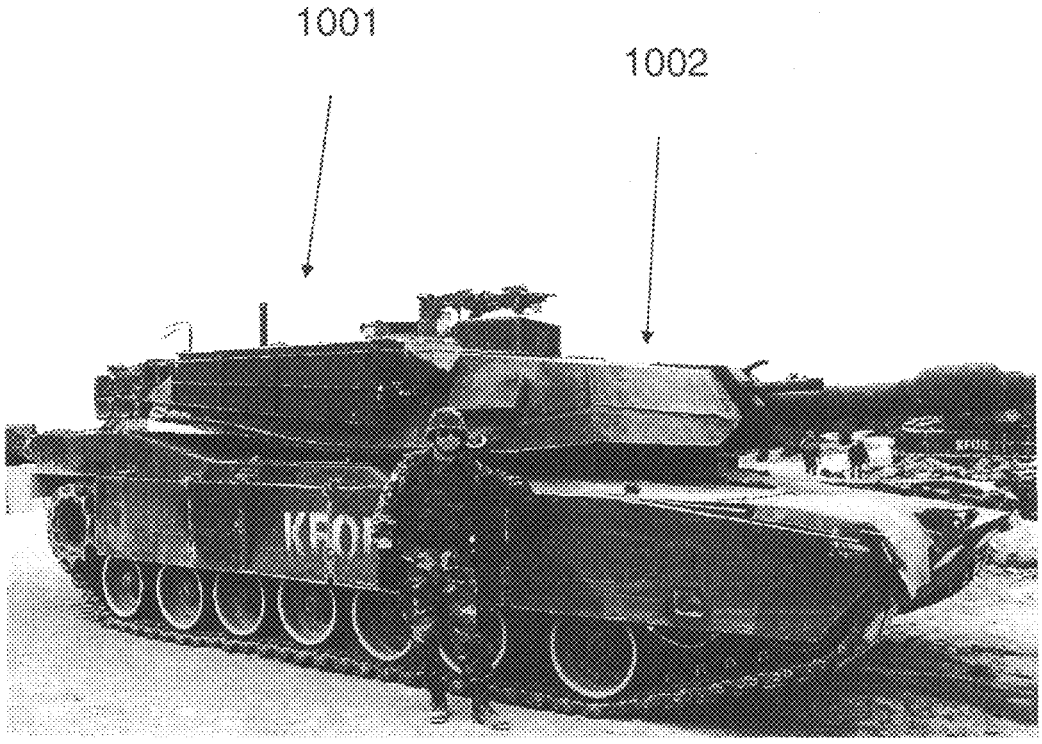
FIGS. 23-24 illustrate various exemplary places the low profile two-way satellite antenna may be placed on a tank (e.g., an Abrams tank)
Figure 24:
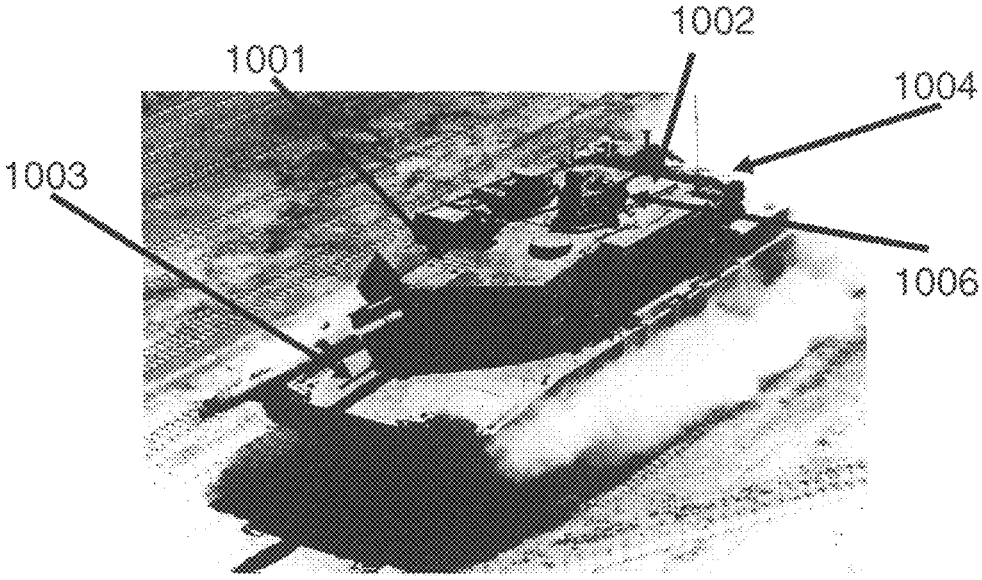
Figure 25:
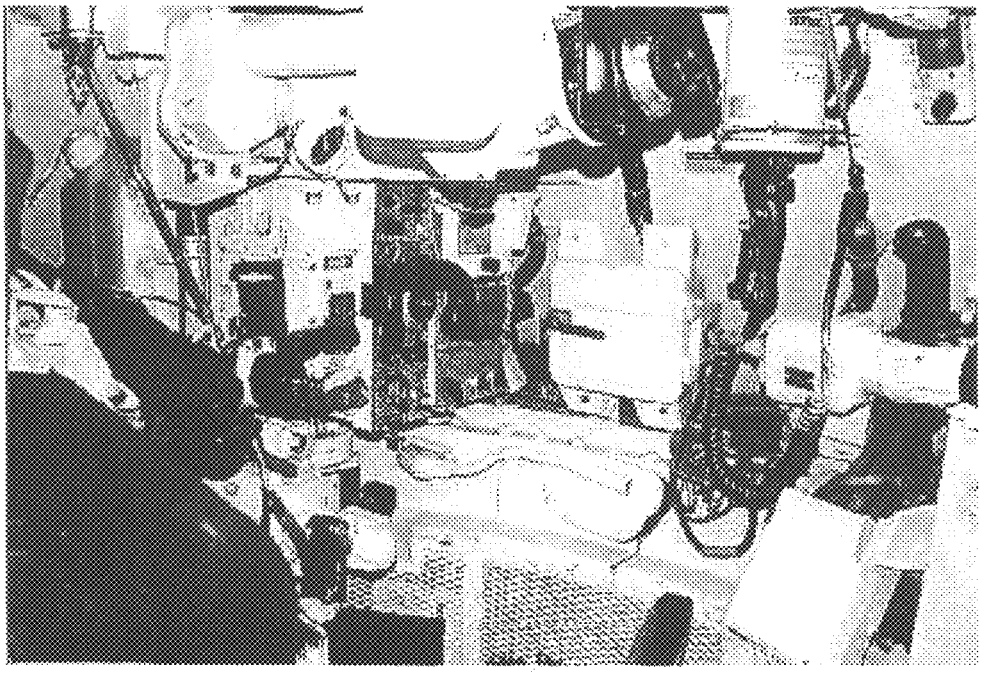
FIG. 25 illustrates an exemplary gunners station in an Abrams tank which may be retrofitted with embodiments of the present invention.
Figure 26:
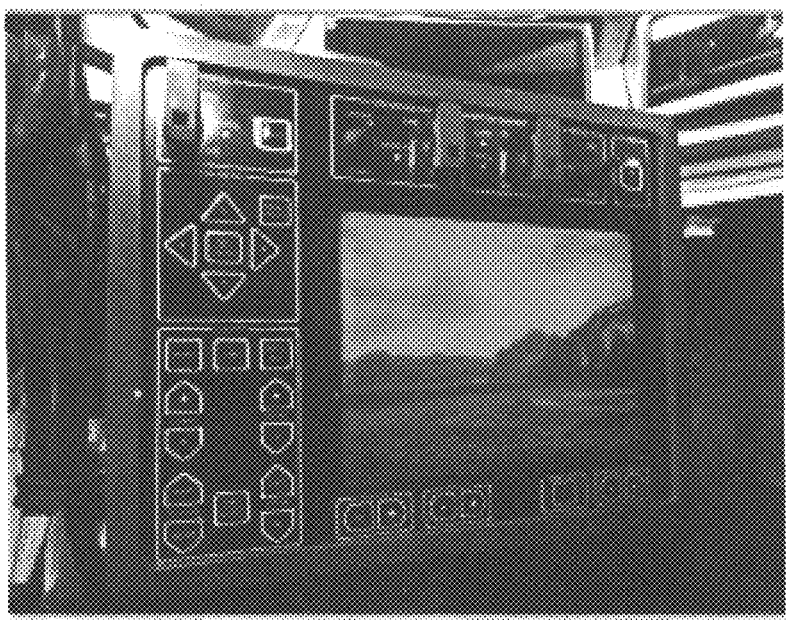
FIG. 26 illustrates an exemplary thermal site for use in an Abrams tank.
Figure 27:
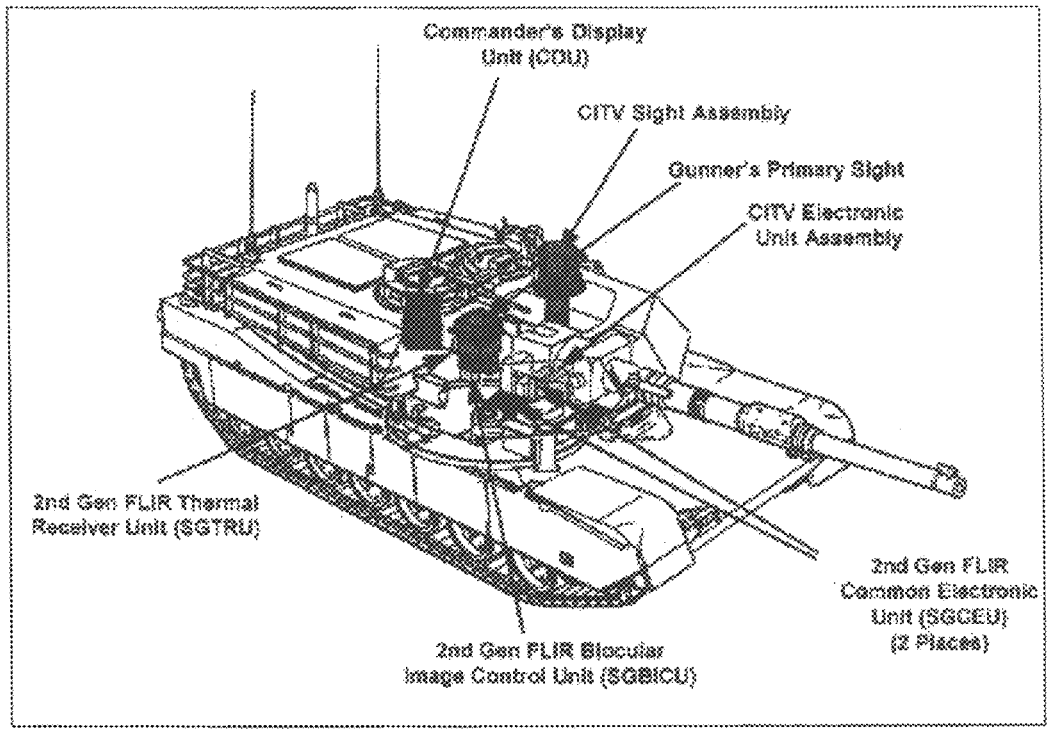
FIG. 27 illustrates an exemplary layout of electronics in an Abrams tank.

Examples of Ku-band or Ka-band applications include: "Communications on the move" or COTM, also sometimes designates as Satellite Communications on the Move (SOTM), allows a tank, HMMWV, JLTV, personnel carrier, bus, truck, boat, plane or other military vehicle to stay in constant high speed data communication with a command center and other assets. In example SOTM applications, the military vehicles receiver may be configured to include a low profile Ku and/or Ka band antenna positioned somewhere on the military vehicles so as to minimize any damage to the antenna. In exemplary embodiments, the low profile antenna may be located on the top of the vehicle, such as shown in FIGS. 23 and 24. The antenna needs to be sufficiently high on the vehicle to avoid water damage when cording lakes or rivers as well as to maintain a clear line of site to the satellite. Additionally, it is desirable that the antenna be protected by the armor of the tank from attack.

The low profile for the satellite antenna is of particular importance in military applications. For example, an enemy will often target the communication vehicles and thus, knock out the communication of a column or military unit so that it cannot communicate with Command Center. Thus, satellite antennas (such as current dish or parabolic shaped antennas) having a relatively high profile could be susceptible to being knocked out by enemy positions and such an antenna is easily targeted. The low profile antennas, on the other hand, can be integrated in such a manner that they are not obvious and do not stick out from the vehicle. The low profile can actually be integrated into the armor in such a manner, as to conceal the communication vehicle's antenna from the enemy. Additionally, the sides of the antenna housing can be protected with armor, Kevlar or other type of covering, so that the antenna will withstand shrapnel and certain military projectiles.

A low profile Ku and/or Ka band antenna can minimize its vulnerability to attack by being mounted atop the tank and/or by including armor around the antenna. In addition, the antenna can be at least partially covered with a substance such as Kevlar (or other similar substance such as is used in bullet proof vests) that transmits electromagnetic waves while at the same time providing substantial impact resistance to projectiles.

In still further embodiments, the low profile two-way Ku and/or Ka band antenna may be integrated into the hatch or other similar mechanism to provide for minimal cost retrofit applications for existing military vehicles.

In still further embodiments, the antenna may be protected fully by a "helmet" that can be quickly removed during active communications.

The applications for the low profile Ku band antenna on military vehicles include logistical and tactical information. For example, data concerning the status of the vehicle may be communicated back to the command center. Currently, the Abrams tank allows the driver to monitor gas levels, oil pressure levels, temperature readings, and other similar status information. This information could also be sent to the centralized command center to keep the center apprised of the operational status of each of its assets in the battle field. Such status could not only include the fuel level of the vehicle, but also other logistic information such as the number of shells remaining in the vehicle; any repairs that may be desired of the vehicle such as air filters or other routine maintenance items. The status of the vehicle including the type of repairs that are desired can be sent up via the satellite link directly into a logistics center so that logistics and other support vehicles and/or supplies can be dispatched to the military column and/or vehicle to supply the vehicle.

In addition to support items such as logistics, the tank crew could also send and receive E-mails, engage in voice and even video communications, and access various network resources and the Internet. In this manner, the tank becomes the mobile home for the tank crew so that even if they are stationed at a remote outpost in the desert, they can have full high speed data communication with their tank command and/or others.

In still further aspects of the invention, the two-way low profile antenna can provide entertainment data to the troops. For example, in addition to: logistic, tactical, and on-site information; entertainment information such as USO broadcasts or messages from the General or President may be directed at the troops. Additionally, movies, training films, tactic updates, and/or other announcements from the commander or other information with home such as: e-mail and/or video information allow the troops to stay in touch and keep morale at a high level.

In addition to logistic information, tactical information can be supplied to and from the vehicle such as, for example: live video feed from the front of the vehicle so that a commander stationed at a central location (e.g., in Florida) can watch in real time the development of the battle from the tank commander's perspective. Further, the complement of the tank crew might even be able to be reduced by having targeting and other operations taken over by remote control. Rather than a four man crew, the tank might be able to operate with a two man crew with the remaining functions being controlled remotely.

The movement of the vehicle, its current position, readings from its thermal imaging cameras and targeting systems and other tactical information could be suitably encrypted and transmitted from the vehicle to a centralized location. For example, any information that the vehicle may have concerning its current tactical position acquired targets, GPS information from the vehicle, and/or the current targets and hits the vehicle has recorded may be transmitted to a centralized location. The centralized location may have real-time and/or satellite/plane imagery to overlay the tactical information form the field assets (e.g., a tank) to develop a better picture of the battle field. This satellite imagery including the tanks or other vehicles positions (including enemy vehicles position) can then be overlaid on satellite imagery in the tank or at a centralized location. This allows the tank commander and/or any remote command center a complete picture of the battle field. In addition, this tactical information may also provide certain status information of the vehicle (such as whether the vehicle is alive or dead or whether a vehicle has been damaged due to a bomb or other shell or impact). Thus, the tactical commander can have immediate up-to-date information on all of its assets in the field.

Currently, many military and civilian applications include Ku band antennas. However, it is not limited to such. For example, Ka band and higher frequency antennas are fully contemplated by the present application and in fact, use of Ka band will typically enable higher bandwidth communications in a compact package. Further, the use of fully electronically tunable antennas which are completely integrated allow for rugged military applications and quick steering over very rough terrain.

In some exemplary embodiments, a mechanical azimuth and elevation adjustments results in approximately a 15 cm height. While this is a low profile Ku and/or Ka band antenna, there are additional optimal designs which may actually improve the height profile of the antenna. In other embodiments, the semi-electronic version having a 5 cm height in which the mechanics are in azimuth but the elevation tracking is done electronically rather than rotating the phase-to-ray panels. By use of electronic tracking rather than manual rotation of the array panels, the only mechanics is the rotation of the azimuth platter; thus vastly increasing the reliability of the overall product. A further embodiments of the invention is a fully electronically steerable antenna which has a height of approximately 2.5 cm. The fully electronically steerable antenna has substantial advantages over the other designs in that the speed of tracking is only limited by the speed of the electronics. Further, the reliability is enhanced such that, it can be used in very difficult and intense environments often encountered by the military. Thus, with the fully electronically steerable module it may be integrated in one or preferably multiple locations on a military vehicle. Where multiple antennas are located on the vehicle, they may be arranged such that they are redundant to increase the probability of the communications system surviving an attack. Further, a back-up antenna may be located on the underside of a hatch such that the tank can simply open the hatch or slide over an armor cover to reveal a back-up antenna. In this manner, communications may be retained even after an enemy has attempted to target the communications of the vehicle. In addition to the reliability improvements, the weight of the fully electronically steerable module is also substantially reduced allowing the module to be utilized in helicopters, air plane, and fighter jet applications. Additionally, the profile is shrunk to a level where it is less detectable by enemy troops and placed in a difficult location to target.

In addition to logistic data, communication applications, and tactical data fed back and forth from a central command center, there is also targeted information data sent to a specific vehicle in the battlefield environment. For example, using the low profile Ku band or Ka band antenna, it is possible to provide a tank commander in real-time a satellite overview picture showing the tank commander's tank imposed on a satellite image of the current surrounding of the tank together with information providing overlay on the satellite image of all the other tanks on the battlefield, to which the tank commander is in charge, as well as the enemy tank positions taken via infrared photos. In this manner, a tank commander will know what's over the other hill before he actually commands his tanks and troops to progress over that hill. He can target enemy tanks that cannot even see the tanks of the tank commander. By using the natural trajectory of the tank's shells, the tank commander can use buildings, trees, and other terrain to hide from enemy tanks while at the same time using air plane and satellite imagery (including infrared imagery) coupled with GPS correlation to the imagery to target tanks, positions, and other enemy assets that cannot even see the tank. Further, the tank commander as well as all of the other units under the tank commander's command cam knows precisely where each other are relative to their own tank so as to prevent friendly fire incidents.

Additionally, the data provided to the tank commander (the targeted information specific data), can be disabled upon any vehicle falling into enemy hands. In this manner, a video inside the tank and/or an explosion indicator will immediately signal the central tank command that a vehicle has been taken over; and that vehicle will be eliminated from any targeted information specific to that vehicle so that it will not be utilized by enemy hands. Additionally, a mechanism such as a key-removal or a clear mechanism will be provided to the troops so that if they are in danger of falling into enemy hands, they can push a button and clear access to targeted specific information.

The on-site networks 201*a* may include a local area network located within a command center, a wireless network between vehicles and/or ground troops located, for example, within 3,000 feet of one another, a Bluetooth network for allowing voice communications from ground troops and/or individuals in the command center, Internet connectivity, connectivity to various military databases, maps, parts, and logistic ordering information. The network 206 may be configured to include any ATM/frame relay, cell relay, SONET, Internet, Arpanet, and/or other military and intelligence network. In this manner, on the network side of the communication link, many entities may utilize the same date (e.g., targeting data, video data, logistics data, command and control data) originating from the particular vehicle at the other end of the link simultaneously. Additionally, antennas on the vehicles may collect radio and/or data from enemy transmission for relaying back to a centralized intelligence facility for assessment. Where the transmissions are in a foreign language, they may be forwarded to a centralized translation facility for assessment. In one embodiment, a security agency or other centralized site can use the military vehicles in the field to monitor, decrypt and/or decode enemy transmissions. In still further embodiments, a battlefield commander at a remote location may monitor the view of the commander from each asset (e.g., vehicle) to assess the battle field or disaster area situation for his or herself. This view may be recorded and/or routed simultaneously to a variety of organizations such as the tank commander of the brigade on site, a remote command center monitoring the progress of the battle, an intelligence organization, logistics, artillery, air support, navel vessels, etc., which all may use the same data either at the same time or at a later time to derive intelligence data, ensure that bombs/shells are not being dropped on friendly positions, that the correct assets such as tanks, artillery, bombs, mortars, supplies, ammunition, tanks, and other assets are routed to the positions were they are most needed. The advantage of the network connections 206 is that the battlefield commander decision may be augmented by information obtained and processed from many other assets on the battle field including plane and satellite images (infrared, graphic, etc.), intelligence data, and/or logistic data. Many organizations can have access to huge amounts of data from every military vehicle in the field and make informed decisions about the battlefield management plan.

A centralized command center can be established which may have large LCD/Plasma screens filling the walls. In this command center, a commander can view satellite images/maps of all of his assets. Using a cursor, the commander may zoom in on any one area of the battle field and immediately assess the number of vehicles disabled, the number remaining, the location and type of all of the vehicles, and even zoom to the level of seeing precisely what the commander of the vehicle is seeing out of his window by simply clicking on the vehicle. Still further, by clicking on the command group icon, the commander may see a mosaic of the views from all of the command vehicles on the screen. Any one of these views may be selected and blown up. Cruise Missiles, mortars, shells, bombs (including smart bombs), may be targeted in the area where any vehicle and/or command is facing stiff resistance. In addition, the commander may monitor the position, movements, and commands on the ground to ensure that the orders from the centralized command are being carried out correctly.

In still further embodiments of the command display, the commander may view a satellite image of the battle field from above, but may also have a three dimensional view by rotating his angle of view down to the view being seen by each of the assets in the field. Further, software may use the GPS coordinates together with a direction indicator from the vehicle to determine where the camera in the vehicle is pointing. By aggregating the camera images from each vehicle using software, the commander may see a view around the room of the entire battle field from every angle available from any vehicle. These may be concatenated together so that overlaps are eliminated and every angle is covered.

Using the combined GPS, video, and/or targeting data from each of the vehicles (e.g., by marking vehicles that are on the front line and using range finders located within the targeting systems) the command center, command center software, and/or intelligence analysis organization may determine the boundary of the enemy's front lines and troop strength. This information may then be relayed simultaneously to each of the assets in the field such as artillery, navel vessels, helicopters, cruise missile launchers, rocket launchers, planes, and drones to target fire on the enemy positions. An intelligence center or software may determine which assets have the most ammunition and range to reach the desired enemy lines and then direct those assets based on a knowledge base to target the appropriate location. Other assets (e.g., missiles and planes) could target areas that are out of range for other assets.

Additionally, the enemy line finder being handled by the network 206 side of the battlefield management may supply data to close air support such and other air craft. In this manner, an aircraft has position data on all friendly as well as all enemy positions. The close air support can also include the blast radius of the bomb they are planning to drop to ensure the friendly troops are outside the blast radius. The blast radius and therefore the targeting coordinates can be modified depending on type of ordnance being dropped. For example, a 5000 pound bomb will have a different blast radius from an artillery shell. The software can automatically determine the target location for the particular ordinance being utilized taking into account the enemy position, the friendly asset position, as well as the distance and terrain between the two. Thus, if a mountain, hill, or building sits between the friendly asset and the enemy, a closer targeting proximity may be selected. However, if the enemy is too close to the friendly position, a location behind the enemy may be selected so that the deadly range encompasses the enemy, but not the friendly position. Since all of these decisions may be made in real time and communicated to all of the assets in real time, software assist and artificial intelligence routines may be utilized to accomplish this task.

An important aspect of the present invention is that the low-profile Ku and/or Ka band antenna is relatively indifferent to which specific satellite is used, being able to work with a variety of military or commercially available satellite transponders. This is particularly advantageous in a military environment such that, wherever a vehicle is deployed in the world, a GPS signal will immediately inform the vehicle where to lock on to certain signals. Additionally, for example, the logistic signals may be provided by a first satellite and the tactical signals may be provided by a second satellite and the on-site information signals may be provided by a third satellite. Thus, a single vehicle is not limited to a particular satellite but in fact, may scan, alter, and change the satellites to which it is connected depending on the current location of the vehicle coupled with the type of information the vehicle which is to receive. This also provides redundancy if one satellite is being jammed or if an enemy has knocked out a satellite.

In addition to being able to work with various Ku and/or Ka band satellites, the advantage of the present system is that it may use satellites that are in an inclined orbit (e.g., orbiting about the equatorial plane such that the ground trace has a figure-eight shape). Because the present antenna is able to track the satellite very inexpensively it is able to track the moving ground trace of the satellite and therefore, use satellites at the end of their life when the satellite may have run out of station keeping fuel but still has operational electronics. In this case, the present invention allows the satellite to be used for an additional several years beyond its "commercial" lifetime thereby providing very cost effective satellite capacity.

Another application for the low-profile Ku antenna is for emergency communication for first responders in a disaster relief situation. In this environment, a vehicle and/or helicopter and/or mobile communication center transported via helicopter and/or vehicle is equipped with a low-profile Ku and/or Ka band antenna to replace the terrestrial infrastructure which is often not present after a disaster. In this way, the mobile infrastructure and/or vehicle may be connected to, for example: FEMA, the Red Cross, the military, and other government disaster relief organizations such that appropriate food, shelters, and other materials may be transported to the appropriate locations under command and control from the emergency communication center. Additionally, the government may monitor the movement of food, supplies, and other equipment in and out of the disaster relief as well as review satellite photos of the region which reflect any impacts to the region and locate stranded and/or missing personnel by virtue of the satellite photos. The personnel who are in trouble may be instructed to mark the top of their houses, buildings, or other locations where people are present with a large white 'X' which may be seen from a satellite photo.

Another application for the low profile mobile Ku band terminals is that of effective border patrol where the terminals, mounted on moving vehicles, provide remote communications for border security personnel.

The present application includes any novel feature or combination of features disclosed herein either explicitly or any generalization thereof. While the features have been described with respect to specific examples, those skilled in the art will appreciate that there are numerous variations and permutations of the above described systems and techniques. For example, each of the aspects of the invention in the summary of the invention may be combined with each other and/or with aspects and embodiments of the invention described herein in any combination or sub combination. Thus, the spirit and scope of the application should be construed broadly.

Mobile Medical Services (Telemedicine) For Disaster Relief and/or Military Field Hospitals Currently, mobile field hospitals, ambulances, and rescue helicopters use a radio to communicate the patient's condition back to the home base/hospital and then to receive instructions based on the conditions conveyed. Alternatively, the ambulance/medic uses a check list to render services. Even where a doctor is on the other end of the line, the doctor has no way to observe the patient or the situation from a remote location. Thus, his examination is delayed until the patient arrives. Thus, tests and other procedures are also delayed until after this initial diagnosis. The low profile two-way concept allows the doctor(s) at the hospital the ability to monitor remotely medical conditions and view the patients to help guide critical care situations in the hands of a medic. It is not always possible to have all the needed doctors need on-site and a two-way high speed connection can allow more highly valued personnel to remain in one location while delivering critical care services through surrogates in many locations. For example, if a field unit has a broken leg or other such injury, the medic using a man-pack two-way apparatus can receive more detailed instructions via a video conference with a doctor back at a field hospital.

An extension of the same concept could be used for field repair of tanks and other equipment. Currently, the military has mobile machine shops that are assigned to logistics units. They have all the parts, electronics, and equipment to fix and maintain portions of the battlefield equipment. However, it is impossible to expect the mechanic assigned to the machine shop to be an expert with respect to all of the equipment. This same concept would allow a group of experts to assist in the repair of very complex systems in which the individual mechanics lack expertise. A helmet mounted camera and an ear piece (on the mechanic or medic) would allow a remote expert to walk the mechanic/medic through the repair. Alternatively, the mechanic may be provided with a video or photocopy transmission of the appropriate repair manual. This is the same concept as above except extended to the repair of another type of system (mechanical as opposed to organic).

Additional applications for the two-way low profile mobile satellite antenna include a dynamic navigation system where the terrain, enemy position, friendly forces positions, mine fields and other data are continuously updated to the vehicle.

Additionally, video file sending and receiving capability (Include recording) may be implemented. Further, the vehicles may have integration with other terrestrial technologies such Cellular, Wi-Fi and WiMAX. Further, the vehicle may broadcast information via re-transmitting or a remote user may send information such as video back to a community of users.

News Gathering

Yet another application of the mobile low profile terminals is for remote news gathering and reporting from locations where terrestrial means are not feasible and where mobility and high speed communications are important. Examples include live video feeds from combat areas with good video quality—better than can be achieved with relatively narrowband signals. Further, remote monitoring vehicles with multiple cameras can be setup and strategically positioned in a war zone. Thus, news reporting and camera images of a city under attack can be taken from a vehicle without notice. The vehicle and/or mobile reporting unit can be parked in a city or atop a building where it is expected that an attack is to occur. Thus, a news organization such as CNN can have realtime reporting (including video feed) of various explosions and/or bombs without endangering personnel. The personal can be narrating the events while still being located remote from the camera. This provides realtime images that captivate the audience while still avoiding danger to the personnel.

Figure 55:
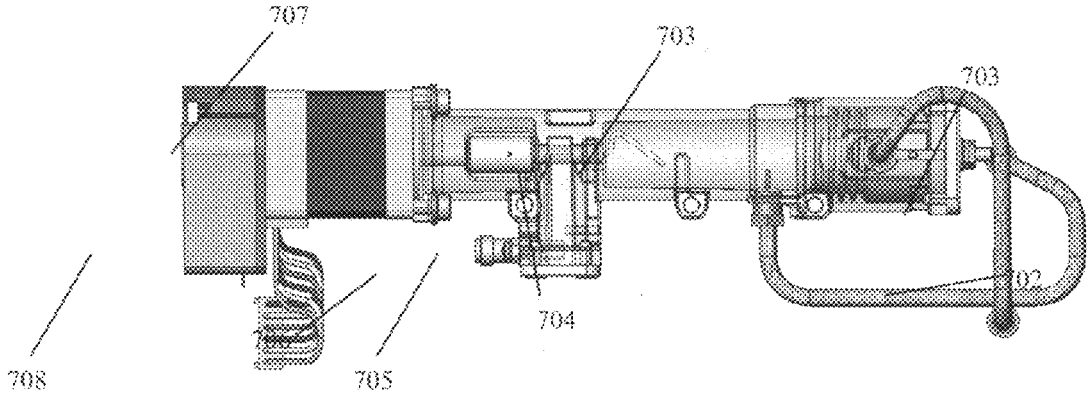
FIG. 55 illustrates embodiment of the terminal polarization control module.

In one preferred embodiment mechanical polarization control device may be used. One possible exemplary embodiment of the mechanical device is shown on FIG. 55. The mechanical device comprises a cylindrical waveguide cavity 703, vertical and horizontal excitation pins and connecting cables 701 and 702; rotating probe 704; waveguide output 705; waveguide to coaxial transition 706; step motor 707 and motor controller 708. In the preferred embodiment the coaxial cables 701 and 702 are connected respectively to the vertical and horizontal polarization antenna outputs. The outputs of the cables are attached to the circular waveguide excitation pins. The excitation pins are arranged properly in order to excite vertical and horizontal electric fields within the circular waveguide cavity 703 having 90 degrees phase difference for the central frequency of the desired band of operation. In that way the pins excite within the circular waveguide cavity 703 a wave mode, which comprises rotating electric field, which may excite tilted linear polarization in the rotating probe 704. The tilt angle of the linear tilted polarization depends exactly of the angle of the probe rotation with respect to its vertical position. The rotating probe 704 excites linearly polarized field in the rectangular waveguide 705, which may be transferred to the device output by the waveguide to coaxial transition 706. Using the disclosed above technique the tilt angle of the signal with linear polarization at the device output 706 could be controlled by the rotation of the probe 704 using a step motor 707. The step motor may be controlled to rotate the probe to the required position calculated by the antenna terminal CPU using controller 708. The required polarization tilt and respectively the rotating probe 704 position may be calculated using information about the geographical position of the antenna terminal, provided by the build in GPS module, position of the selected for communication satellite, stored in the CPU memory and information of the dynamic mobile platform inclination provided by a gyro inclination sensor.

Figure 56:
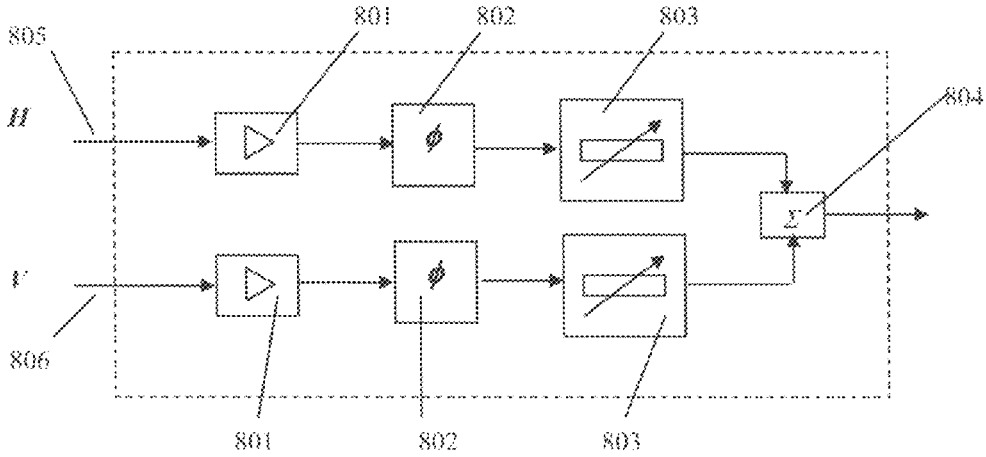
FIG. 56 illustrates a block diagram of the embodiment shown in FIG. 55.

Another preferred embodiment of the polarization-controlling device may use electronic polarization tilt adjustment. One exemplary embodiment of the electronic polarization controlling device is shown on FIG. 56. The polarization controlling device comprises two independent signal flow channels each one of them comprising an amplifier 801, electronic phaseshifter 802 and electronically controllable attenuator 803. The two signal passes may process independently the signals coming from the vertical polarization antenna output 805 as well as that coming from the horizontal polarization antenna output 806. The signals are amplified in order to compensate the polarization controlling device losses by the amplifiers 801 and then their amplitudes and phases are adjusted properly by the phase shifters 802 and attenuators 803 in order to achieved the required polarization tilt at the device output after the signals summation in the combining circuit 804. The electronically controlled phase shifters 802 and attenuators 803 may be produced as hybrid or monolithic circuits comprising microwave diodes, transistors, micromechanical or other types of microwave controlling devices. The electronically polarization controlling device is controlled by the antenna terminal CPU. The required polarization tilt and respectively the introduced by the phaseshifters 802 phase shifts and the attenuations by the attenuators 803 may be calculated using information about the geographical position of the antenna terminal, provided by the build in GPS module, position of the selected for communication satellite, stored in the CPU memory and information of the dynamic mobile platform inclination provided by a gyro inclination sensor.

Embodiments of the present invention are being tested under a Special Temporary Authority for experimental use issued by the Federal Communication Commission (FCC) of the United States government to test its terminals throughout the continental United States ("CONUS"). RaySat is currently testing its technology under the authority of an experimental license issued by the FCC, call sign WD2XTB (issued Aug. 8, 2005). Embodiments of the invention will for the first time, permit users to have data communications on the move while traveling in vehicles, including emergency responder and military vehicles, trucks, cars, trains, recreational vehicles, and other in-motion platforms. In view of the success of this testing in actually deployed systems, the present assignee has applied for a permanent FCC license. Service will be provided using Ku-Band frequencies in communication with any of the following satellites:

TABLE 1

| Satellites | | |
|---|---|---|
| Company | Satellite | Location |
| Intelsat | Intelsat-Americas 7 | 129° W |
| Intelsat | Intelsat Americas 8 | 89° W |
| SES Americom | AMC-4 | 101° W |
| SES Americom | AMC-5 | 79° W |
| SES Americom | AMC-6 | 72° W |
| PanAmSat | SBS-6 | 74° W |
| Horizons | Horizons-1 | 127° W |

It is anticipated that communications with the satellites will be conducted through one or more of the available hub facilities:

Users of the RaySat system are expected at least initially to be primarily government and commercial enterprise customers, including those serving federal government agencies, state and local emergency responders, the U.S. military, transportation companies, RV's, railroads, planes, newsgathering companies and others with a need to access high-speed data communications aboard vehicles in motion. The forward channel offers speeds of 1 to 14 Mbps based on link budget, with a return channel of 64 Kbps to 2 Mbps or more. The system may utilize a standard IP interface and be capable of operating all conventional IP services, including high-speed internet access, Voice Over IP, access to government and corporate intranets, VPN, streaming video and audio, file sharing, and other services.

It is anticipated that the greatest operational need for this service to come from emergency first responders such as FEMA and state and local government agencies, all of which have a voracious appetite for data access in all phases of their operations, as witnessed by the large numbers of grants of special temporary authority for satellite networks in the aftermath of Hurricanes Katrina and Rita. These agencies are at present limited to fixed, or at best fly-away or "pop-up," solutions for high-speed data access. RaySat's solution will allow these agencies to remain connected during all phases of their operations, including while traveling from location to location, which will provide them with significant advantages in terms of productivity and the ability to complete their missions. This is particularly true in light of one of the major benefits of utilizing a mobile satellite communications solution for data communication during disasters: total independence from the terrestrial infrastructure. Not only is the system isolated from the terrestrial communications system, but it draws its power requirements from the vehicle and is thus completely independent of the need for a local power supply or even external generator or battery power.

Embodiments of the system include a mobile 2-way phase combined antenna, which operates in the Ku FSS frequency band (14.0 GHz-14.5 GHz transmit and 11.7 GHz-12. GHz receive). The antenna may be configured to automatically search for and acquire the designated satellite and maintain precise pointing via automatic control of the azimuth, elevation and polarization angles while the vehicle is on the move. The antenna may include an outdoor antenna unit, an indoor controller and a satellite communication modem. The system may further be configured to use GPS signals to determine its location for acquiring the appropriate satellite.

In certain embodiments, the initial acquisition time is less than 60 seconds, and the antenna is capable of tracking through the horizontal plane at tracking speed of 60 degrees per second. The antenna is mechanically aligned in azimuth and elevation plane. The antenna peaks in azimuth through mechanical scanning and through multiple receive beams in the elevation plane. The antenna has 3-axis gyroscopes which allow the position of the satellite to be known. In the event the antenna mechanically mis-points by more than 0.5 degrees, the antenna system will mute the transmit carrier. The transmit carrier is also muted if the system passes through a dead zone (e.g., under a bridge, under a building, or through a tunnel). When emerging from the other side, the system will mute it's transmit until the receive signal is reacquired. This is an important feature for avoiding interference with adjacent satellites. It is also required for certain unexpected events such as a tank or other vehicle making a sudden movement.

The antenna transmit panel is longer in the horizontal dimension, which results in the transmit pattern being narrowest along this dimension. The beam is widest in the elevation plane since this corresponds to the smallest antenna dimension. If the antenna is located at the same longitude as the satellite, the transmit pattern will be at its narrowest. If the antenna is at a different longitude than the satellite, the transmit beam widens, since it becomes an amalgamation of the horizontal and vertical pattern. This widened beam is called the skew angle. The skew angle is a term used to describe the offset angle between the longest axes of the antenna and the arc of the geostationary plane. The skew angle can be computed as follows: Skew Angle=arctan [Sin(Ø) Cos(Θ)/Sin (Θ)], where Ø=Satellite Longitude−Site Longitude; Θ=Site Latitude. The worst case skew angle for the satellites of interest is 50 degrees in the United States when used with the satellites described above in Table 1. Other skew angles apply to other parts of the world depending on the satellite selected.

A sample of the skew angles for IA-8 is listed below:

TABLE 3

Sample Skew Angles

| Site Name | Site Latitude | Site Longitude | Site Skew Angle |
|---|---|---|---|
| Portland OR | 45.5N | 122.7W | −28.6 |
| San Diego CA | 32.4N | 117.2W | −36.7 |
| Bangor ME | 44.8N | 68.8W | 19.2 |
| Miami FL | 25.8N | 80.2W | 17.6 |

Systems in accordance with the present invention may be configured to utilize the space segment and hubs as provided in Tables 1 and 2, supra. The applicant has developed a unique business method for gaining approval of communication on the move applications. Geosynchronous satellites over the United States are spaced apart by 2 degrees. In other parts of the world, the satellites may be spaced apart by three degrees. This close spacing of geosynchronous satellites causes regulatory concerns particularly for mobile land based satellite terminals. As the number of these terminals increases, the amount of interference from improperly operating terminals could increase without proper protections. This could interfere with not only the target satellite, but also adjacent satellites. However, these concerns may be alleviated by taking certain technical protection measures and working directly with the owners of adjacent satellites. For example, by coordinating with adjacent satellite operators (e.g., those spaced physically near the target satellite), and obtaining waiver letters from those adjacent satellite companies, FCC approval of mobile land based satellite terminals may be made possible. This coordination between adjacent satellite owners ensures compliance with regulatory rules governing two or three degree spacing as well as acceptance of the inventions protection measures against errant emission characteristics.

Protection of Other Ku-Band Users

In accordance with the present invention, certain measures may be implemented in the mobile satellite system to ensure protection against unnecessary interference with ground based stations. For example, in one frequency spectrum of interest, the 14.0-14.2 GHz band, there are a number of previously allocated systems. For example, this frequency band may be allocated on a secondary basis to the space research service for Federal Government and non-Federal Government use. As a non-limiting example, the only currently-authorized non-FSS CONUS facility in this portion of the Ku-band uplink is a National Aeronautics and Space Administration (NASA) space research Tracking and Data Relay Satellite System (TDRSS) receive facility (located in White Sands, N.M.) that operate with frequency assignments in the 14.0-14.05 GHz band. Other government operations in the Ku-Band include radioastronomy sites operations in the 14.47-14.5 GHz band at a number of CONUS locations operated under the auspices of the National Science Foundation ("NSF").

Terminals in accordance with the present invention, will protect these and similar uplink operations from harmful interference by means of exclusion zones around the relevant sites within which the antennas will be prohibited from operating, and, in the case of the NSF sites, by restricting operations during times when observations in the relevant band are scheduled to occur. The coordinates of these exclusion zones and associated frequencies may be programmed into the firmware of the antenna and terminal antenna transmissions within these zones may be enforced by means of the GPS system integrated into the antenna and/or associated vehicle.

In a business method associated with the present invention, an applicant for a FCC or similar license may reach agreements with entities (e.g., NASA and NSF) regarding measures that will be undertaken to protect the current and future transmission sites (e.g., radioastronomy sites). These agreements may indicate a preexisting users acquiescence in the use of mobile transmitters having frequencies that overlap with existing permanent transmission facilities.

In further aspects of the invention, certain satellites may be placed in the Ku-Band in Non Geostationary Orbit ("NGSO"). Where NGSO satellites are present, aspects of the invention include operating at reduced power levels where the risk of interference due to off-axis EIRP density levels in the elevation plane are present.

In a business method associated with the present invention, certain waivers are requested from a government entity, e.g., the FCC associated with the provision of a low, mid, and high frequency antenna radiation patterns for both planes associated with mobile land-based rectangular array antennas. These waivers may include waivers for a worst case, 50 degree skew angle, pattern.

In still further aspects of the invention, the antenna may be constructed to afford a combination of the antenna gain pattern and worst case RF power density yields an off-axis EIRP density which meets the combined FCC 25.209 and 25.212 specifications at all angles in the azimuth plane on the low, mid, high frequency bands for the vertical and horizontal planes.

In still further aspects of the invention, the points of communication include satellites of Intelsat, PanAmSat, Horizons, and SES Americom. Specifically, exemplary satellites included in this invention are Intelsat Americas 8 (IA8) at 89 degrees west longitude, SES Americom AMC-4 at 101 degrees west longitude, SES Americom AMC-5 at 79 degrees west longitude, SES Americom AMC-6 at 72 degrees west longitude, PanAmSat SBS-6 at 74 degree west longitude, Horizons 1 at 127 degrees west longitude, and Intelsat Americas (IA7) at 129 degrees west longitude. As can be seen in Table 4, there are adjacent satellites up to 6 degrees removed from each of these desired satellites. In business methods associated with the present invention, the interests of the various satellite operators (e.g., PanAmSat, Horizons, Intelsat, and SES Americom) are coordinated to ensure no unacceptable interference is caused from or into their network by systems of the present inventions. This business method includes the profision of testimony (e.g., affidavits) or other evidence which demonstrates the ability of mobile satellite systems to be used on and adjacent to satellites operated by one or more domestic carriers, including PanAmSat, Horizons, Intelsat, and SES Americom.

In a further business method associated with the present invention, government waivers (e.g., FCC waivers) are sought for mobile satellite antennas (e.g., rectangular arrays) in accordance with the present inventions for antenna radiation patterns not in compliance with FCC Section 25.209(a)(2) for regions not in the plane of the geostationary arc, i.e., the elevation plane. The method includes measuring the mid-band elevation EIRP patterns for vertical and horizontal planes of a land based mobile satellite antenna and comparing these to certain federal regulations, and seeking waivers for regions not in the plane of the geostationary arc, i.e., in the elevation plane. Further methods in accordance with the invention involve reduction of power levels to avoid interference in the region of non-geostationary arc satellites.

TABLE 4

List of Ku-Band Domestic Satellites (Satellites in bold are points of communication requested in this Application)

| Satellite Name | Operator | Orbital Position (W.L.) |
|---|---|---|
| **AMC 6** | **SES Americom** | **72.0°** |
| **SBS 6** | **PanAmSat** | **74.0°** |
| **AMC 5** | **SES Americom** | **79.0°** |
| AMC 9 | SES Americom | 83.0° |
| AMC 2 | SES Americom | 85.0° |
| AMC 16 | SES Americom | 85.0° |
| AMC 3 | SES Americom | 87.0° |
| **Intelsat Americas 8** | **Intelsat** | **89.0°** |
| Galaxy 11 | PanAmSat | 91.0° |
| Intelsat Americas 6 | Intelsat | 93.0° |
| Galaxy 3C | PanAmSat | 95.0° |
| Intelsat Americas 5 | Intelsat | 97.0° |
| Galaxy 4R | PanAmSat | 99.0° |
| **AMC 4** | **SES Americom** | **101.0°** |
| AMC 1 | SES Americom | 103.0° |
| AMC 15 | SES Americom | 105.0° |
| Intelsat Americas 13 | Intelsat | 121.0° |
| Galaxy 10R | PanAmSat | 123.0° |
| **Horizons 1** | **Horizons** | **127.0°** |
| **Intelsat Americas 7** | *Intelsat* | **129.0°** |

Table 5—RaySat StealthRay Off-Axis EIRP Compliance

Further embodiments of the invention will be apparent to those skilled in the art including many combinations and subcombinations of the above embodiments and features of the invention.

We claim:

1. A system for communication, comprising:

a low profile, two-way vehicle-mounted satellite antenna;

a plurality of tracking sensors including a received signal strength indicator circuit, one or more gyroscopes, an inclinometer and a global positioning system receiver;

an electromechanical polarizer having a mechanically rotatable input probe set in a circular waveguide; and a processor, configured to receive input from the tracking sensors and use the input to autonomously acquire, and maintain beam angle tracking of, a satellite while a vehicle on which the antenna is mounted is in motion, and to track linear polarization orientation of a linearly polarized satellite signal by rotating the electromechanical polarizer's input probe.

2. The system according to claim 1 wherein the system is configured to operate in the X-band, Ku-band, Ka-band, or Q-band.

3. The system of claim 1, wherein the antenna is further configured to carry signals for a group video conference with multiple additional parties while the vehicle is in motion.

4. The system of claim 1, wherein the system is further configured to provide position reporting to a central command.

5. The system of claim 1, wherein the processor is further configured to use an input from the one or more gyroscopes to maintain a satellite track in the event of a signal interruption with a tracked satellite.

6. The system of claim 1, wherein the processor is further configured to use an input from the one or more gyroscopes to determine and compensate for a tracking error with a tracked satellite.

7. The system of claim 1, further comprising a wi-fi wireless interface, and further configured to use the wireless interface to establish a wireless communication network in the vicinity of the vehicle.

8. The system of claim 7, further configured to use the wireless interface and wireless communication network to relay information between a satellite and one or more wireless devices in the vehicle's vicinity.

9. The system of claim 1, further comprising a cellular telephone network interface, configured to wirelessly communicate with one or more mobile wireless cellular telephones.

10. The system of claim 1, further comprising a short range land mobile radio, configured to relay information between a satellite and one or more other short range land mobile radios.

11. The system of claim 1, further configured to relay surveillance information between a surveillance system and a command center via satellite.

12. The system of claim 1, further configured to relay information between a first responder unit and a command center via satellite.

13. The system of claim 1, said polarizer's waveguide further comprising:

two orthogonal output probes connected to horizontal and vertical antenna ports to provide output signals whose polarization orientation is determined by the rotation angle of the input probe.

14. The system of claim 1, further configured to use forward error correction rate coding of ⅓ or less in order to minimize emissions to satellites adjacent to a target satellite.

15. The system of claim 1, further configured to switch operation between L-band and either X-band or Ku-band.

16. An apparatus comprising:

a low profile, two-way, vehicle-mounted, Ku-band antenna;

an electromechanical polarizer having a rotatable input probe; and a processor, configured to:

terminate antenna transmissions within predefined exclusion zones based on global positioning system (GPS) data identifying a location of the antenna; and autonomously acquire and track linear polarization orientation of a linearly polarized satellite signal while the vehicle is in motion through rotation of the polarizer input probe.

17. The apparatus of claim 16, wherein processor is further configured to identify a predefined exclusion zone based on time of day.

18. The apparatus of claim 16, wherein the processor is configured to perform the termination automatically.

* * * * *

UNITED STATES PATENT AND TRADEMARK OFFICE

CERTIFICATE OF CORRECTION

PATENT NO. : 7,911,400 B2
APPLICATION NO. : 11/647576
DATED : March 22, 2011
INVENTOR(S) : Ilan Kaplan et al.

It is certified that error appears in the above-identified patent and that said Letters Patent is hereby corrected as shown below:

On the Title page, section (75) "Inventors:"

Please insert the following: --Victor Boyanov, Sofia (BG); Daniel Francis DiFonzo, Vienna, VA (US); Kevin Arthur Bruestle, Falls Church, VA (US); Yoel Gat, Airport City (IL); Robert Yip, Vienna, VA (US); Stanimir Dimitrov Kamenopolski, Sofia (BG)--

Signed and Sealed this
Thirty-first Day of January, 2012

David J. Kappos

David J. Kappos
*Director of the United States Patent and Trademark Office*